United States Patent [19]

Shah et al.

[11] 4,349,111

[45] Sep. 14, 1982

[54] PAPER CURRENCY DEVICE

[75] Inventors: Hasmukh R. Shah, Hot Springs, Ark.; Thaddeus M. Jones; Bruce R. Hemingway, both of South Bend, Ind.

[73] Assignee: UMC Industries, Inc., Stamford, Conn.

[21] Appl. No.: 137,425

[22] Filed: Apr. 4, 1980

[51] Int. Cl.[3] ..... B07C 5/344

[52] U.S. Cl. ..... 209/534; 209/567; 194/4 R

[58] Field of Search ..... 209/534, 567; 194/4

[56] References Cited

U.S. PATENT DOCUMENTS 3,245,534 4/1966 Smith et al. ..... 209/567 X 3,280,974 10/1966 Riddle et al. ..... 209/567 X 3,870,629 3/1975 Carter et al. ..... 209/567 X 3,966,047 6/1976 Steiner ..... 209/567 X

*Primary Examiner*—Joseph J. Rolla

*Attorney, Agent, or Firm*—Rey Eilers

[57] ABSTRACT

A bill-handling device provides relative movement between a sensor and a U.S. bill or other object to permit that sensor to sense longitudinally-spaced areas on that U.S. bill or other object which correspond to areas, on authentic U.S. bills or counterfeits thereof, where significant data is found. Data which is obtained during the sensing of those areas is stored, and subsequently is analyzed to determine the authenticity and denomination of the U.S. bill—if it is one of a plurality of bills of specifically-different denominations.

46 Claims, 25 Drawing Figures

POWER ON
484
DELAY 50 mS
486
504
START
INITIALIZE PORTS
506
SET TIMER INTERRUPT ADDRESS
508
510
NO
SW. 146 ON 3 mS
Yes
START MOTOR FORWARD
512
514
STOP MOTOR
NO
SW. 146 ON
516
YES
SW. 156 ON
NO
518
YES
CLEAR DISPLAY STORAGE
520
BLANK DISPLAY
522
DELAY 20 mS
524
INITIALIZE REGISTERS
526
SET ISAR ADDRESS
528
START TIMER 3.9 mS
530
LOAD REG. 5 WITH 1
532
534
LINE COUNT
536
REG. 5 = 1
NO
YES
538
YES
HEAD SIGNAL = 1
NO
540
LOAD REG. 5 WITH 0
542
YES
HEAD SIGNAL = 0
NO
544
LOAD REG. 5 WITH 1
546
INCREMENT REG. 2

TIMER
548
START TIMER 2.3 mS
550
REG. 8=0
552
NO
YES
BILL BORDER LINES
554
≥2
<2
LOAD REG. 8 TO CAUSE BRANCH AT 552
614
ZONE 30
616
YES
SET
646
NO
ZONE 80
618
YES
RESET
652
NO
ZONE 86
620
YES
PORTRAIT BORDER
660
NO
ZONE 87
622
YES
FREQ.
698
NO
ZONE 135
624
YES
SET
740
NO
ZONE 185
626
YES
STOP
742
NO
REG. 7 0
628
YES
CLEAR
630
NO
SKIP
642
BILL BORDER LINES
556
0
1
DECREMENT REG. 4
558
BILL BORDER LINES
560
1
0
LOAD REG. 2 WITH 0
563
LOAD REG. 4 WITH 2
564
ESTABLISH 3.9 mS PERIODS
566
DECREMENT REG. 1
568
REG. 1=0
570
YES
REJECT
576
NO
EI
572
GO TO LINE COUNT
574

ONE
796
798
GR. SEAL >25
YES
806
REJECT
NO
800
GR. SEAL <5
YES
808
REJECT
NO
903
ONE
802
REG. 49 = 1
804
TX 2

820
TWENTY
903
TWENTY
822
DISPLAY = 20
824
TX 2

848
TWO
850
LINE 1 <110 > 59
NO
852
REJECT
YES
854
GR. SEAL <78 >35
NO
REJECT
856
YES
903
TWO
858
DISPLAY = 2
860
TX 2
870
TEN
872
LINE 1 >99 < 175
NO
REJECT
874
YES
876
GR. SEAL >8 < 33
NO
REJECT
878
YES
903
TEN
880
DISPLAY 10
882
TX2

TX 2
768
770
CALL DISPLAY
NO
BILL CLEARED SW. 162
772
YES
774
T STOP
598
DISPLAY
600
ISAR = 48
REG. 0 = 5
602
(ISAR) → A
INC. ISAR
604
A → PORT 4
606
REG. 0 → PORT → 0
STROBE P5-4
608
DECREMENT REG. 0
610
NO
REG. 0 = -1
YES
612
RETURN

PAPER CURRENCY DEVICE

BACKGROUND OF THE INVENTION

It would be desirable to be able to determine the authenticity of U.S. bills of different denominations, and also to determine those denominations. Various devices have been proposed which could distinguish between various denominations of U.S. bills; but none of those devices has been completely satisfactory.

SUMMARY OF THE INVENTION

The present invention provides relative movement between a sensor and a U.S. bill or other object to permit that sensor to sense longitudinally-spaced areas on that U.S. bill or other object which correspond to areas, on authentic U.S. bills or counterfeits thereof, where significant data is found. One of those areas is the leading portion of the border on the black-ink face of a U.S. bill, another area is that which is immediately in front of, in, and immediately behind the black seal on that black-ink face, a third area is the leading portion of the portrait border, a fourth area is the leading one-half of the grid-like portrait background, and the last area is that which is immediately in front of, in, and immediately behind the green seal on that black-ink face. Data which is obtained during the sensing of those areas is stored and subsequently is analyzed to determine the authenticity and denomination of the U.S. bill—if it is one of a plurality of bills of specifically-different denominations. It is, therefore, an object of the present invention to provide relative movement between a sensor and a U.S. bill or other object to permit that sensor to sense longitudinally-spaced areas on that U.S. bill or other object which correspond to areas, on authentic U.S. bills or counterfeits thereof, where significant data is found.

The lines and other markings on U.S. bills are precisely positioned relative to each other during, and as a result of, the engraving of those bills. However, the positions of those lines and other markings relative to the leading edges of those bills are not uniform, because the cutting of the edges of engraved U.S. bills is not done in a precise manner. As a result, it is impossible to provide precise sensing of longitudinally-spaced areas on the black ink face of a U.S. bill where the locations of those areas are referenced to the leading edge of that bill. The present invention makes it possible to provide precise sensing of longitudinally-spaced areas on the black-ink face of a U.S. bill by referencing the locations of those areas to the leading portion of the border of that bill. Once that leading portion of that border has been located, the positions of the longitudinally-spaced areas that are to be sensed are known; and hence precise sensing of those areas is possible. It is, therefore, an object of the present invention to sense the locations of longitudinally-spaced areas on the black-ink face of a U.S. bill by referencing the locations of those areas to the leading portion of the border of that bill.

The spacings between the lines which define the portrait borders on U.S. bills are distinctive; and it would be difficult for most persons to duplicate those spacings if they attempted to use pen and ink to make a counterfeit bill. The present invention senses distances between the leading edges of several of those lines, and thereby is able to determine the authenticity and denominations of U.S. bills with an unusually high degree of precision. It is, therefore, an object of the present invention to sense the distances between the leading edges of several of the lines which define the portrait borders on U.S. bills.

The ink used in engraving the green seal on the black-ink face of U.S. bills is non-magnetic; but the ink used in engraving the adjacent denomination-defining numerals is magnetic. However, if a photocopy of the black-ink face of a U.S. bill were to be made by a copying machine that used magnetic particles, both the seal and the denomination-defining numerals on that copy would be magnetic. The numbers of magnetic-ink lines used in the green seal areas on authentic U.S. bills are usable in distinguishing between different denominations of those bills; and the magnetic lines of a seal made by a copying machine that uses magnetic particles helps distinguish the copy which bears that seal from any U.S. bill. It is, therefore, an object of the present invention to sense the numbers of magnetic-ink lines in the green seal areas on authentic U.S. bills.

A bill-handling device should be able to accept all authentic U.S. bills of selected denominations even though some of those bills are old and have seen rough service. Unfortunately, some of the magnetic ink that is used to engrave the black-ink faces of U.S. bills can be worn away during the handling of those bills over long periods of time—particularly where those bills are folded and unfolded repeatedly. The present invention makes it possible to provide precise determinations of the authenticity and denominations of old U.S. bills—even where some of the magnetic ink that is used to engrave that black-ink faces of those bills has been worn away. Specifically, the present invention measures the distances between the leading edges of a considerable number of consecutively-arranged lines in a U.S. bill, and then determines the average distance between those leading edges. In doing so, the present invention can identify and authenticate old U.S. bills—even if the ink which defines a line in that number of consecutively-arranged lines had been completely worn away. It is, therefore, an object of the present invention to measure the distances between the leading edges of a considerable number of consecutively-arranged lines on a U.S. bill and then determine the average distance between those leading edges.

Other and further objects and advantages of the present invention should become apparent from an examination of the drawing and accompanying description.

In the drawing and accompanying description, one embodiment of the present invention is shown and described; but it is to be understood that the drawing and accompanying description are for purpose of illustration only and do not limit the invention and that the invention will be defined by the appended claims.

DETAILED DESCRIPTION OF THE PREFERRED EMBODIMENT

Major Components of Bill-Handling Device

Figure 1:
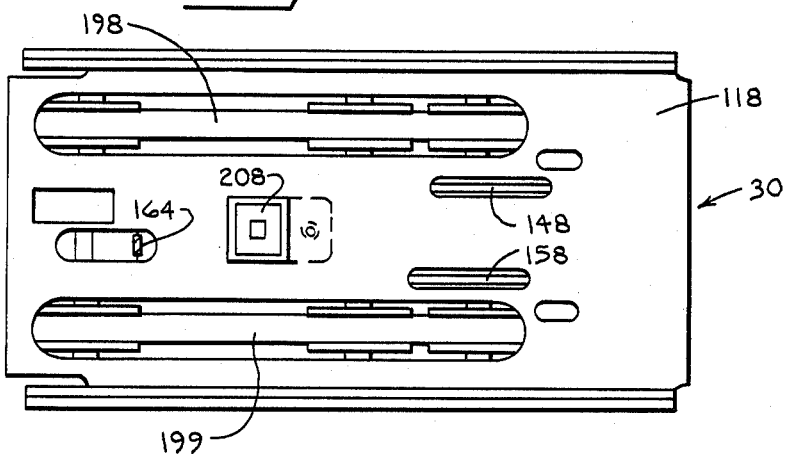
FIG. 1 is a bottom view of the upper platen of one embodiment of transport which can be used in the testing of U.S. bills.
Figure 2:
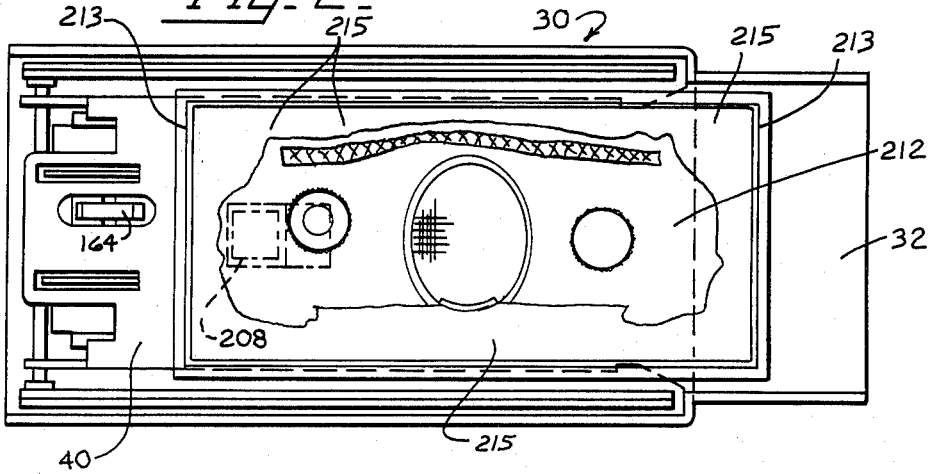
FIG. 2 is a plan view of the lower platen of that transport, and it shows a rough representation of a U.S. bill resting on that platen.

Referring particularly to FIGS. 1 and 2, the numeral 30 denotes a transport for U.S. bills; and that transport has a platform 32 which projects outwardly from the front of a lower platen 40 thereof. A switch actuator 148, of a normally-open single-pole switch 146, normally extends downwardly through a narrow slot in an upper platen 118 of the transport to lie in the path of any bill or similar object that is inserted into that transport. Similarly, a switch actuator 158, for a normally-open single-pole switch 156, normally extends downwardly through a further slot in that upper platen to lie in the path of such a bill or object; and a switch actuator 164, for a normally-open single-pole switch 162, normally extends downwardly through a still further slot in that upper platen to lie in the path of such a bill or object. Continuous belts 198 and 199 are supported by pulleys that are located above the upper platen 118; and the lower "runs" of those belts extend downwardly through elongated wide slots in that platen to engage rollers, not shown, which are supported by the lower platen 40. A motor 562 drives the belts 198 and 199 via a gear train, not shown; and that motor is reversible so it can drive those belts in opposite directions. A MOTOR START AND RUN block 348 supplies power to that motor via relay contacts 436 and 438 and via relay contacts 442 and 444 to operate that motor in the reverse direction at a closely-fixed speed. That MOTOR START AND RUN block also can supply power to that motor via relay contacts 438 and 440 and via relay contacts 444 and 446 to operate that motor in the forward direction at that speed. Whenever that motor operates in the forward direction, it will cause the belts 198 and 199 to move from right to left in FIG. 1. An A.C. generator is mounted in the housing of motor 562; and it responds to rotation of the output shaft of that motor to supply signals to MOTOR START AND RUN block 348 which enable that block to closely regulate the speed of that motor. A plug 428 supplies A.C. to a power supply 430 to enable that power supply to provide D.C. for the MOTOR START AND RUN block 348 and also for motor 562. An NPN transistor 346 selectively supplies a logic "0" or logic "1" to the right-hand input of MOTOR START AND RUN block 348; and that block will respond to a logic "0" at that input to keep motor 562 de-energized, but will respond to a logic "1" at that input to energize that motor. A resistor 342 connects the collector of transistor 346 to power, and the emitter of that transistor is grounded. A resistor 344 connects the base of that transistor to pin 7 of Port 5 of a microprocessor 470.

A relay coil 434 controls the positions of movable relay contacts 438 and 444; and that coil will permit contacts 438 and 444 to be in their "forward" positions—wherein they engage contacts 440 and 446, respectively—whenever that coil is de-energized. However, the contacts 438 and 444 will shift into their "reverse" positions—wherein they are in engagement with contacts 436 and 442, respectively, whenever relay coil 434 is energized.

A display 454, which is an ENVIRONMENTAL TECHNOLOGY, INC. UNIVERSAL DISPLAY MODULE 11141, has six seven-segment units. However, that display is mounted so the two righthandmost seven-segment units thereof are permanently covered. As a result, only the remaining four seven-segment units are visible; and those units are denoted by the numerals 456, 458, 460 and 462. The display 454 can be made to display any one of the following indicia: 1.00, 2.00, 5.00, 10.00 and 20.00.

The transport 30 has a magnetic head 208 which will engage any U.S. bill that is moved through that transport. A combination amplifier and low-pass filter 420 is connected to the output of that magnetic head, a level detector 422 is connected to the output of that combination amplifier and low-pass filter, a Schmitt trigger 424 is connected to the output of that level detector, and a monostable multivibrator 426 is connected to the output of that Schmitt trigger and has its output connected to pin 7 of Port 1 of the microprocessor 470.

The confronting surfaces of the platens 40 and 118 are spaced apart to define a pathway through which a U.S. bill or similar object can be moved; and a patron can easily introduce a U.S. bill into that pathway by resting the leading portion of that bill on the platform 32 and then pushing that leading portion into that pathway. Shortly after that leading portion has been pushed into that pathway, the leading edge of the bill will engage actuator 148; and continued inner movement of the bill will cause that actuator to move far enough to close switch 146.

Various motor starting and running circuits could be used as the MOTOR START AND RUN block 348; but the circuits that are disclosed for the identically-named and numbered block of Jones et al U.S. Pat. No. 3,937,926 for a Validator For Scrip, and that have been used in the BUCKPASSER bill-handling devices marketed by the NRI division of UMC Industries, are preferred. Various generator-equipped motors could be used as the motor 562; but the 9904-120-10804 motor of the Phillips Motor Company is preferred. Similarly, although various transports could be used as the transport 30, the preferred transport for the bill-handling device of the present invention is a modified form of the transport that is described in said patent and that has been used in said BUCKPASSER bill-handling devices. The only modification that is needed in the transport of said patent is the removal of one of the magnetic heads, and the positioning of the remaining magnetic head so it is about midway between the elongated sides of the upper platen 118. Various power supplies could be used as the power supply 430; but the power supply that has been used in said BUCKPASSER bill-handling devices is preferred.

Various magnetic heads could be used as the magnetic head 208, but the identically-numbered magnetic head that is described in said patent, and that has been used in said BUCKPASSER bill-handling devices, is preferred. Various combination amplifier and low-pass filters could be used as the combination amplifier and low-pass filter 402; but the combination amplifier and low-pass filter that has been used in the BUCKPASSER bill-handling devices is preferred. That combination amplifier and low-pass filter amplifies and passes signals close to one kilohertz and attenuates higher-frequency signals, electrical noise and other transients. Various devices could be used as the level detector 422, but one-quarter of a National LM324 Operational Amplifier is preferred. Various devices could be used as Schmitt trigger 424, but one-quarter of an RCA 4093 Schmitt trigger is preferred. Various devices could be used as the multivibrator 426, but one-half of an RCA 4013 D-type Flip Flop is preferred. Various microprocessors could be used as the microprocessor 470; but a preferred form of microprocessor consists of an Environmental Technology, Inc. LITTLE BIT COMPUTER 10154A and an Environmental Technology, Inc. PROTOTYPE KIT 11479. The LITTLE BIT COMPUTER 10154A includes a Fairchild F8-3850 central processing unit, a Fairchild F8-3853 static memory interface, a Fairchild F8-3861 peripheral input/output, and a one kilobyte Motorola MCM2708 E-PROM.

TURN ON

Whenever the bill-handling device is turned on, as by supplying power to the microprocessor 470, that microprocessor will automatically do two things. First, it will load into the program counter the address representing the beginning of the program, and, second, it will block the interrupts. Thereupon, the program will, via connective 484 in FIG. 5, initiate the approximately fifty millisecond (50 MS) delay of step 486. That delay is provided by the combination of a system clocking frequency of two (2) megahertz and the delay sub-routine of FIG. 6. DELAY connective 488, steps 490, 492, 494, 496, 498 and 500, and RETURN connective 502 constitute the delay subroutine of FIG. 6. During step 490 of that sub-routine, twenty (20) is loaded into scratchpad register 4, during step 492 two hundred and fifty-five (255) is loaded into scratchpad register 2, and during step 494 the value in scratchpad register 2 is decremented by one (1) to two hundred and fifty-four (254). The immediately-succeeding ANDING function during step 496 will determine that the count in scratchpad register 2 is not zero (0); and the resulting NO will cause the program to loop to step 494. The consequent decrementing of the value in scratchpad register 2 to two hundred and fifty-three (253) will permit the next ANDING function of step 496 to develop a further NO. The program will loop through steps 494 and 496 a further two hundred and fifty-three times until the ANDING function of step 496 determines that the value in scratchpad register 2 has been progressively decremented to zero (0); and the elapsed time between the loading of scratchpad register 2 and the development of the YES by the ANDING function of step 496 will be about two and one-half milliseconds (2.5 MS).

The YES of step 496 will enable the value in scratchpad register 4 to be decremented from twenty (20) to nineteen (19) during step 498. The immediately-succeeding ANDING function of step 500 will determine that the value in that scratchpad register is not zero (0); and the resulting NO will loop the program to step 492. During the latter step, two hundred and fifty-five (255) will again be loaded into scratchpad register 2; and, thereafter, steps 494 and 496 will consume a further approximately two and one-half milliseconds (2.5 MS) until step 496 again provides a YES. Further loopings of the program through steps 492, 494, 496, 498 and 500 will repeatedly decrement and then re-load scratchpad register 2 until the value in scratchpad register 4 is progressively decremented to zero (0). The total time between the loading and the complete decrementing of the latter scratchpad register will be approximately fifty milliseconds (50 MS); and hence when the program returns to step 486 of FIG. 5, via the RETURN connective 502 of FIG. 6, the desired delay will have been provided.

Thereupon, during step 506, the control ports of the microprocessor 470 will be "initialized" to have the following logic values:

| PORT | PIN | LOGIC VALUE |
|---|---|---|
| 0 | 0 | 0 |
| 0 | 1 | 0 |
| 0 | 2 | 0 |
| 1 | 4 | 0 |
| 1 | 5 | 0 |
| 1 | 6 | 0 |
| 1 | 7 | 0 |
| 4 | 0 | 0 |
| 4 | 1 | 0 |
| 4 | 2 | 0 |
| 4 | 3 | 0 |
| 4 | 4 | 0 |
| 5 | 1 | 1 |
| 5 | 2 | 1 |
| 5 | 6 | 1 |
| 5 | 7 | 0 |

The control ports develop signals, at the corresponding input pins of microprocessor 470, which are the complements of the logic values to which those control ports are initialized. As a result, each of the input pins of microprocessor 470, which correspond to pins 1, 2 and 6 of Port 5 will provide a logic "0" whereas each of the input pins of that microprocessor which correspond to pins 0, 1 and 2 of Port 0, to pins 4, 5, 6 and 7 of Port 1, to pins 0, 1, 2, 3 and 4 of Port 4, and to pin 7 of Port 5 will provide a logic "1".

Figure 7:
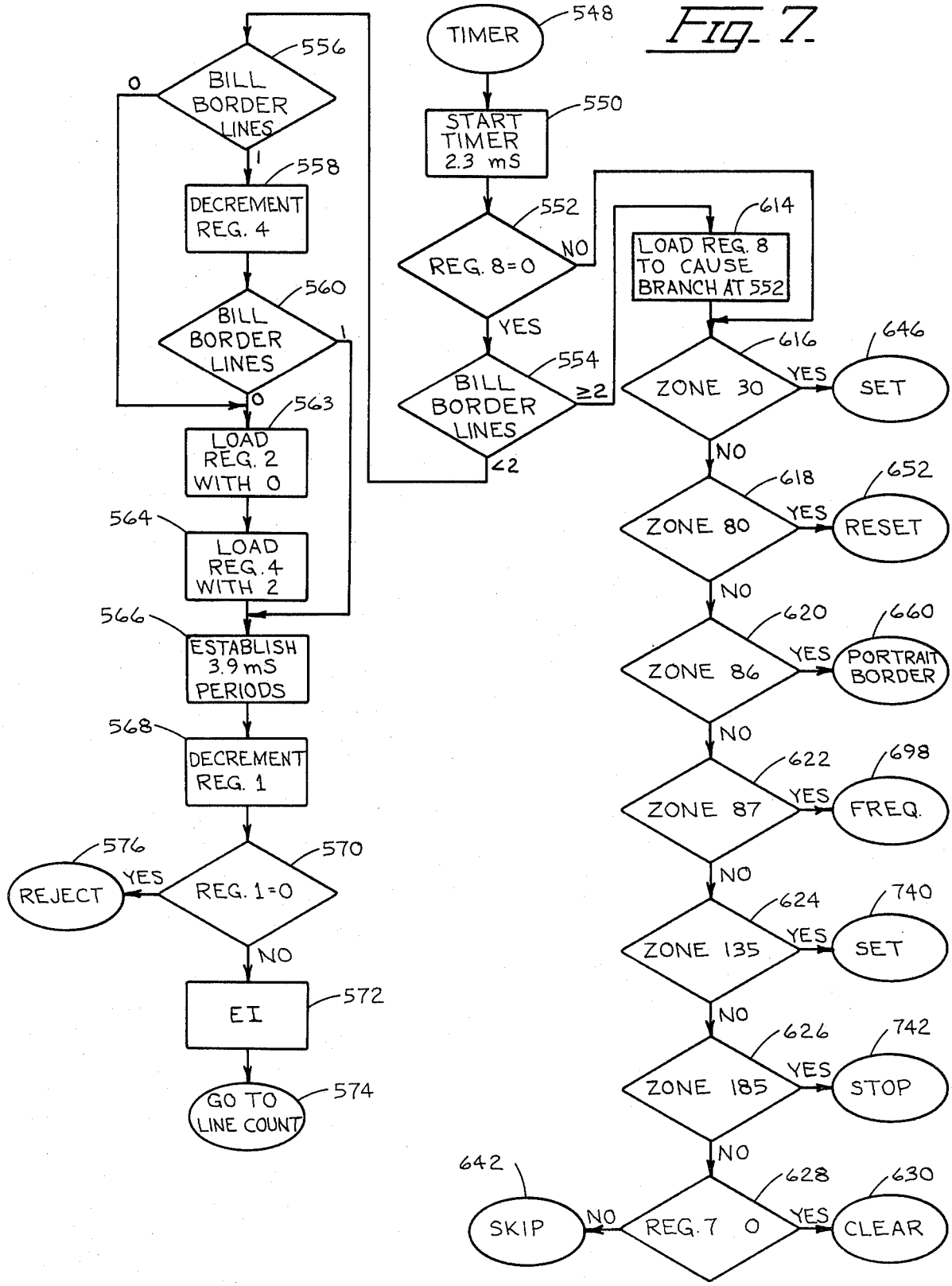
FIG. 7 is a further portion of the flow chart, and it shows many of the steps of the interrupt service routine which is executed during the operation of the bill-handling device.

During step 508 the timer in 3853 will be set to respond to each interrupt to address the TIMER connective 548 of FIG. 7. During the next-succeeding step 510, an ANDING function will determine whether the switch 146 is open or closed. If that switch is open, the resulting signal at pin 4 of Port 1 will cause that ANDING function to provide a NO; and thereafter the program will loop at step 510 until switch 146 is closed.

At such time, the bill-handling device will be in a "ready" or "standby" condition; and it will remain in that condition until switch 146 is closed or power is disconnected from the microprocessor 470. As indicated by the START connective 504 of FIG. 5, the bill-handling device will assume the "ready" or "standby" condition each time it has (a) determined that an insert is not authentic or is not a U.S. one dollar, two dollar, five dollar, ten dollar or twenty dollar bill and has caused the motor 562 to reverse and to move that insert back out of the transport or (b) has determined that an insert is an authentic U.S. one dollar, two dollar, five dollar, ten dollar or twenty dollar bill.

HEAD SIGNALS

When an insert is inserted in, and then is moved inwardly of, the transport 30, the scan path 230 on that insert will be engaged by the air gap of the magnetic head 208. If that insert is an authentic U.S. one dollar, two dollar, five dollar, ten dollar or twenty dollar bill, and if that bill has its black-ink face up, the air gap of that magnetic head will engage, and respond to, each of the magnetic-ink lines along the scan path 230. Further, if that bill is inserted so the green seal is remote from the platens 40 and 118—and pictorial and written instructions on the platform 32 will encourage patrons to so insert each bill—the air gap of the magentic head 208 will engage, and sense, the magnetic-ink lines of that scan path in a known order and at known spacings therebetween. The amplifier and low pass filter 420 will amplify those signals from magnetic head 208 which are below the one kilohertz range; and the level detector 422 will respond to all of the signals from amplifier 420 which have an amplitude greater than a predetermined minimum amplitude. Schmitt trigger 424 and monostable multivibrator 426 will generate a steep-sided negative-going pulse in response to each negative-going signal from level detector 422. As a result, whenever the air gap of the magnetic head 208 is not engaging a magnetic-ink line or area, a logic "0" will appear at the output of that monostable multivibrator; and whenever that air gap engages the leading edge of a magnetic-ink line or area, a logic "1" will appear at the output of that monostable multivibrator. A logic "1" will continue to appear at that output as long as that magnetic-ink line or area continues to move in engagement with the air gap of the magnetic head 208; but that logic "1" will abruptly change to a logic "0" as an ink-free area is moved into engagement with that air gap. Although those logic "1" and logic "0" signals appear at the output of the monostable multivibrator 426, those signals will, after being inverted by the input port of the microprocessor 470, be referred to hereinafter as "head signals" because they were originated by the magnetic head 208 as the insert was moved past the air gap of that magnetic head.

DISPLAY ROUTINE

Figures 9, 17, 18, 19, 20, 21:
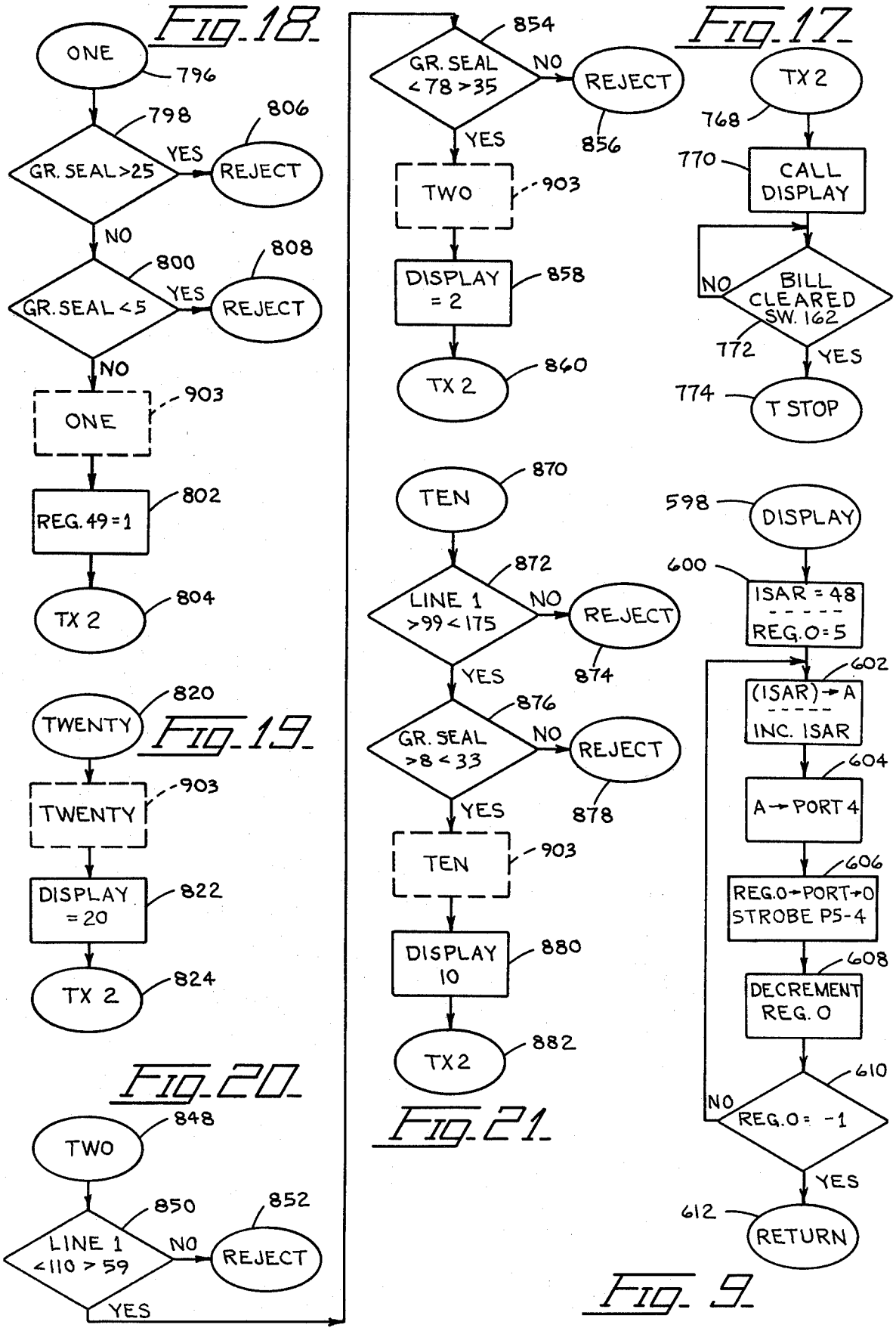
FIG. 9 is the portion of the flow chart which includes the steps of the display routine.
FIG. 17 shows a portion of the flow chart which shows steps that call for the displaying of indicia representing the denomination of an inserted bill.
FIG. 18 is a portion of the flow chart which shows steps that respond to data from a U.S. one dollar bill to initiate the display routine of FIG. 17.
FIG. 19 is a portion of the flow chart which shows steps that respond to data from a U.S. twenty dollar bill to initiate the display routine of FIG. 17.
FIG. 20 is a portion of the flow chart which shows steps that respond to data from a U.S. two dollar bill to initiate the display routine of FIG. 17.
FIG. 21 is a portion of the flow chart which shows steps that respond to data obtained from a U.S. ten dollar bill to initiate the display routine of FIG. 17.

Whenever the CALL DISPLAY step 770 of FIG. 17 is initiated, the program will be directed to step 600 of FIG. 9; and, during that step the ISAR will be set to address scratch pad register 48. Also during that step, a five (5) will be loaded into scratch pad register 0. During step 602, the contents of the scratch pad register that is currently being addressed by the ISAR—and, during the first execution of that step, it will be scratch pad register 48—will be transferred to the Accumulator. Also during step 602, the ISAR will be incremented; and during that first execution of step 602, the ISAR will be incremented to address scratch pad register 49. During step 604, the contents of the Accumulator will be supplied to Port 4; and, during step 606, the number in scratch pad register O will be supplied to Port 0. Also during step 606, a strobe will be applied to pin 4 of Port 5. Thereupon, the data which the Accumulator supplied to Port 4 during step 604 will be transferred to a register within the display 454 that is dedicated to the seven-segment unit 456; and that seven-segment unit will provide the display, if any, called for by that transferred data. If the insert is an authentic twenty dollar bill, that seven-segment unit will be illuminated to display a two (2); but if that insert is an authentic ten dollar bill, that seven-segment unit will be illuminated to display a one (1). In all other instances, seven-segment unit 456 will remain blank. During step 608, the count in scratch pad register O will be decremented; and, in the first execution of that step, that count will be decremented to four (4). A comparing function during step 610 will determine whether the count in scratch pad register O is minus one (−1); and, in the first execution of that step, a NO will be produced.

Thereupon, the program will branch to step 602; and, during the second execution of that step, the contents of scratch pad register 49 will be transferred to the Accumulator, and the ISAR will be incremented to address scratch pad register 50. During the second execution of step 604, the value in the Accumulator—which previously had been in scratch pad register 49—will be supplied to Port 4. During the second execution of step 606, the four (4) count in scratch pad register O will be supplied to Port 0; and a strobe will be applied to pin 4 of Port 5 thereby enabling the data at Port 4 to be transferred to a register in the display 454 that is dedicated to the seven-segment unit 458, and causing that seven-segment unit to provide the display called for by that transfered data. If the insert is an authentic one dollar bill, that data will be a HEX 11 and that seven-segment unit will be illuminated to display a one (1), if the insert is an authentic two dollar bill, that data will be a HEX 12 and that seven-segment unit will be illuminated to display a two (2), and if the insert is an authentic five dollar bill, that data will be a HEX 15 and that seven-segment unit will be illuminated to display a five (5). If the insert is an authentic ten dollar bill, that data will be a HEX 10 and that seven-segment unit will be illuminated to display a zero (0); and, similarly, if the insert is an authentic twenty dollar bill, that data will be a HEX 10 and that seven-segment unit will be illuminated to display a zero (0). In all other instances, the seven-segment unit 458 will, when it is illuminated, display a zero (0). During the second execution of step 608, the four (4) in scratch pad register O will be decremented to three (3); and, during the second execution of step 610, the comparing function will again produce a NO.

The display routine, which includes steps 602, 604, 606, 608 and 610, will be repeated four more times; and, during the sixth execution of step 610, the comparing function will determine that the value in scratch pad register O is minus one (−1). The resulting YES will, via RETURN connective 612, cause the program to branch back to step 770 of FIG. 17.

During those four more executions of the display routine, the contents of each of the scratch pad registers 50, 51, 52 and 53 will be successively transferred to the Accumulator, to Port 4, and then to four individually-different scratch pad registers in display 454 that are dedicated to the seven-segment units 460 and 462 and to the other two seven-segment units, not shown, of that display. Also, each of the seven-segment units 460 and 462 will be illuminated to display a zero (0). The data which is stored in scratch pad registers 50, 51, 52 and 53 will not change during the operation of the bill-handling device; because each of seven-segment units 460 and 462 will display a zero (0) whenever it is illuminated, and each of the covered seven-segment units will be blanked. However, the data which is stored in scratch pad register 48 will selectively cause seven-segment unit 456 to display a zero (0), a one (1) or a two (2); and the data which is stored in scratch pad register 49 will selectively cause seven-segment unit 458 to display a five (5), a two (2), a one (1) or a zero (0).

Figure 5:
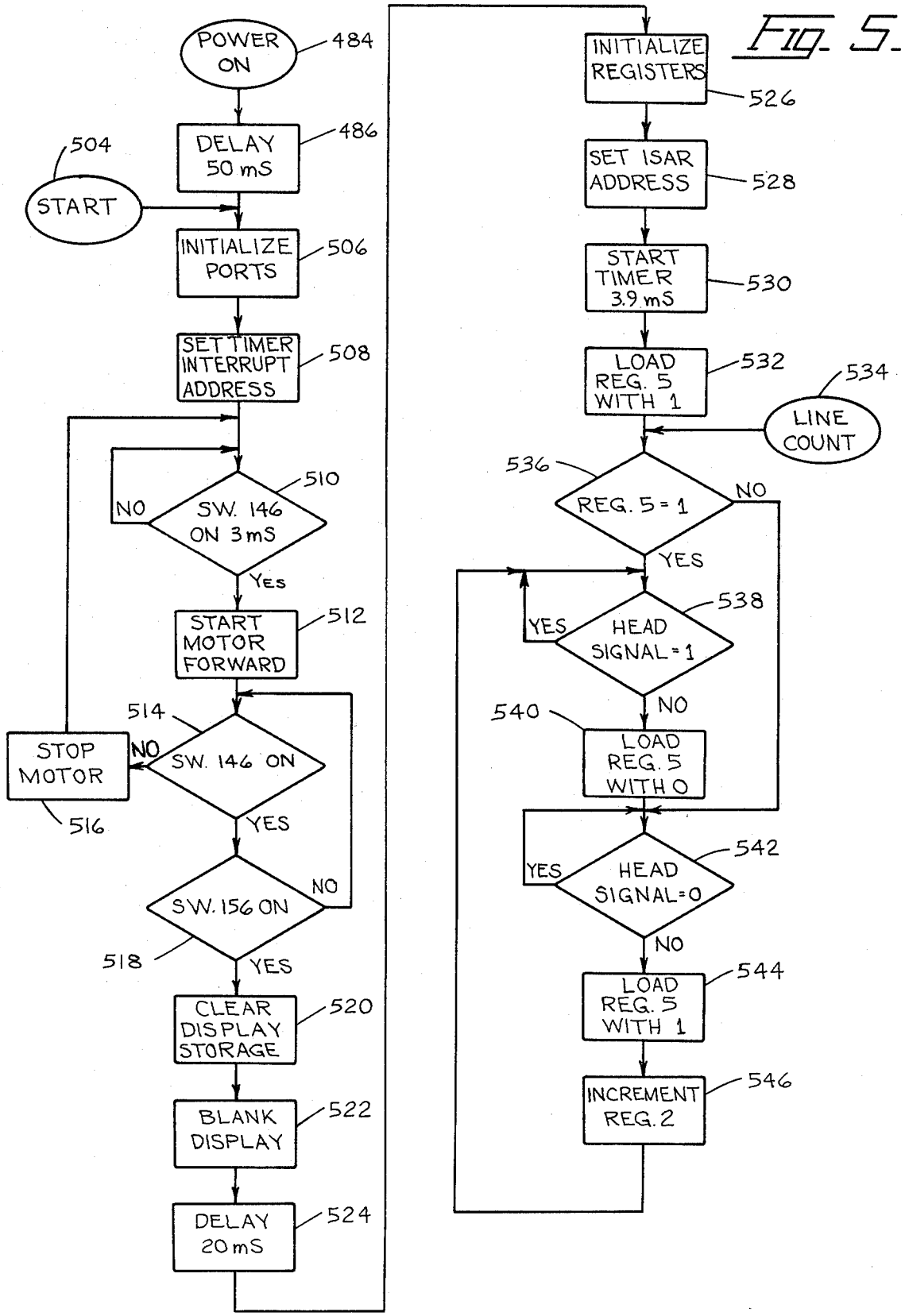
FIG. 5 is part of an overall flow chart which shows the steps that are executed during the operation of the bill-handling device that is provided by the present invention.

The data which is loaded into scratch pad register 48 during step 520 of FIG. 5 will keep seven-segment unit 456 blank until (a) that data is changed during step 822 of FIG. 19 and (b) step 770 of FIG. 17 causes the display routine to enable that data to effect the displaying of a two (2) by seven-segment unit 456, or until (c) that data is changed during step 880 of FIG. 21 and (d) step 770 of FIG. 17 causes the display routine to enable that data to effect the displaying of a one (1) by seven-segment unit 456. The data which is loaded into scratch pad register 49 during step 520 of FIG. 5 will cause seven-segment unit 458 to display a zero (0) until (a) that data is changed during step 764 of FIG. 16 and (b) step 770 of FIG. 17 causes the display routine to enable that data to effect the displaying of a five (5) by seven-segment unit 458, or until (c) that data is changed during step 802 of FIG. 18 and (d) step 770 of FIG. 17 causes the display routine to enable that data to effect the displaying of a one (1) by seven-segment unit 458, or until (e) that data is changed during step 858 of FIG. 20 and (f) step 770 of FIG. 17 causes the display routine to enable that data to effect the displaying of a two (2) by seven-segment unit 458. In this way, the indicia provided by the display 454 will be "0.00" until the acceptance of an insert cause different indicia to be displayed by seven-segment units 456 and 458.

Whenever various of the seven-segment units 456, 458, 460 and 462 have been illuminated, during the various executions of step 606 of the display routine, those units will tend to remain illuminated. Consequently, the display 454 will tend to continue to display whatever indicia the seven-segment units are caused to exhibit. However, when a further insert is introduced into the transport 30, step 520 of FIG. 5 will again load the scratch pad registers 48, 49, 50, 51, 52 and 53 with data which will call for the blanking of seven-segment unit 456, and the two covered seven-segment units, and which will call for each of seven-segment units 458, 460 and 462 to display a zero (0). During the next-succeeding step 522 of FIG. 5, all of the six (6) seven-segment units will be rendered blank so they will be dark.

Reject Routine

Figure 8:
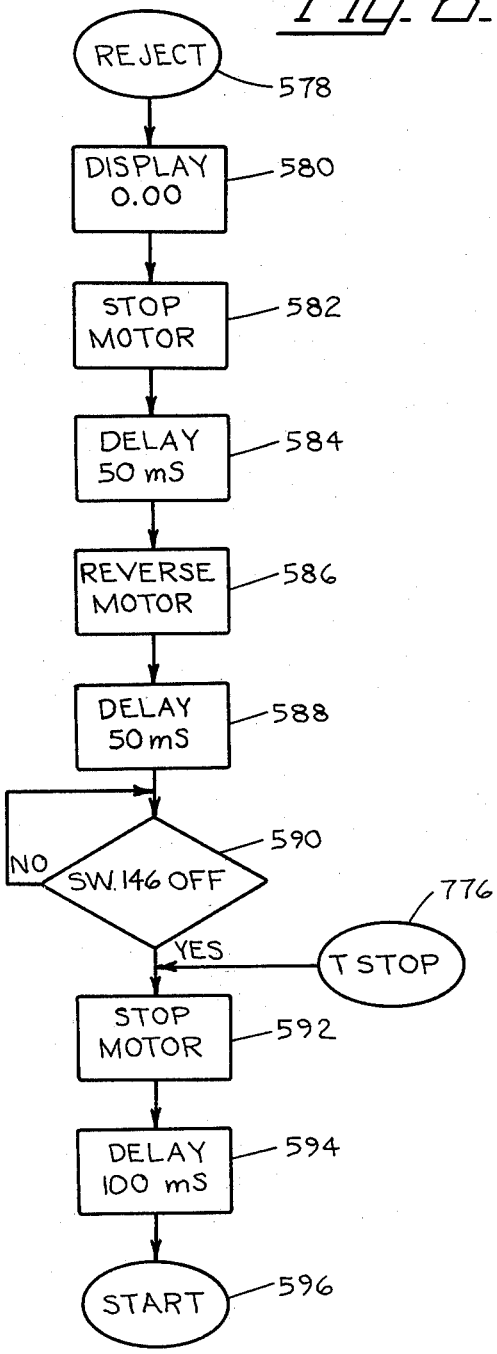
FIG. 8 is a still further portion of the flow chart, and it shows the steps of the reject routine which can be executed during the operation of the bill-handling device.

Steps 580, 582, 584, 586, 588, 590, 592 and 594 of FIG. 8 constitute a reject routine which will be executed whenever an analysis of the data obtained from an insert shows that the data fails to match certain pre-set values. REJECT connective 578 in FIG. 8 will respond to any one of REJECT connective 576 of FIG. 7, REJECT connective 738 of FIG. 12, REJECT connectives 778, 780, 784, 788, 826, 828, 830, 834, 838, 842, 864 and 886 of FIG. 14, REJECT connectives 890 and 894 of FIG. 15, REJECT connective 794 of FIG. 16, REJECT connectives 806 and 808 of FIG. 18, REJECT connectives 852 and 856 of FIG. 20, REJECT connectives 874 and 878 of FIG. 21 to branch the program to step 580 of the reject routine. During that step, a HEX 10 will be stored in scratch pad register 49; and then the display routine of FIG. 9 will be called for. During the execution of that routine, each of the scratch pad registers 48, 49, 50, 51, 52 and 53 will be addressed, the data therein will be transferred to the appropriate register in display 454, and a strobe will cause the corresponding seven-segment unit to respond to that transferred data. Thereupon, the seven-segment units 458, 460 and 462 will display "0.00"—thereby showing that the insert was not acceptable.

At the conclusion of the display routine, the program will, via RETURN connective 612 of FIG. 9, branch to step 582 of FIG. 8. During that step the logic "1", which must be supplied to pin 7 of Port 5 during step 512 of FIG. 5 to cause motor 562 to start operating in the forward direction, will be changed to logic "0"—thereby de-energizing that motor and permitting it to stop. During the succeeding step 584, the delay subroutine of FIG. 6 will be operated to provide a fifty millisecond (50 ms) delay. At the conclusion of that fifty millisecond (50 ms) delay, the program will return, via RETURN connective 502 of FIG. 6, to step 586 of FIG. 8. During that step, a logic "1" will again be supplied to pin 7 of Port 5 and a logic "1" will be supplied to pin 6 of that port. Transistor 346 of FIG. 4 will respond to the resulting "0" at its base to be non-conductive, and thereby enable resistor 342 to apply a "1" to the upper right-hand input of the MOTOR START AND RUN block 348; and transistor 452 will respond to the resulting "0", which resistor 450 will apply to its base, to be non-conductive, and thereby enable resistor 448 to cause current to flow through resistor 448 and relay coil 434 to energize that relay coil. The resulting shifting of relay contacts 438 and 444 to their left-hand "reverse" positions will cause the motor 562 to start operating in the "reverse" direction—with consequent movement of belts 198 and 199, and of the insert held thereby, from left to right in FIGS. 1 and 2. During the succeeding step 588, the delay subroutine of FIG. 6 will be executed to provide a further fifty millisecond (50 ms) delay. At the conclusion of that further fifty millisecond (50 ms) delay, the program will return, via RETURN connective 502 of FIG. 6, to step 590 of FIG. 8; and, during that step, a comparing function will determine whether the insert has been moved far enough toward the platform 32 to release the actuator 148 of switch 146. If that comparing function provides a NO, as it will do until the insert has been moved all of the way back to the platform 32, the program will loop at step 590. When the comparing function of step 590 determines that switch 146 has re-opened, logic "1" at pin 7 of Port 5 and logic "1" at pin 6 of that port will be changed to logic "0". Thereupon, motor 562 and relay coil 434 will become de-energized. At this time, the major portion of the length of the insert will be resting upon, or extending outwardly beyond, the platform 32; and the patron can easily retrieve that insert. During the succeeding step 594 of FIG. 8, a one hundred millisecond (100 ms) delay will be provided by causing the delay routine of FIG. 6 to be executed two succeeding times. At the end of that one hundred millisecond (100 ms) delay, the program will branch, via RETURN connective 502 of FIG. 6, to START connective 596 of FIG. 8. That connective and START connective 504 of FIG. 5 will branch the program to step 506 of FIG. 5, wherein the ports of the microprocessor 470 will again be "initialized" to the same logic states to which they were "initialized" during the first execution of step 506. During the next-succeeding step 508, the timer interrupt address will be set in the same manner as, and to the same address to which, it was set during the first execution of that step. During the next-succeeding step 510, a comparing function will determine whether switch 146 has again been closed. If that comparing function provides a NO—thereby indicating that switch 146 has not been re-closed—the program will loop at step 510 until that switch is again re-closed. At this time, the bill-handling device will again be in its "standby" or "ready" condition.

BRIEF DESCRIPTION OF COLLECTION AND ANALYSIS OF DATA USED TO DETERMINE AUTHENTICITY AND DENOMINATION OF PAPER CURRENCY

Figure 3:
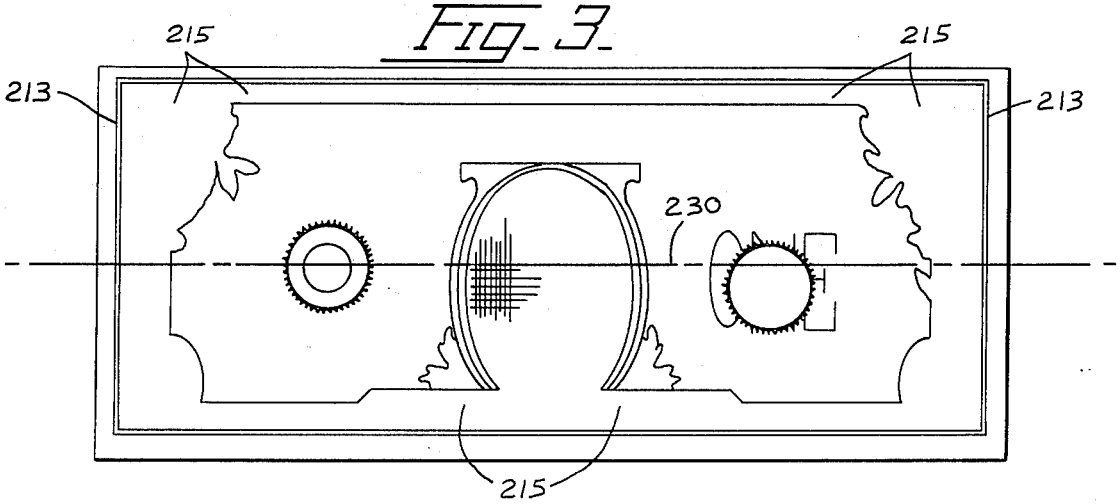
FIG. 3 is a full-size representation of a U.S. one dollar bill.

The transport 30 will respond to the closing of switch 146 to cause the motor 562 to act through the gear train to cause the belts 198 and 199 to start moving from right to left in FIGS. 1–3; and those belts will move at the rate of ten (10) inches per second. If switch 146 was closed by the insertion of a U.S. bill of any given denomination or by a piece of paper of the same size and stiffness as such a bill, that bill or piece of paper (hereinafter insert) will be moved from right to left in FIGS. 1–3. The leading edge of that insert will successively engage actuator 158 to close switch 156, engage the air gap of magnetic head 208, and engage actuator 164 to close switch 162. Prior to the time the leading edge of that insert engages actuator 164, that leading edge will engage the air gap of magnetic head 208; and thereafter, as long as any part of that insert engages and moves past that air gap, that magnetic head will scan a portion of the scan path 230. As shown by FIG. 3, that scan path is about midway between the upper and lower edges of a U.S. bill. The insert will continue to move from right to left in FIGS. 1–3 until the trailing edge of that insert is moved to the left beyond actuator 164 to permit switch 162 to re-open, or the motor 562 is caused to stop and then reverse the movement of that insert to cause that insert to move back out of transport 30 and thereby permit switches 162, 156 and 146 to re-open.

Although the air gap of magnetic head 208 will scan all magnetic ink lines and areas on the insert which cross the scan path 230, the scanning of some of those lines and areas is very important, whereas the scanning of the rest of those lines and areas is not. Specifically, it is important to scan the area where the leading portion of the rectangular border of a U.S. bill is located; and it is recognized that the width of that area differs between U.S. bills of different denominations, and it also is recognized that the distance between that area and the leading edges of U.S. bills of the same denomination also varies. Further, it is important to scan the area, intermediate the leading portion of the border and the leading portion of the portrait border on a U.S. bill, where the black-ink seal is located. Additionally, it is important to scan the area where the leading edge of the portrait border and the leading portion of the grid-like portrait background of a U.S. bill are located. Finally, it is important to scan the area, intermediate the trailing edge of the portrait border and the trailing portion of the rectangular border on a U.S. bill, where the green-ink seal and the black-ink denomination-identifying numerals are located.

On each U.S. bill, the distances between the leading portion of the rectangular border, the black seal, the leading portion of the portrait border, and the green seal are precisely fixed at the time that bill is engraved. However, the distance between the leading edge of a bill and the leading portion of the rectangular border is not precisely fixed; because the cutting of the edges of engraved bills is not done in a precise manner. As a result, any system of collecting and analyzing data, to be used in determining the authenticity and denomination of any U.S. bill or piece of paper, which relates its time base to the leading edge of that U.S. bill or piece of paper could produce unacceptably-inaccurate determinations of authenticity or denomination. The present invention obviates the production of unacceptably-inaccurate determinations of authenticity or denomination by using a time base which is related to the leading portion of the rectangular border of a U.S. bill, rather than to the leading edge of that bill; and hence has a very predictable relation to each of the hereinbefore-identified important scanning areas of a U.S. bill. That time base consists of a large number of segments—each of which has a duration of two and three-tenths (2.3) of a millisecond; and that time base enables the bill-handling device to collect and store data obtained during the scanning of the hereinbefore-identified important scanning areas of a U.S. bill while freeing that bill-handling device of the need of collecting and storing data obtained during the scanning of the remaining areas of that bill.

At the time the leading edge of an insert moves actuator 148 far enough to close switch 146, the timer in 3853 establishes three and nine-tenths millisecond (3.9 ms) time periods; and those time periods will be provided prior to, and during, the time when the air gap of magnetic head 208 is engaged by the area on the insert which corresponds to the area where the leading portions of the borders of U.S. bills are located. If, two (2) signals, which are comparable to signals that are developed as a magnetic-ink line or area is moved into engagement with that air gap, are developed during one of the three and nine-tenths millisecond (3.9 ms) time periods, or if one (1) such signal is developed during one of those time periods and another such signal is developed during the immediately-succeeding time period, it can be assumed that those signals were due to the sensing of two (2) magnetic-ink lines or areas and not to electrical noise or other transients. Further, it will be assumed that those magnetic-ink lines or areas were in the leading portion of the border of a U.S. bill; and thereafter a number of predetermined areas, which are spaced known distances from the leading portions of the borders of U.S. bills, will be sensed.

In the first of those areas—which corresponds to the area that starts immediately ahead of and that ends immediately behind, the black-ink seal on a U.S. bill—no magnetic-ink lines or areas should be sensed; because the ink in that seal is non-magnetic. However, if the insert was a photocopy, of a U.S. bill, which had been made by a copying machine that uses magnetic particles, that area would produce many signals as the air gap of magnetic head 208 engaged that area. As a result, the absence of signals from that area can be used as one indication of authenticity, and the presence of an appreciable number of signals from that area can be used to initiate the rejection of the insert.

In the second of the predetermined areas—which corresponds to the area on U.S. bills where the lefthand portrait border lines are located—signals should be developed which have durations that indicate the widths of those lines and of the immediately-succeeding spaces. Because the widths of the portrait border lines and of the immediately-succeeding spaces on U.S. twenty dollar bills differ from those on two dollar and ten dollar bills, the measuring of the widths of the portrait border lines, and of the immediately-succeeding spaces, helps distinguish between twenty dollar bills and two dollar and ten dollar bills. Also, the measuring of those widths helps distinguish between two dollar and ten dollar bills.

In the third of the predetermined areas—which corresponds to the area on U.S. bills where the portion of the portrait background is located—signals should be developed which have durations that indicate the widths of the vertical lines, which help form that background, and of the immediately-succeeding spaces. Because the widths of the vertical portrait background lines and of the immediately-succeeding spaces on U.S. one dollar and five dollar bills differ from each other and also from those on two dollar, ten dollar and twenty dollar bills, the measuring of the widths of those lines and of the immediately-succeeding spaces helps distinguish between one dollar and five dollar bills, and also helps distinguish those bills from two dollar, ten dollar and twenty dollar bills.

In the last of the predetermined areas—which corresponds to the area on U.S. bills where the green seal and the black-ink denomination-defining lines are located—predictable numbers of signals can be anticipated during the scanning of that area on authentic U.S. one dollar, two dollar, five dollar, ten dollar and twenty dollar bills. Those signals can be used to help determine the denominations of inserted U.S. bills; and those signals materially help in distinguishing U.S. bills from counterfeit bills. Specifically, the numbers of signals from the green seal area of an authentic U.S. bill (a) will be much greater than the essentially-zero number of signals obtained by scanning the green seal area of a counterfeit made with non-magnetic ink particles and (b) will be much less than the very large number of signals obtained by scanning the green seal area of a counterfeit made with magnetic ink particles.

All of the signals that are needed to identify authentic U.S. one dollar, two dollar, five dollar, ten dollar and twenty dollar bills and to reject all counterfeits are initiated by a single magnetic head, during a single pass of a bill or other object past that magnetic head. As a result, the bill-handling device provided by the present invention utilizes a minimum of parts, requires a minimum of time to test bills, and requires a minimum of space.

Detailed Description of Collection of Data

As an insert moves actuator 148 far enough to close switch 146, the resulting logic "1" signal at pin 4 of Port 1 of microprocessor 470 will cause a delay of slightly less than three milliseconds (3 ms) to be provided during step 510 of FIG. 5. That delay is produced by loading scratch pad register 2 with a count of one hundred and thirteen (113) and then decrementing that count to zero (0). Each time that count is decremented during step 510, the state of the signal at pin 4 of Port 1 will be sensed to determine whether switch 146 is still closed. If that state of that signal remains unchanged throughout the decrementing of register 2 to zero (0), step 510 will provide a YES. Step 512 will respond to that YES to provide a logic "1" signal at pin 7 of Port 5 and a logic "0" signal at pin 6 of that Port; and those signals will indicate that switch 146 remained closed for almost three milliseconds (3 ms). Port 5 will supply the complements of those signals to the corresponding output pins of microprocessor 470.

If, at any time while the count in register 2 was being decremented, step 510 had sensed a change in the state of the signal at pin 4 of Port 1, that step would have provided a NO; thereby indicating that switch 146 had re-opened. In that event, the signal at pin 7 of Port 5 would have continued to be a logic "0"; and the motor 562 would have remained de-energized. Also, the program would have resumed its looping at step 510; and that looping would have continued until switch 146 was again closed.

The application of a logic "1" to pin 7 of Port 5, as step 512 responded to the YES from step 510, removed the previously-existing forward bias for NPN transistor 346; and hence the collector of that transistor applied a logic "1" to the upper right-hand input of MOTOR START AND RUN block 348. The simultaneous application of a logic "1" to the base of transistor 452 forward-biased that transistor; and the resulting conduction of that transistor permitted relay coil 434 to be de-energized and to dispose movable contacts 438 and 444 in their right-hand "forward" positions. The resulting energization of motor 562 enabled that motor to start moving the insert inwardly of the transport 30; and the MOTOR START AND RUN block 348 caused that insert to be moved inwardly at a constant speed of ten (10) inches per second.

During step 514 of FIG. 5, a comparing function is used to check the state of the signal at pin 4 of Port 1, and thereby determine whether switch 146 still is closed. If that switch were not closed, as indicated by a NO at the conclusion of that comparing function, the signal at pin 7 of Port 5 would be changed back to logic "0"; and transistor 346 and MOTOR START AND RUN block 348 would respond to the resulting logic "1" at the corresponding output pin of microprocessor 470 to de-energize the motor 562, as indicated by step 516. At such time, the belts 198 and 199 would come to rest, and the insert would not be moved any further into the transport 30. Also, the program would branch back to step 510; and it would then loop at that step until such time as switch 146 was again closed for slightly less than three milliseconds (3 ms). However unless, prior to the initiation of the comparing function of step 514, the insert had been pulled back out of that transport by the person who inserted it, switch 146 would continue to remain closed; and the motor 562 would continue to move the insert inwardly of that transport.

In response to a YES from the comparing function of step 514, one or more comparison checks will be made during step 518 of the state of the signal at pin 6 of Port 1 to determine whether switch 156 is closed. Because a finite time will be required to move the leading edge of an insert from the point where it moved actuator 148 far enough to close switch 146 to the point where it can move actuator 148 far enough to close switch 156, the initial check during step 518 will usually determine that switch 156 still is open. The resulting NO from that initial comparison check will cause the program to loop through steps 514 and 518 as long as switch 146 remains closed and switch 156 remains open.

During each loop through those steps, the closed state of switch 146 will enable step 514 to provide a YES, but the open state of switch 156 will cause step 514 to provide a NO—with consequent resumption of the looping of the program through those steps. If, during any of those loopings, the comparing function in step 514 were to determine that switch 146 had reopened, the resulting NO at that step would cause the motor 562 to be de-energized, as at step 516, and would cause the program to loop at step 510 until switch 146 was again closed.

A YES from the comparing function of step 514 will permit the motor 562 to effect continued inward movement of the insert; and, within a small fraction of a second, the leading edge of that insert will move actuator 158 far enough to close switch 156. The next comparing function of step 518 will respond to the closed state of that switch to provide a YES. During the immediately-succeeding step 520, scratch pad registers 48, 49, 50, 51, 52 and 53 will have the following "words" written into them:

| Register | Word |
|---|---|
| 48 | 0000 1111 |
| 49 | 0000 0000 |
| 50 | 0000 0000 |
| 51 | 0000 0000 |
| 52 | 0000 1111 |

-continued

| Register | Word |
|---|---|
| 53 | 0000 1111 |

Those registers store the data which is used to determine whether the seven-segment units of display 454 are left dark or are used to display desired indicia. Register 48 provides the data for seven-segment unit 456, register 49 provides the data for seven-segment unit 458, register 50 provides the data for seven-segment unit 460, register 51 provides the data for seven-segment unit 462, and registers 52 and 53 provide the data for the two right hand-most seven-segment units which are not shown in FIG. 4 because they are covered up and not used. Registers 52 and 53 continuously store 0000 1111 therein to provide continuous blanking of the two right hand-most seven-segment units. Register 48 initially stores a 0000 1111 therein—to normally keep seven-segment unit 456 dark; because one dollar, two dollar, and five dollar bills are used more frequently than ten dollar and twenty dollar bills in the purchase of products or services offered by vending machines. During step 522, signals are supplied to all of the seven-segment units of display 454 to keep those units dark, irrespective of the data in registers 48 through 53.

Figure 6:
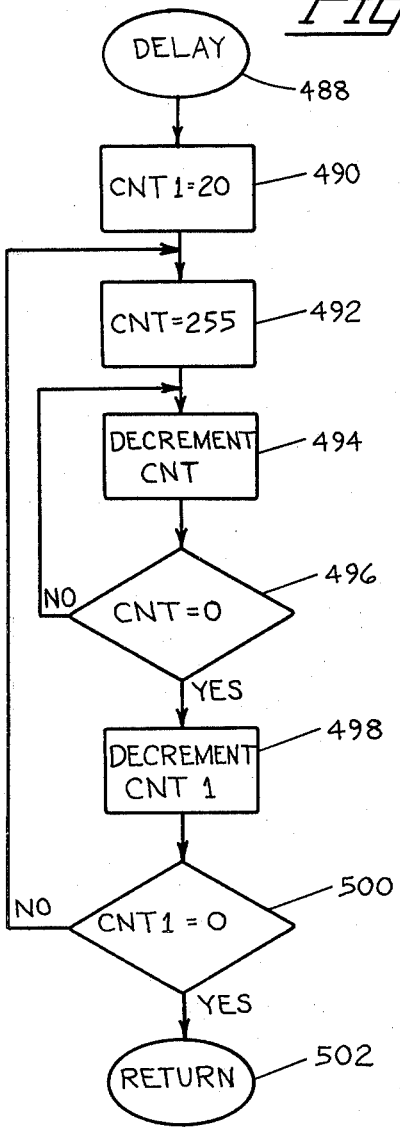
FIG. 6 shows a sub-routine for one of the steps of FIG. 5.

During step 524, a delay of twenty milliseconds (20 ms) is provided, and that delay is produced by a subroutine which is similar to that of FIG. 6. However, instead of loading twenty (20) into register 4, eight (8) is loaded into that register. As a result, the delay has a duration of only twenty millisecond (20 ms) instead of the fifty milliseconds (50 ms) which is provided by the subroutine of FIG. 6. At the conclusion of the twenty milliseconds (20 ms) delay, scratch pad registers 0, 1, 2, 4 7 and 8 are "initialized" in step 526. Specifically, two (2) is loaded into register 0, one hundred and eighty (180) is loaded into register 1, two (2) is loaded into register 4, and zero (0) is loaded into each of registers 2, 7 and 8.

During step 528, the indirect scratch pad address register (hereinafter ISAR) is set to address scratch pad register 40.

Sensing for Closely-Spaced Lines in Leading Portion of Border

The timer in 3853 is started in step 530; and that timer is programmed during that step to provide a time period of three and nine-tenths milliseconds (3.9 ms) and also to provide an interrupt at the end of that time period. Also, the 3861 interrupts are disabled, and the external interrupts for the 3850 CPU are enabled, during step 530. During step 532, register 5 is set to a known state; and, in the program which is attached to and made a part of this description, that state is one (1). Steps 538, 540, 542, 544 and 546 constitute a data collection routine which the program will execute many times. The first execution of that routine, during the collecting of data from an insert, will occur before the leading edge of that insert reaches the air gap of the magnetic head 208—and hence will occur at a time when no magnetic-ink line or area is in engagement with that air gap. As a result, at the time of the first execution of the data collection routine during the collecting of data from an insert, the magnetic head signal will be a logic "1"; and the program will be searching for a logic "0"—to determine when a magnetic-ink line or area moves into engagement with the air gap of magnetic head 208. By loading a one (1) into register 5, step 532 facilitates the search for a logic "0" magnetic head signal. Specifically, during step 536, a comparing function will determine whether the value in register 5 equals one (1); and, if the answer is YES, a comparing function during step 538 will determine whether the head signal also is one (1). If the answer is YES—thereby indicating that the air gap of magnetic head 208 is not engaging a magnetic-ink line or area, the program will loop at step 538 until such time as the head signal becomes zero (0)—thereby indicating that a magnetic-ink line or area has moved into engagement with that air gap. The zero (0) head signal will cause the comparing function of step 538 to provide a NO; and, thereupon, during step 540, a zero (0) will be loaded into register 5.

An ANDING function during step 542 will check the logic state of the head signal; and, because the magnetic-ink line or area still is in engagement with the air gap of magnetic head 208, that state will be a zero (0). The resulting YES will cause the program to loop at step 542 until such time as the head signal again becomes one (1)—thereby indicating that the magnetic-ink line or area had moved out of engagement with the air gap. The one (1) head signal will cause the comparing function of step 542 to provide a NO; and, thereupon, during step 544, a one (1) will be loaded into scratch pad register 5. During step 546, the value in scratch pad register 2—which was set to zero (0) during step 526—will be incremented. Thereafter the program will start to re-execute the data collection routine by causing the comparing function of step 538 to again check the state of the head signal.

In the immediately-preceding portion of this description, the development of a NO by the comparing function of step 538 indicated the sensing, by the air gap of magnetic head 208, of the leading edge of a magnetic-ink line or area; and the subsequent development of a NO by the ANDING function of step 542 indicated the sensing, by that air gap, of the trailing edge of that magnetic-ink line or area. The incrementing of the value in scratch pad register 2, during step 546, indicated the counting of one magnetic-ink line or area. Such a sensing and counting of a magnetic-ink line or area could occur during the first execution of the data collection routine in the checking of any given insert only if, at the starting of the three and nine-tenths milliseconds (3.9 ms) time period of step 530, (a) the leading edge of that insert was immediately adjacent the air gap of magnetic head 208 and (b) that magnetic-ink line or area was immediately adjacent that leading edge. In most instances, the leading edge of an insert will not reach the air gap of magnetic head 208 until after the data collection routine has been executed at least once; and in virtually all instances a magnetic-ink line or area will not reach that air gap until after the data collection routine has been executed several times.

It is impossible to predict which step, of the data collection routine, the program will be executing at the instant the three and nine-tenths milliseconds (3.9 ms) time period of step 530 will expire; because that time period could terminate during the execution of any of the steps 538, 540, 542, 544 and 546. However, the present invention will, unless the insert has been moved far enough to cause a magnetically-different area on that insert to move into engagement with the air gap of magnetic head 208, enable that program to promptly resume the execution of the step which was being executed when that time period terminated—if the count in scratch pad register 2 is less than two (2). For example, if the head signal was a one (1) and the program was looping at step 538 at the time the three and nine-tenths milliseconds (3.9 ms) time period of step 530 terminated, and if the value in scratch pad register 2 was less than two (2), the TIMER connective 548 of FIG. 7 would enable step 550 to cause the timer in 3853 to start a two and three-tenths millisecond (2.3 ms) time period.

The immediately-succeeding ANDING function of step 552 would determine that scratch pad register 8 still had its "initialized" zero (0) in it; and the resulting YES from that step would enable the comparing function of step 554 to determine whether the value in scratch pad register 2 was less than two (2). The resulting YES from the latter step would enable the comparing function of step 556 to determine whether the value in scratch pad register 2 was one (1) or zero (0). In the latter case, the program would branch to step 563; whereas in the former case, the value in scratch pad register 4 would be decremented by one (1). That value was set at two (2) during step 526 of FIG. 5; and hence the value in that scratch pad register would be decremented to one (1). The succeeding comparing function of step 560 would determine whether one (1) or no (0) magnetic-ink line or area had been sensed by the air gap of magnetic head 208 in the leading portion of the border of a U.S. bill. In the latter case, scratch pad register 2 would, in step 563, as in step 526 of FIG. 5, be loaded with a zero (0); and scratch pad register 4 would in step 564, as in step 526 of FIG. 5, be loaded with a two (2); whereas in the former case, the program would branch to step 566. In either case, a further three and nine-tenths millisecond (3.9 ms) time period would be provided during step 566, and the value in register 1 would be decremented during step 568. Because one hundred and eighty (180) was loaded into that register during step 526 of FIG. 5, the decrementing of that value during step 568 would not make that value zero (0); and hence the ANDING function during step 570 would provide a NO. Thereupon, an enable interrupt would be provided during step 572 and the program would branch to step 536 in FIG. 5 via GO TO LINE COUNT connective 574 in FIG. 7 and the LINE COUNT connective 534 in FIG. 5. Because the value in scratch pad register 5 was equal to one (1) at the termination of the immediately-preceding three and nine-tenths milliseconds (3.9 ms) time period, that value would enable the program to pass to step 538. The time required to execute steps 550, 552, 554, 556, 558, 560, 563, 564, 566, 568, 570 and 572 of FIG. 7 and step 536 of FIG. 5 is so short that the air gap of magnetic head 208 would in almost all instances be engaging essentially the same area of the insert which it was engaging at the termination of the immediately-preceding three and nine-tenths millisecond (3.9 ms) time period. As a result, the head signal would, in the assumed instance, continue to be a "1"; and the program would resume its looping at step 538. In this way, the present invention permits the termination of the three and nine-tenths millisecond (3.9 ms) time period to occur at step 538 during the data collection routine and yet obviates the development of specious change-of-state signals as the program re-enters that routine.

If it is assumed that the head signal had been a zero (0) and the program had been looping at step 542, and if the value in scratch pad register 2 had been less than two (2), the TIMER connective 548 of FIG. 7 would have enabled the program to execute the steps 550, 552, 554, 556, 558, 560, 563, 564, 566, 568, 570 and 572 of FIG. 7 in the same manner in which it executed those steps when the three and nine-tenths millisecond (3.9 ms) time period terminated while the program was looping at step 538. However, when that program branches to step 536 in FIG. 5 via GO TO LINE COUNT connective 574 in FIG. 7 and LINE COUNT connective 534 in FIG. 5, the value in scratch pad register 5 would be zero (0)—having previously been set to that value during the execution of step 540 prior to the initiation of the looping at step 542. Consequently the ANDING function of step 536 directed the program to step 542. Because the time required to execute steps 550, 552, 554, 556, 558, 560, 563, 564, 566, 568, 570 and 572 of FIG. 7 and step 536 of FIG. 5 is very short, the air gap of magnetic head 208 would in almost all instances be engaging essentially the same area of the insert which it was engaging at the termination of the immediately-preceding three and nine-tenths milliseconds (3.9 ms) time period. As a result, the head signal would, in almost all instances, continue to be a "0"; and the program would resume its looping at step 542. Here again, the present invention permits the termination of the three and nine-tenths millisecond (3.9 ms) time period to occur without any development of specious change-of-state signals as the program re-enters the data collection routine.

The data collection routine is initiated prior to the time the leading edge of the insert can engage the air gap of magnetic head 208; and hence that routine will almost certainly loop at step 538 until the end of the first three and nine-tenths millisecond (3.9 ms) time period that is provided during step 530. If the scan path 230 of the insert has a magnetic-ink line or area thereon, some subsequent initiation of the data collection routine will cause step 538 to provide a NO. However, unless a NO is provided during step 542 of that data collection routine, a one (1) cannot be loaded into register 5 during that data collection routine. This is desirable; because the likelihood of electrical noise or some other transient causing a NO to be produced during step 538 and then causing a further NO to be produced within three and nine-tenths milliseconds (3.9 ms) during step 542 is far less than the likelihood of electrical noise or some other transient being able to cause a NO to be produced during step 538 or during step 542 of any given execution of the data collection routine. As a result, the requirement that a NO must be produced by step 538 and that a further NO be produced by the succeeding step 542 of the data collection routine during the same three and nine-tenths milliseconds (3.9 ms) constitutes a test, of the production, sequence and timing of oppositely-directed changes of state, which minimizes the risk that electrical noise or some other transient could produce signals which could cause the program to indicate that a magnetic-ink area or line had been sensed by the air gap of magnetic head 208.

Steps 558, 560, 563 and 564 of FIG. 7 provide protection against the possibility of electrical noise or some other transient producing signals which might cause the program to indicate that two closely-adjacent magnetic-ink lines or areas were present on an insert. They do so by permitting scratch pad register 2 to accumulate a count of two (2) therein only if two actual or specious line-indicating signals are developed during the same three and nine-tenths milliseconds (3.9 ms) time period or in contiguous three and nine-tenths milliseconds (3.9 ms) time periods. Specifically, if, in any given three and nine-tenths milliseconds (3.9 ms) time period, the data collection routine of FIG. 5 had, during step 546, effected the incrementing of the value in scratch pad register 2 from its initial zero (0) to one (1), the consequent directing, by step 556, of the program to step 558 would have effected the decrementing of the initial two (2) in scratch pad register 4 to one (1) during the latter step. However, because the value in the latter scratch pad register is one (1) rather than zero (0), the program branched from step 560 to step 566, and thereby avoided the re-setting of scratch pad register 2 to zero (0) which would have occurred if the program had been permitted to pass to step 563.

The one (1) in scratch pad register 2 would enable the sensing of a magnetic-ink line or area, during the next-succeeding three and nine-tenths milliseconds (3.9 ms) time period, to effect an incrementing of the value in scratch pad register 2 to two (2) in step 546; whereas the failure to sense a magnetic-ink line or area during that time period would leave the previously-set one (1) in that scratch pad register. In the former instance, the comparing function which is performed during step 554 would direct the program to step 614, whereas in the latter instance, the program would again execute steps 556 and 558. Importantly, the second execution of step 558 would decrement the value in scratch pad register 4 to zero (0); the hence the comparing function of step 560 would not be able to cause the program to pass to step 566 and thereby by-pass steps 563 and 564. As a result, the one (1) in scratch pad register 2 would be erased by the zero-setting operation performed during step 563; and hence the air gap of magnetic head 208 would have to engage the respond to two further magnetic-ink lines or areas, the data collection routine would have to check the nature and sequence of the resulting head signals, and steps 554, 556, 558, 560, 563 and 564 would have to determine whether those further magnetic-ink lines or areas were sensed during the same three and nine-tenths millisecond (3.9 ms) time period or during contiguous three and nine-tenths (3.9 ms) time periods. By requiring two (2) actual or specious line-indicating signals to be developed within the same or in contiguous three and nine-tenths millisecond (3.9 ms) time periods, steps 554, 556, 558, 560, 563 and 564 additionally decrease the likelihood that electrical noise or other transients could effect the authenticating of an insert.

The re-setting of the value in scratch pad register 4 to two (2), which occurred during step 564, will permit the next execution of steps 554, 556, 558 and 560 to again cause the program to bypass steps 563 and 564, as by being directed to step 566. This is desirable because it will permit a value of one (1), which is accumulated in scratch pad register 2 during step 546 of a subsequent execution of the data collection routine, to be retained in that scratch pad register—as by the bypassing of steps 563 and 564—so that one (1) could be incremented to two (2) during a subsequent execution of the data collection routine.

The leading portion of the border of each authentic U.S. one dollar, two dollar, five dollar, ten dollar and twenty dollar bill has at least two closely-adjacent, narrow, magnetic-ink lines which can be caused by the air gap of magnetic head 208 to determine whether the succession of time-related segments should be initiated. The width of each of those lines is narrow enough so both the leading edge and the trailing edge of either one of those lines can be moved past that air gap in considerably less than three and nine-tenths milliseconds (3.9 ms). As a result, even if, during any execution of the data collection routine of FIG. 5, the trailing edge of one of those magnetic-ink lines provided the first logic state change, that data collection routine would have enough time during the rest of the three and nine-tenths milliseconds (3.9 ms) time period to loop around steps 538, 540, 542, 544 and 546 to detect both the leading edge and the trailing edge of the next-succeeding, closely-adjacent narrow magnetic-ink line. If, during an execution of the data collection routine of FIG. 5, the leading edge of one of those magnetic-ink lines provided the first logic state change, that data collection routine might have enough time during the rest of the three and nine-tenths millisecond (3.9 ms) time period to loop around steps 538, 540, 542, 544 and 546 to detect both the leading edge and the trailing edge of that magnetic-ink line and also might have enough time to loop around steps 538, 540, 542, 544 and 546 to detect both the leading edge and the trailing edge of the next-succeeding, closely-adjacent narrow magnetic-ink line. In this way, whether a data collection routine is initiated at a time when the air gap of magnetic head 208 is engaging a magnetic-ink line, is initiated at a time when that air gap is engaging an ink-free space, that data collection routine will be able to respond to change-of-state signals from both the leading edge and the trailing edge of any magnetic-ink line which moved into engagement with, and then out of engagement with, that magnetic head during the three and nine-tenths millisecond (3.9 ms) time period of that data collection routine.

Establishment of Time-Related Segments

When the value in scratch pad register 2 exceeds one (1)—and thereby indicates that two magnetic-ink lines or areas were sensed during the same three and nine-tenths millisecond (3.9 ms) time period or during contiguous three and nine-tenths millisecond (3.9 ms) time periods—the comparing function provided during step 554 will cause the program to branch to step 614. During the latter step, a finite value other than zero (0) will be loaded into scratch pad register 8. The setting of the timer of 3853 to provide a two and three-tenths millisecond (2.3 ms) time period—which occurred during each prior execution of step 550—was not significant; because that timer was subsequently set, during step 566, to resume the providing of three and nine-tenths millisecond (3.9 ms) time periods. However, the setting of the timer of 3853 to provide a two and three-tenths millisecond (2.3 ms) time period will—whenever the value in scratch pad register 2 is at least two (2)—be significant; because the two and three-tenths millisecond (2.3 ms) time periods are used to define the areas on an insert where the head signals should be used to produce data that is collected and stored. More specifically, the portion of the scan path 230—which remains to be scanned after the data collection routine of FIG. 5 and steps 550, 552, 554, 556, 558, 560, 566, 568, 570 and 572 of FIG. 7 have indicated that two (2) closely-spaced magnetic-ink lines or areas were sensed on the insert—will be considered as being subdivided into one hundred and eighty-five (185) time-related segments, each of which has a length of only twenty-three thousandths (0.023) of an inch. Those segments enable the bill-handling device to collect and store data from those portions of the scan path 230 which contain important and significant authenticity-determining and denomination-identifying information without having to collect and store data from portions of that scan path which do not contain important and significant authenticity-determining and denomination-identifying information. For example, those segments enable the bill-handling device to collect and store data from the portion of scan path 230 immediately ahead of, in, and immediately behind the area where the black ink seal is located, and which is defined by segments thirty through eighty (30–80) on authentic U.S. bills, from the portion of that scan path immediately ahead of, in, and immediately behind the portrait border and the succeeding one half of the grid-like portrait background, and which starts at segment eighty-six (86) on authentic U.S. bills, and from the portion of that scan path immediately ahead of, in, and immediately behind the area where the green seal is located, and which is defined by segments one hundred and thirty-five through one hundred and eighty-five (135–185) on authentic U.S. bills.

Authentic U.S. bills have magnetic ink lines, such as line 213 of FIGS. 2 and 3, which enclose, but are spaced outwardly of, the border 215. Although the line 213 will be sensed by the air gap of magnetic head 208, and although the data collection routine of FIG. 5 will increment scratch pad register 2 to note the sensing of that line, the resulting one (1) in that scratch pad register will be erased during a subsequent execution of steps 558, 560 and 563 of FIG. 7. Specifically, the line 213 is spaced so far outwardly of the border 215 that more than three and nine-tenths millisecond (3.9 ms) will lapse between the sensing of the trailing edge of that line and the sensing of any line in the border 215. Consequently, in the three and nine-tenths millisecond (3.9 ms) time period which immediately followed the three and nine-tenths millisecond (3.9 ms) time period wherein the value in scratch pad register 2 was incremented to reflect the sensing of line 213, the data collection routine would not again increment that value; and hence the comparing function of step 554 would determine that less than two (2) counts were in that scratch pad register and would branch the program to step 556. During the subsequent execution of step 563, the one (1) in scratch pad register 2 would be erased. Consequently, the initiation of the first of the one hundred an eighty-five (185) time-related segments will not begin until the leading portion of the border 215 engages the air gap of magnetic head 208.

Collection and Storage of Data

During the rest of the two and three-tenths millisecond (2.3 ms) time period initiated in step 550, successive comparisons will be made between the value in scratch pad register 0 and the numbers thirty (30), eighty (80), eighty-six (86), eighty-seven (87), one hundred and thirty-five (135), and one hundred and eighty-five (185), and the data collection routine of FIG. 5 will be re-executed. At the end of that two and three-tenths millisecond (2.3 ms) time period, the program will branch to step 550 in FIG. 7 via TIMER connective 548; and a further interrupt service routine will be initiated.

The scratch pad register 0 is intended to accumulate a progressively-incremented number which will represent the number of the time-related segment which is, at any given instant, being sensed by the air gap of magnetic head 208. Because a finite time will be required to sense, and respond to, two (2) magnetic-ink lines in the leading portion of the border 215 of a U.S. bill, and because an average finite time for sensing and responding to such lines in U.S. one dollar, two dollar, five dollar, ten dollar and twenty dollar bills is at least four and six-tenths milliseconds (4.6 ms), the number two (2) was loaded into scratch pad register 0 during step 526.

Consequently, the initial comparisons which are made between the value in that scratch pad register and the numbers thirty (30), eighty (80), eighty-six (86), eighty-seven (87), one hundred and thirty-five (135), and one hundred and eighty-five (185) will produce a NO answer at each of steps 616, 618, 620, 622, 624 and 626 of FIG. 7. The consequent directing of the program to step 628 will enable the ANDING function of that step to determine that the zero (0), which was loaded into scratch pad register 7 during step 526 of FIG. 5, is the current value in that scratch pad register. Thereupon, the program will branch, via CLEAR connective 630 of FIG. 7 and CLEAR connective 632 of FIG. 10, to step 634. The consequent clearing of scratch pad register 2 will condition the data collection routine to sense and collect data corresponding to further magnetic-ink lines or areas that will engage the air gap of magnetic head 208.

During step 636, the value in scratch pad register 0 will be incremented to indicate the movement of the insert through a distance corresponding to one time-related segment. During step 638, an interrupt enable signal will be developed; and then the program will branch via LINE COUNT connective 640 in FIG. 10 and LINE COUNT connective 534 in FIG. 5 to step 536. Thereupon, the data collection routine will be reexecuted; and, during that routine, the air gap of magnetic head 208 will sense for further magnetic-ink lines or areas. At the end of the two and three-tenths millisecond (2.3 ms) time period set in the previous execution of step 550 of FIG. 7, TIMER connective 548 will again direct the program to step 550; and the timer in 3853 will again be set during that step to develop a two and three-tenths millisecond (2.3 ms) time period. However, because the value in scratch pad register 8 was incremented during the execution of step 614 of FIG. 7, the ANDING function in step 552 will branch the program to step 616. The value in scratch pad register 0 will still be substantially less than thirty (30); and hence each of the comparing functions during steps 616, 618, 620, 622, 624 and 626 will provide a NO. As a result, the ANDING function of step 628 will again cause the program to branch to step 634 of FIG. 10 via the CLEAR connectives 630 and 632, respectively, in FIGS. 7 and 10. Any value that was stored in scratch pad register 2 during the data collection routine will be erased by the re-setting of that scratch pad register during step 634. The value in scratch pad register 0 will again be incremented during step 636; and the enable interrupt will again be provided during step 638. Steps 550, 552, 616, 618, 620, 622, 624, 626 and 628 of FIG. 7 and steps 634, 636 and 638 of FIG. 10 constitute an interrupt service routine which will be executed, at least in part, many times during the operation of the bill-handling device. During each execution of that routine, the timer in 3853 will again be set to develop a two and three-tenths millisecond (2.3 ms) time period, and the value in scratch pad register 0 will be compared with the numbers thirty (30), eighty (80), eighty-six (86), eighty-seven (87), one hundred and thirty-five (135) and one hundred and eighty-five (185). During the ensuing execution of steps 634, 636 and 638 of FIG. 10, scratch pad register 2 will be cleared to erase any data which was stored therein during the data collection routine, the value in scratch pad register 0 will be augmented to enable that value to correspond to the instantaneous position of the scan path 230 relative to the air gap of magnetic head 208, and the enable interrupt will again be provided.

Sensing Black Seal Area

The program will repeatedly loop through the data collection and interrupt select routines until the value in scratch pad register 0 has been incremented to thirty (30); and, thereupon, during the execution of the next-succeeding interrupt select routine, the comparing function which is provided during step 616 will provide a YES. The program will then branch, via SET connective 646 of FIG. 7 and SET connective 648 of FIG. 10, to step 650. A one (1) will be loaded into scratch pad register 7 during step 650, scratch pad register 0 will again be incremented during step 636, the enable interrupt will be provided during step 638, and then the data collection routine will be reinitiated. Any magnetic-ink lines or areas which are sensed by the air gap of magnetic head 208 during that routine will be noted; and a corresponding incrementing will be made in the value in scratch pad register 2 during step 546. Because the value in scratch pad register 0 will be thirty-one (31), the comparing function provided by step 616 will permit the program to pass to step 628. Because a one (1) was loaded into scratch pad register 7 during step 650 of FIG. 10, the ANDING function in step 628 of the interrupt service routine will provide a NO. Thereupon, the program will branch, via SKIP connective 642 of FIG. 7 and SKIP connective 644 of FIG. 10, to step 636; and then the value in scratch pad register 0 will again be incremented during step 636 and the enable interrupt will be provided during step 638. It is important to note that the SKIP connectives 642 and 644, respectively, of FIGS. 7 and 10 enable the program to bypass step 634 of FIG. 10. As a result, any data that was stored in scratch pad register 2 during the preceding two and three-tenths milliseconds (2.3 ms) time period will not be erased and, instead, will remain in that scratch pad register. During the looping of the program through the data collection and interrupt service routines during the time period corresponding to time-related segments thirty through eighty (30–80), any magnetic-ink lines or areas along the corresponding portion of scan path 230 will be engaged and sensed; and corresponding incrementing of the data in scratch pad register 2 will occur during step 546 of FIG. 5.

During the interrupt service routine which occurs after the value in scratch pad register 0 has been incremented to eighty (80), the comparing function provided during step 618 of FIG. 7 will provided a YES. Thereupon, the program will branch, via RESET connective 652 of FIG. 7 and RESET connective 654 of FIG. 10, to step 656. During that step, any data that had been accumulated in scratch pad register 2, throughout the executions of the data collection routine in the time period corresponding to time-related segments thirty through eighty (30–80), will be transferred to scratch pad register 40—which was selected at an earlier time by the ISAR during step 528 of FIG. 5. Also, the ISAR will be caused to address scratch pad register 41. Because the time-related segments thirty through eighty (30–80) define the portion of scan path 230 which is immediately ahead of, in, and immediately behind the black seal area on a U.S. bill, and because that seal is engraved with non-magnetic ink, no data should be stored in scratch pad register 2, and hence no data should be transferred to scratch pad register 40. However, if any data, due to electrical noise or other transient, had been accumulated in scratch pad register 2, that data would be transferred to and stored in scratch pad register 40. If the insert was a photocopy, of a U.S. bill, which had been made by a copying machine that uses magnetic particles, the seal on that copy would cause magnetic head 208 to develop a large number of signals that would be noted by the incrementing of the value in scratch pad register 2 during executions of step 546 in FIG. 5. The resulting data in that scratch pad register would be transferred to and stored in scratch pad register 40 during step 656 of FIG. 10. All of this means that whatever data was developed as a result of the fifty-one (51) loopings of the program through the data collection and interrupt service routines, as the portion of scan path 230 which corresponds to time-related segments thirty through eighty (30–80) was engaging and passing the air gap of magnetic head 208, will be initially stored in scratch pad register 2 and then transferred to and stored within scratch pad register 40.

After the data, if any, in scratch pad register 2 is transferred to scratch pad register 40 during step 656, a zero (0) will be loaded into scratch pad register 7 during step 658; and scratch pad register 2 will be cleared during step 634. The data in scratch pad register 0 will be incremented to eighty-one (81) during step 636, and the enable interrupt will be provided during step 638. Thereafter, a further data collection routine and a further interrupt service routine will be initiated. During the latter routine, the comparing function of step 618 will respond to the eighty-one (81) in scratch pad register 0 to provide a NO; and hence the program will pass to step 628. Because scratch pad register 7 was reset to zero (0) during step 658, the ANDING function of step 628 will cause the program to branch to step 634 in FIG. 10—with consequent clearing of scratch pad register 2, a further incrementing of scratch pad register 0, the provision of the enable interrupt, and the initiation of a further data collective and interrupt service routine. During the looping of the program through the data collection and interrupt service routines, in the time period corresponding to time-related segments eighty-one through eighty-five (81–85), any data that is accumulated in scratch pad register 2 will be erased during each execution of step 634, and scratch pad register 2 will be incremented during each execution of step 636. The erasing of data obtained during those loopings is desirable, because the portion of scan path 230 which corresponds to time-related segments eighty-one through eighty-five (81–85) is located between the black seal and the leading portion of the portrait border on each U.S. bill; and that portion of that scan path is devoid of significant information.

Sensing Portrait Border Lines

During the interrupt service routine which occurs after the value in scratch pad register 0 has been incremented to eighty-six (86), the comparing function provided during step 620 of FIG. 7 will provide a YES. Thereupon, the program will branch, via PORTRAIT BORDER connective 660 of FIG. 7 and the identically-named connective 662 of FIG. 11, to step 664. The timer in the 3853 will be stopped during step 664, but motor 562 will continue to move the insert inwardly of the transport 30. Scratch pad register 4 will be loaded with a count of three (3) during step 666, and scratch pad registers 2, 5 and 6 will be cleared—by being set to zero (0)—during step 668. During step 670 an ANDING function will determine whether the head signal is zero (0)—thereby indicating that a magnetic-ink line or area had been moved into register with the air gap of magnetic head 208. If a NO is produced by that ANDING function, as will surely be the case because time-related segment eighty-six (86) corresponds to the ink-free areas immediately ahead of the portrait borders on U.S. bills, the program will loop at step 670 until a magnetic-ink line or area is moved into engagement with the air gap of magnetic head 208 to produce a logic "0" head signal. That magnetic-ink line or area will almost certainly be the left hand-most arcuate line at the left-hand side of the portrait border, and will be referred to hereinafter as the first portrait border line. Scratch pad register 5 will be incremented during step 672; and then a comparing function will be provided during step 674 to determine whether the head signal is a logic "1"—thereby indicating that the magnetic-ink line or area which constitutes the first portrait border line has been moved out of engagement with the air gap of magnetic head 208. If that comparing function provides a NO, as it will surely do because a finite time is required to move a magnetic-ink line or area out of engagement with that air gap, the program will loop at steps 672 and 674 until the head signal becomes a logic "1". Significantly, the scratch pad register 5 will be incremented during each of those loopings; and the number of those loopings will correspond to the width of the first portrait border line that was being sensed during those loopings. Specifically, because each looping requires twenty-two microseconds (22 $\mu$s), the number of loopings represents a definite length of time; and, because the insert is being moved at a fixed speed, the number of loopings is a true measure of the width of that first portrait border line.

When the comparing function of step 674 provides a YES—thereby indicating that the air gap of magnetic head 208 is in register with the space behind the first portrait border line, scratch pad register 5 will be incremented during step 676, and a comparing function will be provided during step 678 to determine whether the head signal is a logic "0"—thereby indicating that a further magnetic-ink line or area has been moved into engagement with that air gap. That magnetic-ink line or area would almost certainly be the second left-hand-most arcuate line at the left hand side of the portrait border on a U.S. one dollar, two dollar or twenty dollar bill or the arcuate edge of the left hand portion of the grid-like portrait background on U.S. five dollar and ten dollar bills. That line will be referred to hereinafter as the second portrait border line. If that comparing function provides a NO, as it will surely do because a finite time is required to move the space between the first and second portrait border lines out of engagement with the air gap of magnetic head 208, the program will loop at steps 676 and 678 until the head signal becomes a logic "0". Significantly, the scratch pad register 5 will be incremented during each of those loopings; and the number of those loopings will correspond to the width of the space immediately behind the first portrait border line.

The incrementings of the value in scratch pad register 5, which occur during the loopings through steps 676 and 678, will add to the value which was stored in that scratch pad register during the loopings through steps 672 and 674. Consequently, at the time the comparing function of step 678 provides a YES, the total count in scratch pad register 5 will represent the distance between the leading edge of the first and second portrait border lines. Also at that time, step 680 will cause the data in scratch pad register 5 to be transferred to scratch pad register 41—which is currently being addressed by the ISAR. In addition, step 680 will effect a further incrementing of ISAR so it will direct further data to scratch pad register 42.

Scratch pad register 5 will be cleared during step 682; and the value in scratch pad register 4 will be decremented from three (3) to two (2) during step 684. A comparing function in step 686 will compare the value in scratch pad register 4 with zero (0); and, at this time, will provide a NO. Thereupon, the program will branch back to step 672—with a consequent incrementing of the zero (0) in the scratch pad register 5 to one (1). At this time, the second portrait border line will still be in engagement with the air gap of the magnetic head 208, and hence the comparing function of step 674 will provide a NO. The program will loop through steps 672 and 674 until the head signal becomes a one (1)—thereby indicating that the second portrait border line has been moved out of engagement with the air gap, and that the air gap is sensing the space between that second portrait border line and the third portrait border line—which will be the arcuate edge of the left-hand portion of the grid-like portrait background on U.S. one dollar, two dollar, and twenty dollar bills and which will be the lefthand-most straight vertical line in the left-hand portion of the portrait background on U.S. five dollar and ten dollar bills. That line will be referred to hereinafter as the third portrait border line. During each looping of the program through steps 672 and 674, the scratch pad register 5 will be incremented; and hence, when the comparing function of step 674 provides a YES, the count in scratch pad register 5 will be a measure of the width of the second portrait border line.

During step 676, the value in scratch pad register 5 will be incremented, and the ANDING function of step 678 will determine whether the head signal is a logic "0". Because a finite time is required for the space between the second and third portrait border lines to be moved out of engagement with the air gap of magnetic head 208, the head signal will continue to be 1. Consequently, the program will loop at steps 676 and 678 until the leading edge of the third portrait border line is moved into engagement with the air gap—thereby causing the head signal to become a logic "0". At this time, the count in scratch pad register 5 will represent the total number of loopings at steps 672 and 674 plus the total number of loopings at steps 676 and 678, and hence will represent the total distance between the leading edges of the second and third portrait border lines.

When the comparing function of step 678 provides a YES, the data in scratch pad register 5 will be transferred to scratch pad register 42 during step 680. Also, the ISAR will be caused to address further data to scratch pad register 43. During step 682, scratch pad register 5 will again be cleared; and during step 684 the two (2) in scratch pad register 4 will be decremented to a one (1). The comparing function of step 686 will compare the one (1) in scratch pad register 4 with zero (0), and hence will provide a further NO—thereby causing the program to branch back to step 672.

The ensuing execution of steps 672,674,676 and 678 will cause scratch pad register 5 to accumulate the number of loopings at step 674 plus the number of loopings at step 678, will cause the total number of those loopings to be transferred to scratch pad register 43, and will cause ISAR to address all further data to scratch pad register 44. The number of loopings at steps 672 and 674 will be a measure of the width of the third portrait border line, and the number of loopings at steps 676 and 678 will be a measure of the width of the space which succeeds that line.

After step 680 has caused the data in scratch pad register 5 to be transferred to scratch pad register 43 and has caused ISAR to be incremented to address all further data to scratch pad register 44, scratch pad register 5 will be cleared in step 682, and scratch pad register 4 will be decremented to zero (0) during step 684. Consequently, the ANDING function of step 686 will provide a YES; and the program will branch through RET connective 688 of FIG. 11 and RET connective 690 of FIG. 12 to step 692. Thereupon, the timer in 3853 will be started again; and it will be caused to provide a further two and three-tenths millisecond (2.3 ms) time period. RES connective 694 in FIG. 12 and RES connective 696 in FIG. 10 will cause zero (0) to be loaded into scratch pad register 7 during step 658. Scratch pad register 2 will be cleared during step 634, scratch pad register 0 will be incremented during step 636, and the enable interrupt will be provided during step 638. During the time period between steps 664 and 692—when the timer in 3853 was stopped and then was re-started—the first second and third portrait border lines and the spaces behind those lines were moved past the air gap of magnetic head 208. Also, the length of that first line and its succeeding space was measured and a corresponding value was stored in scratch pad register 41, the length of that second line and its succeeding space was measured and a corresponding value was stored in scratch pad register 42, and the length of that third line and its succeeding space was measured and a corresponding value was stored in scratch pad register 43. Because the sensing of the three portrait border lines and the immediately-succeeding spaces may, and usually will, require more than two and three-tenths milliseconds (2.3 ms), the timer of 3853 was stopped during step 664. Consequently, when the timer was re-started in step 692, the count in scratch pad register 2 was only eighty-seven (87).

Sensing Grid Lines

Figure 10:
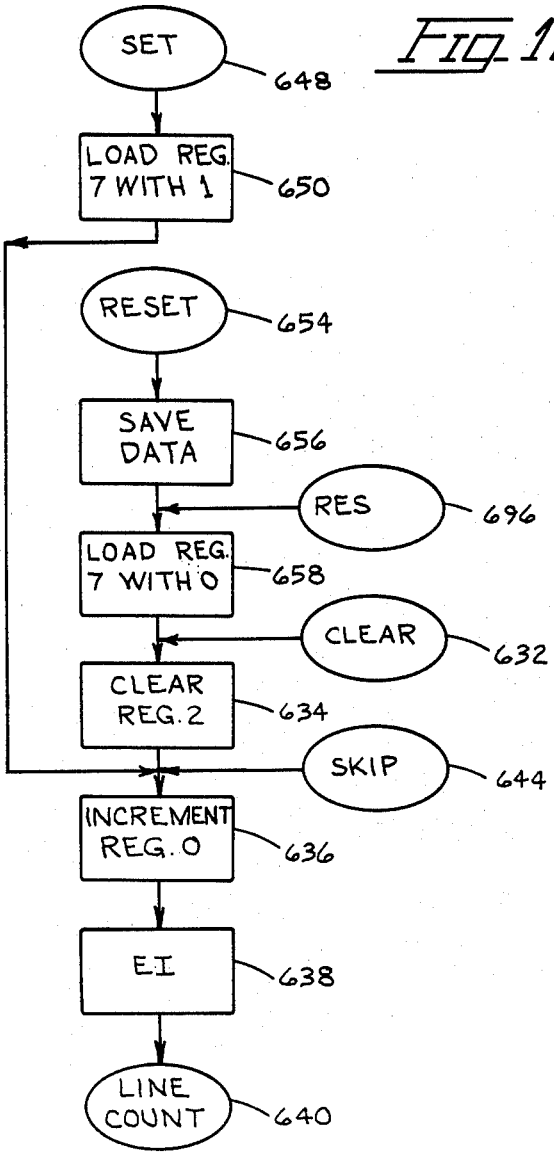
FIG. 10 is the portion of the flow chart which includes the steps of the reset routine.

The LINE COUNT connectives 640 and 534, respectively, in FIGS. 10 and 5 will cause the program to branch to step 536, and will thereby cause the data collection routine of FIG. 5 to be re-initiated. The data collection routine will continue through the existing two and three-tenths milliseconds (2.3 ms) time period; and then the interrupt will cause the program to branch to step 550 in FIG. 7 to initiate the interrupt service routine of FIG. 7. During the latter routine, step 622 will provide a YES as a result of a comparison between the count in scratch pad register 0 and the eighty-seven (87). Thereupon, FREQ connectives 698 and 700, respectively, of FIGS. 7 and 12 will cause the timer in 3853 to be stopped during step 702. Scratch pad register 3 will have sixteen (16) stored therein and scratch pad register 4 will have four (4) stored therein during step 704; and scratch pad registers 2, 5 and 6 will be cleared during step 706. An ANDING function during step 708 will determine whether the head signal is a logic "0" and, hence will determine whether a magnetic-ink line or area has moved into register with the air gap of the magnetic head 208. Steps 708, 710, 712, 714 and 716 of FIG. 12 perform a function that is essentially identical to the function which is performed by steps 670, 672, 674, 676 and 678 of FIG. 11, namely, sensing the width of a magnetic-ink line or area and the width of the immediately-succeeding space. However, steps 708, 710, 712, 714 and 716 are intended to, and will, measure the widths of straight vertical lines in the left-hand portion of the portrait background on U.S. bills and the widths of the immediately-succeeding spaces, rather than measure the widths of the portrait border lines and the widths of the immediately-succeeding spaces. Further, steps 708, 710, 712, 714 and 716 are intended to, and will, increment the count in scratch pad register 2 rather than increment the count in scratch pad register 5.

Each time the comparing function of step 716 provides a YES—and thereby indicates that the number of loopings at step 712 have been counted by incrementing the value in scratch pad register 2 and also that the number of loopings at step 716 have been counted by additionally incrementing the value in that scratch pad register, a comparison will be made during step 718 between the count in scratch pad register 2 and the numbers fifteen (15) and sixty (60). Whenever the comparison of step 718 determines that the count in scratch pad register 2 is both greater than fifteen (15) and less than sixty (60)—as it will be if the line that was sensed was a vertical grid line on a U.S. one dollar, two dollar, five dollar, ten dollar or twenty dollar bill, that comparison will provide a YES. If at the time the comparison of step 718 is made, the number of counts in scratch pad register 2 is not greater than fifteen (15), the sum of the widths of the sensed magnetic-ink line and of the immediately-succeeding space was less than the sum of the widths of a vertical grid line and the immediately-succeeding space in the portrait background of a U.S. one dollar, two dollar, five dollar, ten dollar or twenty dollar bill. If, at that time the comparison of step 718 is made, the number of counts in scratch pad register 2 is not less than sixty (60), the sum of the widths of the sensed magnetic-ink line and of the immediately-succeeding space was greater than the sum of the widths of a vertical grid line and the immediately-succeeding space in the portrait background of a U.S. one dollar, two dollar, five dollar, ten dollar or twenty dollar bill.

A YES from the comparison of step 718 will cause the count on scratch pad register 2 to be transferred to scratch pad registers 5 and 6 during step 720; will cause scratch pad register 2 to be cleared during step 722, and will cause the count in scratch pad register 3 to be decremented from sixteen (16) to fifteen (15) during step 724. Scratch pad registers 5 and 6 are used to provide sufficient storage capacity to accommodate the sum of the sixteen (16) totals that will be temporarily stored in scratch pad register 2 prior to the time the count of sixteen (16) in scratch pad register 3 is decremented to zero (0).

An ANDING function will be performed in step 726 to determine whether the count in scratch pad register 3 is zero (0); and the resulting NO will cause the program to branch to steps 710, 712, 714 and 716. During those steps, the width of a further vertical grid line and the width of the immediately-succeeding space will be measured, and the resulting count will be stored in scratch pad register 2. A YES from the ANDING function of step 716 will cause a comparison to be made, during step 718, between that count and the numbers fifteen (15) and sixty (60). If it is assumed that this second comparison during step 718 provides a YES, and if it further is assumed that each of the next fourteen (14) comparisons of step 718 provide a YES, the initial sixteen (16) count in scratch pad register 3 will be decremented to zero (0), and the counts that were successively stored in scratch pad register 2 will be added to the count stored in scratch pad registers 5 and 6. Consequently, at the end of the sixteenth execution of step 720, the total count in scratch pad registers 5 and 6 will represent the widths of sixteen (16) vertical grid lines plus the widths of the sixteen (16) immediately-succeeding spaces. At the end of that step, scratch pad register 2 will be cleared, the count in scratch pad register 3 will be decremented to zero (0), and the ANDING function of step 726 will provide a YES. During step 728, the total count stored in scratch pad registers 5 and 6 will be divided by sixteen (16); and, during step 730, the resulting quotient will be transferred to scratch pad register 44. Also during step 730, the ISAR will be incremented to address further data to scratch pad register 45. During the sixteen (16) executions of the routine which includes steps 710, 712, 714, 716, 718, 720, 722, 724, 726, 728 and 730 of FIG. 12, the distances between corresponding portions of sixteen (16) succeeding magnetic-ink lines or areas—in the time-related segments that started with segment eighty-seven (87)—were measured, summed and averaged, and then a count corresponding to that average was stored in scratch pad registers 5 and 6. That average will be in the range of twenty-nine through thirty-six (29–36) if the insert is an authentic U.S. one dollar bill that is not badly worn, that average will be in the range of forty-four through forty-seven (44–47) if the insert is an authentic U.S. five dollar bill that is not badly worn, and that average will be in the range of forty through forty-two (40–42) if the insert is an authentic U.S. two dollar or ten dollar or twenty dollar bill that is not badly worn.

Sensing Portrait And Rest of Portrait Background

Figure 12:
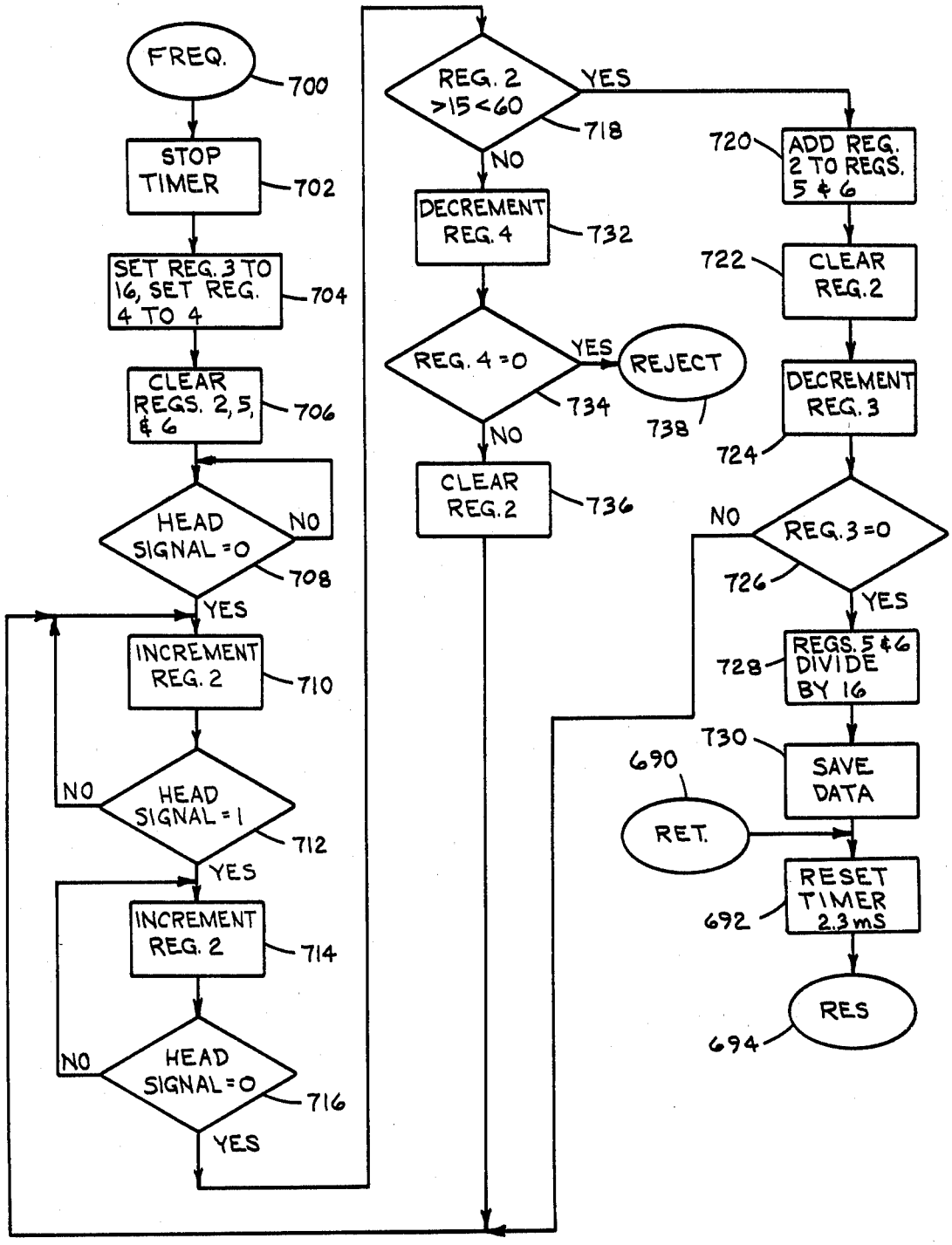
FIG. 12 is the portion of the flow chart which relates to the collecting and storing of data corresponding to the spacing of the vertical grid lines in the left-hand portions of the portrait backgrounds on U.S. bills.

At the conclusion of step 730 of FIG. 12, a further two and three-tenths milliseconds (2.3 ms) time period will be initiated during step 692; and then the RES connectives 694 and 696, respectively, of FIGS. 12 and 10 will branch the program to step 658. During the latter step, a zero (0) will be loaded into scratch pad register 7. During step 634 the scratch pad register 2 will be cleared, during step 636 the value in scratch pad register 0 will be incremented, and during step 638 the enable interrupt will be provided. Thereafter, the LINE COUNT connectives 640 and 534, respectively, of FIGS. 10 and 5 and step 536 will branch the program to the data collection routine. During the execution of that routine, any magnetic-ink line or area that is sensed by the air gap of magnetic head 208 will cause scratch pad register 2 to be incremented; and that routine will continue until the end of the existing two and three-tenths millisecond (2.3 ms) time period. During the ensuing execution of the interrupt service routine of FIG. 7, the number in scratch pad register 0 will be greater than eighty-seven (87) but will be smaller than one hundred and thirty-five (135); and hence the program will pass to step 628. The YES, that will be provided by the ANDING function of that step, will cause CLEAR connectives 630 and 632, respectively, of FIGS. 7 and 10 to branch the program to step 634. The clearing of scratch pad register 2, during the latter step, will erase any count corresponding to the magnetic-ink line that was noted during the last execution of the data collection routine. Scratch pad register 0 will be incremented during step 636, and the enable interrupt will be provided during step 638. Thereupon LINE COUNT connectives 640 and 534, respectively, of FIGS. 10 and 5 and step 536 will initiate a further data collection routine.

During that further data collection routine, and during all further data collection routines which are initiated prior to time-related segment one hundred and thirty-five (135), any magnetic-ink line or area which is sensed by the air gap of magnetic head 208 will have a corresponding count stored in scratch pad register 2 during step 546. However, that count will be erased when that scratch pad register is cleared during step 634 of FIG. 10. The overall result is that the bill-handling device will obtain data corresponding to each magnetic-ink line or area which the air gap of magnetic head 208 engages in the portrait and in the right-hand portrait background of a U.S. bill will momentarily store that data, but will promptly erase that data.

Sensing Green Seal Area

In the data collection routine which is executed during time-related segment one hundred and thirty-five (135), any data corresponding to any magnetic-ink line or area which the air gap of magnetic head 208 engages will cause scratch pad register 2 to be incremented. In the ensuing interrupt service routine of FIG. 7, the comparing function of step 624 will provide a YES, because the number in scratch pad register 0 will be one hundred and thirty-five (135). Consequently, SET connectives 740 and 648, respectively, of FIGS. 7 and 10 will branch the program to step 650; and, during that step, one (1) will be loaded into scratch pad register 7. Thereafter, scratch pad register 0 will be incremented during step 636, the enable interrupt will be provided during step 638, and LINE COUNT connectives 640 and 534, respectively, of FIGS. 10 and 5 and step 536 will initiate a further data collection routine.

During that further data collection routine, and also during all subsequent data collection routines which are executed prior to time-related segment one hundred and eighty-five (185), any data corresponding to any magnetic-ink line or area which the air gap of magnetic head 208 engages will increment the value in scratch pad register 2 during step 546. That value will not be erased, because the ANDING function of step 628 in FIG. 7 will provide a NO—in view of the one (1) which was loaded into scratch pad register 7 during step 650 of FIG. 10. Consequently, the program will branch via SKIP connectives 642 and 644, respectively, of FIGS. 7 and 10, to step 636 of FIG. 7—thereby by-passing the clearing of scratch pad register 2 which is provided by step 634.

Because the air gap of magnetic head 208 will engage the magnetic-ink lines of the denomination-identifying numerals, adjacent and in the green seal, during some of the time-related segments one hundred and thirty-five through one hundred and eighty-five (135–185), the value stored in scratch pad register 2 will represent the number of such lines in that area. The total number of such lines will be less than the storage capacity of scratch pad register 2 and hence an overflow scratch pad register is not required. During the interrupt service routine which follows the data collection routine that was initiated during segment one hundred and eighty-five (185), the comparing function of step 626 will provide a YES. Thereupon, STOP connectives 742 and 744, respectively, of FIGS. 7 and 13 will branch the program to step 746; and, during that step, the data in scratch pad register 2 will be transferred to scratch pad register 45. Also during that step, the ISAR will be incremented to cause it to direct further data to scratch pad register 46. CKBD connectives 748 and 750, respectively, of FIGS. 13 and 14 will branch the program to step 752 of FIG. 14. The count that was transferred to scratch pad register 45 represents the number of magnetic-ink lines or areas which the air gap of magnetic head 208 engaged while an area, corresponding to the green seal area on a U.S. bill, was being moved past that air gap. If the insert had been an authentic U.S. bill, the resulting count could be used to help authenticate U.S. one dollar and five dollar bills, and could be used to help authenticate two dollar, ten dollar and twenty dollar bills while also helping distinguish twenty dollar bills from two dollar and ten dollar bills.

Figure 11:
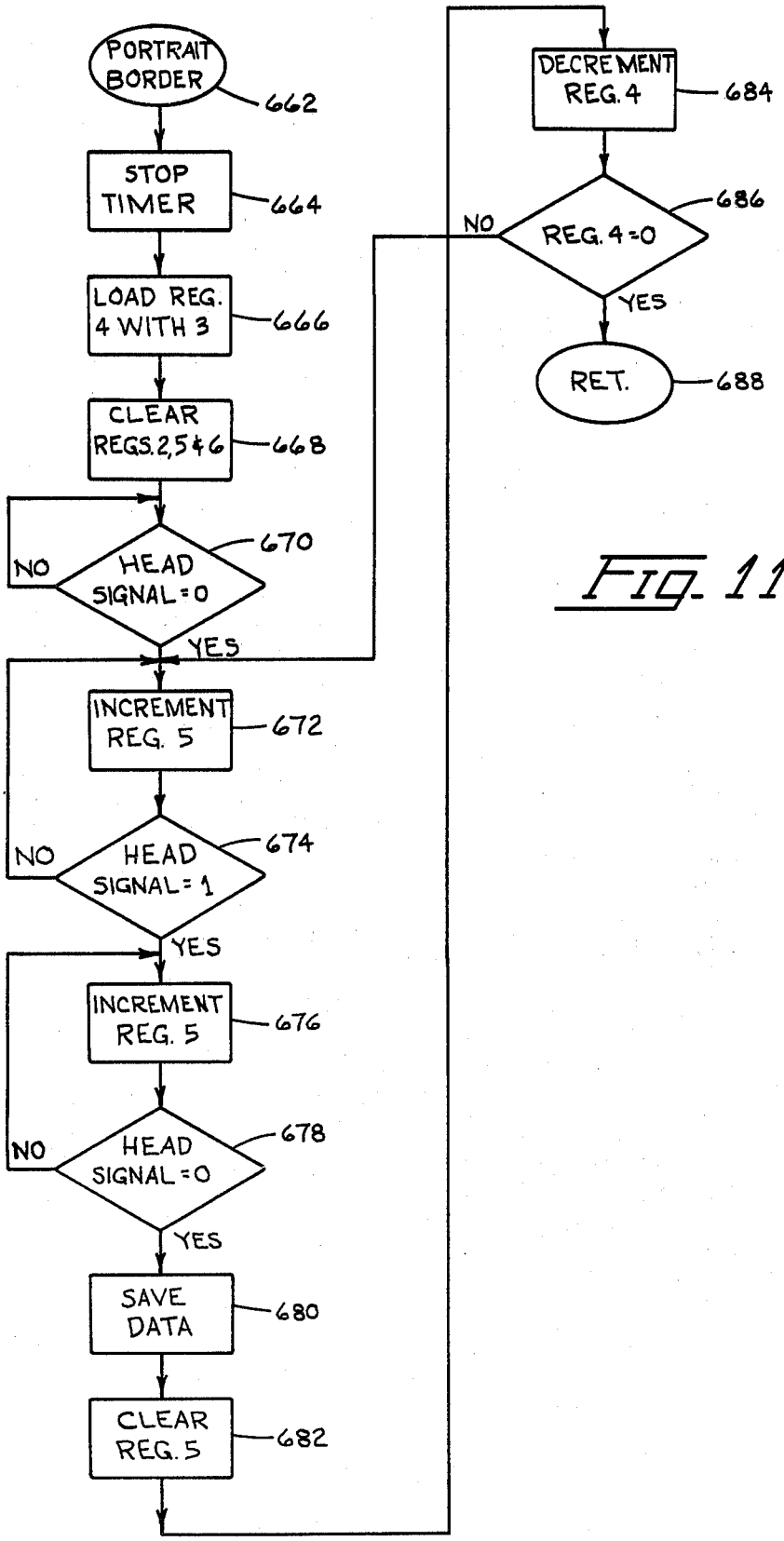
FIG. 11 is the portion of the flow chart which relates to the collecting and storing of data corresponding to magnetic-ink lines in the portrait borders on U.S. bills.

The lapse of time between the stopping of timer 3853 during step 664 of FIG. 11 and the subsequent re-starting of that timer during step 692 of FIG. 12 is closely, but not precisely, predictable; because the widths of, and spacings between, the first four (4) portrait border lines are not the same on authentic U.S. one dollar, two dollar, five dollar, ten dollar and twenty dollar bills. Similarly, the lapse of time between the stopping of timer 3853 during step 702 of FIG. 12 and the subsequent re-starting of that timer during step 692 of FIG. 12 is closely, but not precisely, predictable; because the widths of, and spacings between, the vertical portrait background lines are not the same on authentic U.S. one dollar, two dollar, five dollar, ten dollar and twenty dollar bills. However, the bill-handling device of the present invention compensates for any variation in the length of the time period between the stopping and re-starting of timer 3853 during steps 664 and 692 by having the collecting and storing of data from the vertical portrait background lines begin as soon as the collecting and storing of data from the first four (4) portrait border lines is completed. Also, that bill-handling device compensates for any such variation by sensing those vertical portrait background lines along a scan line where the number of those lines is considerably larger than sixteen (16). The bill-handling device compensates for any variation in the length of the time period between the stopping and re-starting of timer 3853 during steps 702 and 692 by having the count in scratch pad register 0 reach the number one hundred and thirty-five (135) well prior to the time the first of the denomination-defining magnetic-ink lines of the green seal area could move into engagement with the air gap of magnetic head 208. The overall result is that the bill handling device will have ample time and opportunity to scan, and to collect and store data from, each significant area on each inserted authentic U.S. one dollar, two dollar, five dollar, ten dollar and twenty dollar bill.

Unacceptable Measurements of Grid Lines

If, during any execution of the routine which includes steps 710, 712, 714 and 716 of FIG. 12, the count that was accumulated in scratch pad register 2 was fifteen (15) or less, that count would indicate (a) that the insert was not an authentic U.S. one dollar, two dollar, five dollar, ten dollar or twenty dollar bill, or (b) that part of one of the vertical grid lines on such a bill had been worn away. If during any execution of the routine which includes steps 710, 712, 714 and 716 of FIG. 12, the count that was accumulated in scratch pad register 2 was sixty (60) or more, that count would indicate (a) that the insert was not an authentic U.S. one dollar, two dollar, five dollar, ten dollar or twenty dollar bill or (b) that some magnetic particles had been applied to the left-hand one-half of the portrait background on such a bill. In either event, the comparing function of step 718 would provide a NO; and the count in scratch pad register 4 would be decremented during step 732 to three (3). The ANDING function of step 734 would determine that the count in scratch pad register 4 was not zero (0), and hence would provide a NO. Thereupon, scratch pad register 2 would be cleared during step 736, and the program would branch back to step 710.

If, during succeeding executions of the routine which includes steps 710, 712, 714 and 716, the comparison of step 718 provided three (3) additional NO responses, the count in scratch pad register would be decremented to zero (0). Thereupon, the ANDING function of step 734 would provide a YES; and REJECT connectives 738 and 578, respectively, of FIGS. 12 and 8 would cause the program to execute the reject routine.

During that routine, "0.00" will appear on the seven-segment units 458, 460, and 462 of display 454; and motor 562 will operate in the reverse direction until it returns the insert to the platform 32 on lower platen 40. Thereafter, START connectives 596 and 504, respectively, of FIGS. 8 and 5, step 506 and step 508 of FIG. 5 will branch the program to step 510; and that program will loop at the latter step until switch 146 is again closed. In this way, the bill-handling device will respond to four or more unacceptable counts of lines, which were sensed during time-related segments--after segment eighty-seven (87) and before segment one hundred and thirty-five (135)--to indicate that the insert is not acceptable, to return that insert to platform 32, and to place that bill-handling device in its "standby" or "ready" condition.

Detailed Description of Analyses of Data

The bill-handling device of the present invention does not start to analyze the denomination-determining data--which is collected and stored during scanning of the black seal area, the leading portrait border area, the left-hand portion of the portrait background, and the green seal area--until the air gap of magnetic head 208 has reached time-selected segment one hundred and eighty-five (185). Because the succession of time-related segments is not generated unless and until at least two (2) magnetic-ink lines are sensed in the leading portion of the border of a U.S. bill within less than seven and eight-tenths milliseconds (7.8 ms), the sensing of that leading portion of the border is important, even though no data is collected and stored during that sensing for subsequent analysis. By requiring those two magnetic-ink lines to be sensed within the same three and nine-tenths millisecond (3.9 ms) time period or within contiguous three and nine-tenths millisecond (3.9 ms) time periods, the bill-handling device of the present invention makes certain that no ordinary individual could use a ruling pen and magnetic ink to prepare two lines which would cause the bill-handling device to start generating the succession of time-related segments. Also by requiring the presence of each of those lines to be established by a signal corresponding to the leading edge and by an oppositely-developed signal corresponding to its trailing edge, and by requiring the minimum of two sets of edge-indicating signals to be developed within the same three and nine-tenths millisecond (3.9 ms) time period or within contiguous three and nine-tenths millisecond (3.9 ms) time periods, the present invention virtually insures that sixty (60 ) cycle electrical noise will not be accepted as line-indicating signals.

Figure 13:
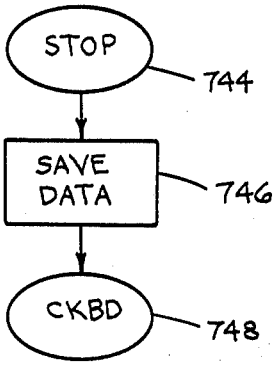
FIG. 13 is a portion of the flow chart which shows a step that effects the transfer of data from one scratchpad register to another scratchpad register.

Subsequently, as the CKBD connectives 748 and 750, respectively, of FIGS. 13 and 14 branch the program to step 752 of FIG. 14, a comparing function during that step will determine whether the count in scratch pad register 40 is greater than two (2). Because that count corresponds to the number of magnetic-ink lines or areas in the black seal area on a U.S. bill, and because non-magnetic ink is used to engrave that seal, there should be no count in scratch pad register 40. However, because electrical noise or some other transient might possibly cause a count of one (1) or two (2) to be stored in that scratch pad register, and because a photocopy of a U.S. bill that was made by a copying machine which uses magnetic particles would produce a large count in scratch pad register 40, it is practical to have step 752 provide a NO--even if the count in scratch pad register 40 is two (2). However, if the count in that scratch pad register were to exceed two (2), as it would do if the insert was a photocopy made with magnetic particles, REJECT connectives 778 and 578, respectively, of FIGS. 14 and 8 would initiate the reject routine--with consequent returning of the insert to platform 32 and re-setting of the bill-handling device.

Figure 14:
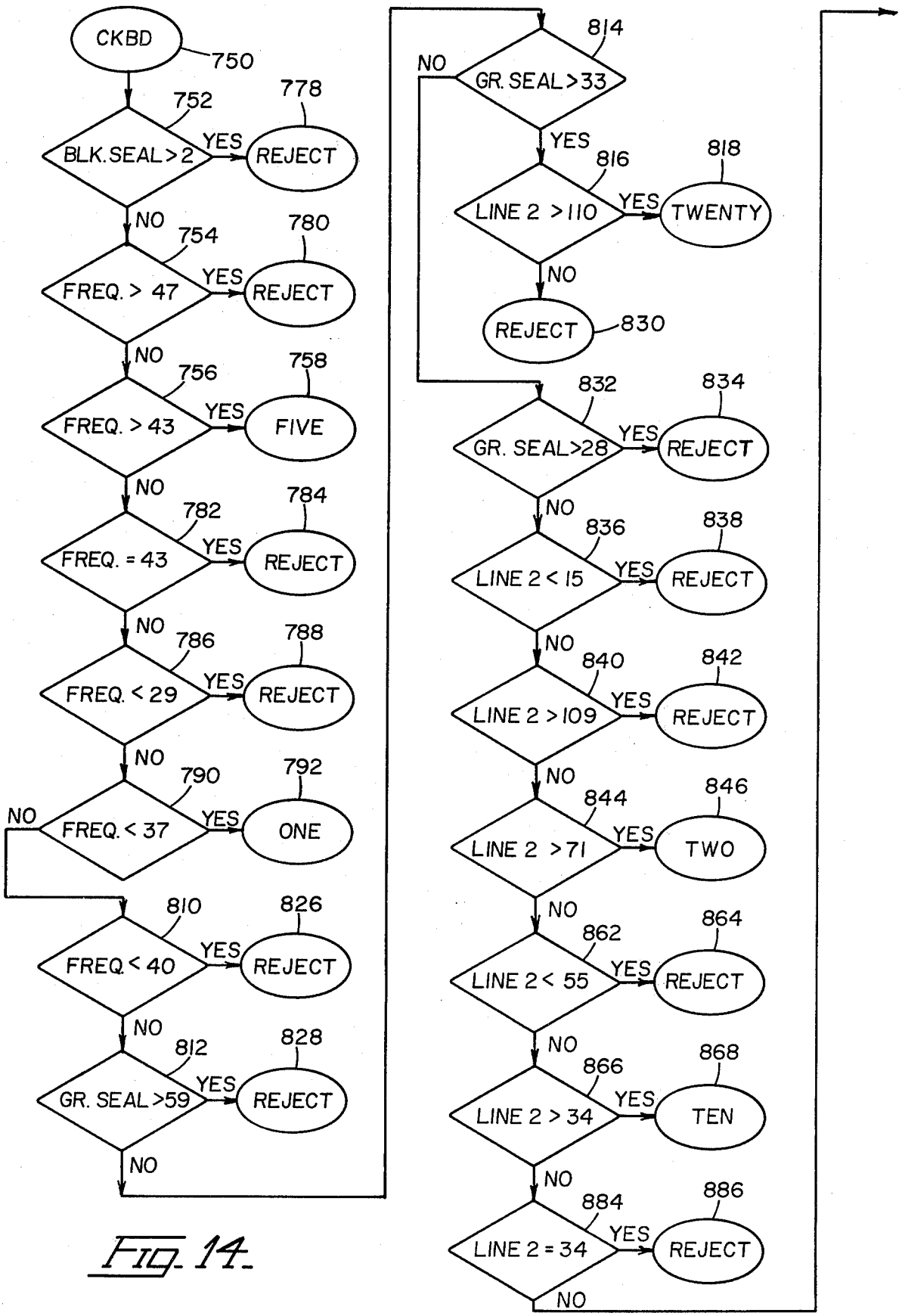
FIG. 14 is a portion of the flow chart which shows steps that control some of the processing of data obtained in earlier steps of the flow chart.

If the comparing function of step 752 of FIG. 14 provided a NO, a comparing function of step 754 would determine whether the count in scratch pad register 44 was greater than forty-seven (47). Because the count which represents the maximum distance between corresponding points on adjacent vertical portrait background lines of an authentic U.S. one dollar, two dollar, five dollar, ten dollar or twenty dollar bill is forty-seven (47), a YES from the comparing function of step 754 should and will, cause REJECT connectives 780 and 578, respectively, of FIGS. 14 and 8 to initiate the reject routine. Thereupon, the insert would be returned to platform 32, and the bill-handling device would be reset.

Figure 16:
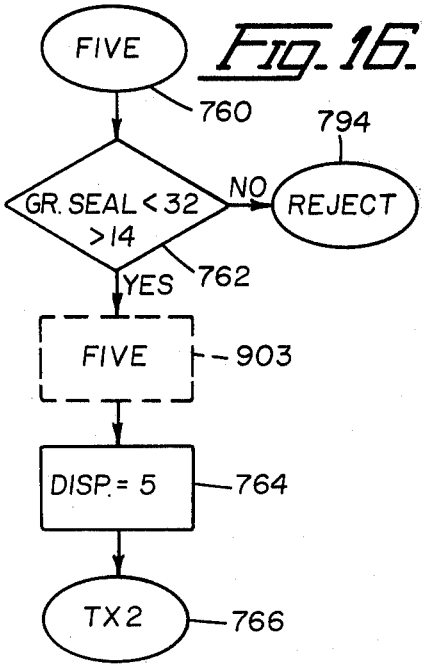
FIG. 16 is a portion of the flow chart which shows steps wherein data from U.S. five dollar bills are processed.

If the comparing function 754 of FIG. 14 provided a NO, a comparing function of step 756 would determine whether the count in scratch pad register 44 was greater than forty-three (43). Because the count which represents the average distance between corresponding points on adjacent vertical portrait background lines of an authentic U.S. five dollar bill is in the range of forty-four through forty-seven (44–47), a YES from the comparing function of step 756 indicates that the insert is an authentic U.S. five dollar bill or is a photocopy of such a bill that was made by a copying machine which uses magnetic particles. Consequently, FIVE connectives 758 and 760, respectively, of FIGS. 14 and 16 would branch the program to step 762 of FIG. 16. The comparing function of that step will determine whether the count in scratch pad register 45 is both greater than fourteen (14) and less than thirty-two (32). Because the count obtained from the green seal area of an authentic U.S. five dollar bill ranges from fifteen through thirty-one (15–31), whereas the count from the corresponding area on a counterfeit made with nonmagnetic ink would be zero (0) and the count from the corresponding area on a counterfeit made with magnetic ink or particles would exceed thirty-two (32), a YES from the comparing function of step 762 would establish that the insert was an authentic U.S. five dollar bill. The dotted-line step 903 of FIG. 16 is not significant where the program does not supply signals to a vending machine, and hence that step should not be considered. Next in this section, step 764 will respond to the YES from the comparing function of step 762 to store in scratch pad register 49 a signal which will enable the seven-segment unit 458 to exhibit a five (5) and also will enable the display 454 to exhibit a decimal point behind that five (5). Step 764 does not need to send a signal to either of scratch pad registers 50 and 51; because the data which was loaded into those scratch pad registers during step 520 will cause each of the seven-segment units 460 and 462 to exhibit a zero (0).

The TX2 connectives 766 and 768, respectively, of FIGS. 16 and 17 will cause step 770 of FIG. 17 to initiate the display routine. During that routine, the display 454 will exhibit "5.00". While that display is exhibiting that value, a comparing function of step 772 will determine whether the U.S. five dollar bill has been moved far enough inwardly of transport 30 to permit the trailing edge thereof to free actuator 164. If that actuator is being held in switch-closing position by the U.S. five dollar bill, the program will loop at step 772 until the trailing edge of that U.S. five dollar bill frees actuator 164. Once that actuator has been freed, switch 162 will reopen; and the comparing function of step 772 will provide a YES. The T STOP connectives 774 and 776, respectively, of FIGS. 17 and 8, will branch the program to step 592 of FIG. 8.

During step 592, the logic "0" that was applied to the base of transistor 346 to enable that transistor to cause the MOTOR START AND RUN block 348 to energize the motor 562 will be removed; and, thereupon, that motor will be de-energized. A delay of one hundred milliseconds (100 ms) will be provided during step 594, as by causing the delay routine of FIG. 6 to be executed twice. At the end of that delay, the START connectives 596 and 504, respectively, of FIGS. 8 and 5 will cause steps 506, 508 and 510 to place the bill-handling device in its "standby" or "ready"0 condition.

If, instead of providing a YES, the comparing function of step 762 of FIG. 16 had provided a NO, the insert would have been determined to be other than an authentic U.S. five dollar bill. Such an insert should be rejected; and the NO of that comparing function would cause the program, via REJECT connectives 794 and 578, respectively, of FIGS. 16 and 8 to initiate the reject routine of FIG. 8. Thereupon, the insert will be returned to platfom 32, and the bill-handling device will be re-set.

If, instead of providing a YES, the comparing function of step 756 of FIG. 14 provided a NO, the routine of FIG. 16 would not have been executed. Instead, a comparing function of step 782 would determine whether the count in scratch pad register 44 is equal to the number forty-three (43). Because no authentic U.S. one dollar, two dollar, five dollar, ten dollar or twenty dollar bill has the portrait background lines thereof so spaced that the average distance between corresponding points on those lines is equal to forty-three (43), a YES at the conclusion of the comparing function of step 782 would indicate that the insert was not an authentic U.S. one dollar, two dollar, five dollar, ten dollar or twenty dollar bill. In response to such a YES, REJECT connectives 784 and 578, respectively, of FIGS. 14 and 8 would initiate the reject routine--with consequent returning of the insert to platform 32 and re-setting of the bill-handling device.

If the comparing function of step 782 had provided a NO, a comparing function in step 786 would determine whether the count in scratch pad register 44 was less than the number twenty-nine (29). Because no authentic U.S. one dollar, two dollar, five dollar, ten dollar or twenty dollar bill has the portrait background lines thereof so spaced that the average distance between corresponding points on those lines is less than twenty-nine (29), a YES at the conclusion of the comparing function of step 786 would indicate that the insert was not an authentic U.S. one dollar, two dollar, five dollar, ten dollar or twenty dollar bill. In response to such a YES, REJECT connectives 788 and 578, respectively, of FIGS. 14 and 8 would initiate the reject routine--with consequent returning of the insert to platform 32 and re-setting of the bill-handling device.

If the comparing function of step 786 had provided a NO, a comparing function of step 790 would determine whether the count in scratch pad register 44 was less than thirty-seven (37). Because an authentic U.S. one dollar bill has the portrait background lines thereof so spaced that the average distance between corresponding points on those lines is in the range of twenty-nine through thirty-six (29–36), whereas each authentic U.S. two dollar, five dollar, ten dollar and twenty dollar bill has the portrait background lines thereof so spaced that the average distance between corresponding points in those lines is greater than thirty-seven (37), a YES at the conclusion of the comparing function of step 790 would indicate that the insert was an authentic U.S. one dollar bill. In response to such a YES, the ONE connectives 792 and 796, respectively, of FIGS. 14 and 18 will branch the program to step 798 in FIG. 18.

A comparing function during that step will determine whether the count in scratch pad register 45 is greater than the number twenty-five (25). Such a determination is useful; because the count in scratch pad register 45 will represent the number of magnetic-ink lines in the area on the insert which corresponds to the green seal on a U.S. bill, and the number of such lines on an authentic U.S. one dollar bill is in the range of six through twenty-five (6–25). This means that if the number in scratch pad register 45 is greater than twenty-five (25), the insert is not an authentic U.S. one dollar bill. The resulting YES from the comparing function of step 798 will, via REJECT connectives 806 and 578, respectively, of FIGS. 18 and 8, initiate the reject routine--with consequent return of the insert to platform 32 and re-setting of the bill-handling device.

If the comparing function of step 798 of FIG. 18 provided a NO--as it should do if the insert is an authentic U.S. one dollar bill, a comparing function of step 800 will determine whether the number in scratch pad register 45 is less than five (5). This is a useful determination; because an insert which has less than five (5) magnetic-ink lines in the area which corresponds to the green seal on a U.S. bill is not an authentic U.S. one dollar bill. Consequently, if the comparing function of step 800 provides a YES, the REJECT connectives 808 and 578, respectively, of FIGS. 18 and 8 will initiate the reject routine--with consequent return of the insert to platform 32 and re-setting of the bill-handling device.

As pointed out hereinbefore, the dashed line step 903 is not applicable to this section; and, consequently, a NO from the comparing function of step 800 will cause a one (1) to be stored in scratch pad register 49 during step 802. The storing of that value in that scratch pad register will effect the display of a one (1) by the seven-segment unit 458 of the display 454 during step 770 of FIG. 17. The TX2 connectives 804 and 768, respectively, of FIGS. 18 and 17 will branch the program to step 770 of FIG. 17; and, thereupon, the display 454 will cause the seven-segment units 458, 460 and 462 thereof to exhibit a "1.00".

A comparing function in next-succeeding step 772 will determine whether switch 162 has been permitted to re-open--as it will do when the trailing edge of the insert has been moved inwardly beyond the actuator 164 of that switch. If switch 162 has not been permitted to re-open, the program will loop at step 772 until the trailing edge of the insert has been moved far enough inwardly of the transport 30 to permit that switch to re-open. The resulting YES from the comparing function of step 772 will enable the program, via T STOP connectives 774 and 776, respectively, of FIGS. 17 and 8 to stop the motor 562, provide a delay of one hundred milliseconds (100 ms), initialize the ports, set the timer interrupt address, and start looping at step 510 until switch 146 is re-closed—all as provided by steps 592, 594, 506, 508 and 510 in FIGS. 8 and 5. In this way, the insertion of an authentic U.S. one dollar bill will be recognized by the display of appropriate indicia on seven-segment units 458, 460 and 462, and that bill will be accepted by being moved inwardly beyond the actuator 164 of switch 162.

If the insert had not been an authentic U.S. one dollar bill, the comparing function of step 790 of FIG. 14 would have provided a NO; and the comparing function of step 810 would determine whether the number in scratch pad register 44 is less than the number forty (40). Because no authentic U.S. two dollar, five dollar, ten dollar or twenty dollar bill has the portrait background lines thereof so spaced that the average distance between corresponding points on those lines is less than forty (40), a YES at the conclusion of the comparing function of step 810 would indicate that the insert was not an authentic U.S. two dollar, five dollar, ten dollar or twenty dollar bill. In response to such a YES, REJECT connective 826 and 578, respectively, of FIGS. 14 and 8 would initiate the reject routine—with consequenct returning of the insert to platform 32 and re-setting of the bill-handling device.

If the comparing function of step 810 had provided a NO, a comparing function in step 812 would determine whether the count in scratch pad register 45 was greater than the number fifty-nine (59). Such a comparison is useful, because no authentic U.S. one dollar, two dollar, five dollar, ten dollar or twenty dollar bill has more than fifty-nine (59) magnetic ink lines in the denomination-defining numerals of the green seal area thereof. Consequently, if the comparing function of step 812 provides a YES, the insert is a photocopy of a U.S. bill which was made by a copying machine that uses magnetic particles, and hence should be rejected. As a result, a YES from the comparing function of step 812 will cause the program, via REJECT connectives 828 and 578, respectively, of FIGS. 14 and 8 to initiate the reject routine of FIG. 8—with consequent returning of the insert to platform 32 and re-setting of the bill-handling device.

If the comparing function of step 812 had provided a NO, a comparing function in step 814 would determine whether the count in scratch pad register 45 was less than thirty-three (33). Such a comparison is useful, because the number of magnetic-ink lines in the denomination-defining numerals of the green seal area on an authentic U.S. twenty dollar bill is in the range of thirty-three through fifty-nine (33–59), whereas the number of magnetic-ink lines in the denomination-defining numerals of the green seal area of each authentic U.S. ten dollar bill is in the range of eight through thirty-two (8–32) and the number of magnetic-ink lines in the denomination-defining numerals of the green seal area of many authentic U.S. two dollar bills is in the range of eight through thirty-two (8–32)—although some authentic U.S. two dollar bills have as many as thirty-five (35) magnetic-ink lines in the denomination-defining numerals of the green seal area thereon. Consequently, a NO at the conclusion of the comparing function of step 814 will indicate that the insert (a) is not an authentic ten dollar bill, (b) probably is not an authentic U.S. two dollar bill, and (c) probably is an authentic U.S. twenty dollar bill—although it might be an authentic U.S. two dollar bill. If that comparing function does provide a YES, a comparing function in step 816 would determine whether the count in scratch pad register 42 was greater than one hundred and ten (110).

Because the value in scratch pad register 42 is a measure of the point-to-point distance between corresponding points on the second and third portrait border lines, and because the point-to-point distance between corresponding points on the second and third portrait border lines on a twenty dollar bill is greater than one hundred and ten (110), whereas the point-to-point distance between corresponding points on the second and third portrait border lines on an authentic U.S. two dollar bill or an authentic ten dollar bill is in the range of fifteen through thirty-three (15–33), a YES at the conclusion of the comparing function of step 816 would indicate that the insert was an authentic twenty dollar bill. Thereupon TWENTY connectives 818 and 820, respectively, in FIGS. 14 and 19 would direct the program to step 822 in FIG. 19—the dotted-line step 903 not being applicable in this section. During step 822, a two (2) will be loaded into scratch pad register 48 and a HEX 10 will be loaded into scratch pad register 49. Thereafter, TX 2 connectives 824 and 768, respectively, of FIGS. 19 and 17 will branch the program to step 770; and, during that step, the display 454 will be caused to exhibit "20.00" The program then will loop at next-succeeding step 772 until the insert is moved far enough inwardly of the transport 30 to permit switch 162 to re-open; and then T STOP connectives 774 and 776, respectively, of FIGS. 17 and 8 will cause steps 592, 594, START connectives 596 and 504, and steps 506, 508 and 510 of FIGS. 8 and 5 to de-energize motor 562, provide a one hundred millisecond (100 ms) delay, initialize the Ports, set the timer interrupt address, and cause the program to loop at step 510.

It will be noted that if the comparing function of step 814 had provided a YES, the program would have branched to step 832 so the determination of whether the insert was an authentic U.S. two dollar or ten dollar bill could be made by the routine which includes steps 832, 836, 840, 844, 862, 866, 884, 888, 892 and 896. Consequently, when the comparing function of step 814 provided a NO, and when the comparing function in next-succeeding step 816 determined whether the count in scratch pad register 42 was greater than one hundred and ten (110), the primary purpose of the latter comparing function was to determine whether the insert was an authentic or spurious twenty dollar bill. If the answer to the comparing function of step 816 was NO, REJECT connectives 830 and 578, respectively, of FIGS. 14 and 8 would initiate the reject routine—with consequent returning of the insert to platform 32 and re-setting of the bill-handling device.

It is recognized that if the number of magnetic-ink lines in the denomination-defining numerals of the green seal area of an authentic U.S. two dollar bill were thirty-three (33), thirty-four (34), or thirty-five (35), the comparing functions of steps 814 and 816 would initiate the rejection of that bill. Specifically, the comparing function of step 814 would respond to a count of thirty-three (33), thirty-four (34), or thirty-five (35) in scratch pad register 45 to direct the program to step 816, and hence would necessarily direct that program away from step 832. Thereafter, the comparing function of step 816 would respond to the count—between fifteen and one hundred and nine (15–109)—in scratch pad register 42 that would represent the point-to-point distance between corresponding points on the second and third portrait border lines on all authentic U.S. two dollar bills—to provide a NO. Thereupon, REJECT connectives 830 and 578, respectively, of FIGS. 14 and 8 would initiate the reject routine of FIG. 8—with consequent returning of that authentic U.S. two dollar bill to platform 32 and re-setting of the bill-handling device. Although the rejection of authentic U.S. two dollar bills in this manner is possible, such a rejection does not normally occur; because the number of magnetic-ink lines in the denomination-defining numerals of the green seal area on most authentic U.S. two dollar bills is in the range of eight through thity-two (8–32). Moreover, it frequently happens that when a rejected authentic U.S. two dollar bill is re-inserted in the transport 30, that bill will be authenticated and will have the value thereof displayed by the seven-segment units 458, 460 and 462 of the display 454.

If the comparing function of step 832 provided a NO, a comparing function in step 836 would determine whether the count in scratch pad register 45 was less than fifteen (15). Such a determination would be useful, because the point-to-point distance between corresponding points on the second and third portrait border lines on authentic U.S. two dollar and ten dollar bills provides a count in the range of fifteen through one hundred and nine (15–109). As a result, a YES at the end of the comparing function of step 836 would indicate that the insert was not an authentic U.S. two dollar or ten dollar bill; and REJECT connectives 838 and 578, respectively, of FIGS. 14 and 8 would initiate the reject routine—with consequent returning of the insert to platform 32 and re-setting of the bill-handling device.

If the comparing function of step 836 provided a NO, a comparing function in step 840 would determine whether the count in scratch pad register 42 was greater than one hundred and nine (109). Such a determination would be useful in effecting the rejection of any counterfeit bills which attempted to simulate the point-to-point distance between corresponding points on the second and third portrait border lines on an authentic twenty dollar bill. The count in scratch pad register 42, which was obtained during the scanning of such counterfeit bills, would be greater than one hundred and nine (109); and hence the comparing function of step 840 would provide a YES. Thereupon, the REJECT connectives 842 and 578, respectively, of FIGS. 14 and 8 would initiate the reject routine—with consequent returning of the insert to platform 32 and re-setting of the bill-handling device.

If the comparing function of step 840 provided a NO, a comparing function in step 844 would determine whether the count in scratch pad register 42 was greater than seventy-one (71). Such a determination would be useful, because it would indicate that the insert could be an authentic U.S. two dollar bill and is not an authentic U.S. ten dollar bill. Specifically, the scanning of many authentic U.S. two dollar bills will provide a count, which represents the point-to-point distance between corresponding points on the second and third portrait border lines, in the range of seventy-two through one hundred and nine (72–109), whereas the corresponding scanning of authentic U.S. ten dollar bills will provide a much lower count—in the range of fifteen through fifty-five (15–55). Consequently, a YES at the end of the comparing function of step 844 would indicate that the insert was not an authentic U.S. ten dollar bill and probably was an authentic U.S. two dollar bill. The program would respond to that YES to branch, via TWO connectives 846 and 848, respectively, of FIGS. 14 and 20 to step 850 of FIG. 20. A comparing function of that step would determine whether the count in scratch pad register 41 was both less than one hundred and ten (110) and greater than fifty-nine (59). Such a determination would be useful in determining whether the insert was an authentic U.S. two dollar bill or was a counterfeit bill whereon the point-to-point distance between corresponding points on the first and second portrait border lines was different from the corresponding distance on authentic U.S. two dollar bills. Specifically, the scanning of an authentic U.S. two dollar bill would provide a count in scratch pad register 41 which was in the range of sixty through one hundred and nine (60–109); and that count would represent the point-to-point distance between corresponding points on the first and second portrait border lines on that bill. If the scanning of the same lines on a counterfeit bill provided a count of one hundred and ten (110) or more, that count would be above the upper end of the range for authentic U.S. two dollar bills; and, if that scanning provided a count of fifty-eight (58) or less, that count would be below the lower end of the range for authentic U.S. two dollar bills. In either event, the insert should be rejected; and the resulting NO from the comparing function of step 850 would cause the program, via REJECT connectives 852 and 578, respectively, of FIGS. 20 and 8, to initiate the reject routine—with consequent returning of the insert to platform 32 and re-setting of the bill-handling device.

If the comparing function of step 850 provided a YES, a comparing function in step 854 would determine whether the count in scratch pad register 45 was greater than eight (8) and less than thirty-five (35). Such a determination would be useful in determining whether the insert was an authentic U.S. two dollar bill or was a counterfeit bill whereon the number of magnetic-ink lines in the green seal area differed from the corresponding number of magnetic-ink lines on authentic U.S. two dollar bills. Specifically, the number of magnetic-ink lines in the green seal area on an authentic U.S. two dollar bill is in the range of eight through thirty-five (8–35); and if an insert provided a count of thirty-five (35) or more, that count would indicate that the insert was not an authentic U.S. two dollar bill. Similarly, if an insert provided a count of seven (7) or less, that count would indicate that the insert was not an authentic U.S. two dollar bill. In either event, the insert should be rejected; and the resulting NO from the comparing function of step 854 would cause the program, via REJECT connectives 856 and 578, respectively, of FIGS. 20 and 8, to initiate the reject routine with consequent returning of the insert to platform 32 and re-setting of the bill-handling device.

If the comparing function of step 854 provided a YES, the program will execute step 858. As pointed out hereinbefore, dotted-line step 903 is not applicable to this section. During step 858, a two (2) will be supplied to scratch pad register 49 to enable the display 454 to exhibit a "2.00" during step 770. Thereafter, TX2 connectives 860 and 768, respectively, of FIGS. 20 and 17 will branch the program to step 700; and, during that step, the display 454 will be caused to exhibit "2.00". The program then will loop at next-succeeding step 772 until the insert is moved far enough inwardly of the transport 30 to permit switch 162 to re-open; and then T STOP connectives 774 and 776, respectively, of FIGS. 17 and 8 will cause steps 592, 594, START connectives 596 and 504, and steps 506, 508 and 510 of FIGS. 8 and 5 to de-energize motor 562, provide a one-hundred millisecond (100 ms) delay, initialize the Ports, set the timer interrupt address, and cause the program to loop at step 510.

If the comparing function of step 844 provided a NO, a comparing function in step 862 would determine whether the count in scratch pad register 42 was greater than fifty-five (55). Such a determination would be useful in determining whether the insert was an authentic U.S. two dollar or ten dollar bill or was a counterfeit bill; because a YES would indicate that the insert was a counterfeit bill, and would, via REJECT connectives 862 and 578, respectively, of FIGS. 14 and 8 initiate the reject routine. Specifically, the count in scratch pad register 42 would represent the point-to-point distance between corresponding points on the second and third portrait border lines of an insert which could not be an un-worn authentic U.S. two dollar bill; because the corresponding count for an un-worn authentic U.S. two dollar bill is seventy-two through one hundred and nine (72–109).

It will be noted that the comparing functions of steps 844 and 862 will permit only data from those inserts which provide a count—from the data corresponding to the distance between the second and third portrait border lines on U.S. bills—between fifty-five and seventy-one (55–71) to cause the program to execute step 866. Significantly, those steps will separate un-worn authentic U.S. two dollar bills from authentic U.S. ten dollar bills. Also, those steps will separate un-worn authentic U.S. two dollar bills from counterfeit bills which provide a count—from the data corresponding to the distance between the second and third lines on U.S. bills—of seventy-one (71) or less but more than fifty-five (55).

If the comparing function of step 862 provided a NO, a comparing function in step 866 would determine whether the count in scratch pad register 42 was greater than thirty-four (34). That count could be greater than thirty-four (34) if the insert was an un-worn authentic U.S. ten dollar bill; because the point-to-point distance between corresponding points on the second and third portrait border lines on such a bill provides a count which averages thirty-five through fifty-five (35–55). The resulting YES from the comparing function of step 866 would cause the program to branch, via TEN connectives 868 and 870, respectively, of FIGS. 14 and 21, to step 872 of FIG. 21. A comparing function during the latter step would determine whether the count in scratch pad register 41 was greater than ninety-nine (99) but less than one hundred and seventy-five (175). Such a determination would be useful because the sixty through one hundred and nine (60–109) range of point-to-point distances between corresponding portions of the first and second portrait border lines on an authentic U.S. two dollar bill and the one hundred through one hundred and seventy-five (100–175) range of point-to-point distances between corresponding portions of the first and second portrait border lines on an authentic U.S. ten dollar bill would enable the comparing function of step 872 to provide a YES. In contrast, any insert which caused a count of ninety-nine (99) or less, or a count of one hundred and seventy-five (175) or more, to be stored in scratch pad register 41 while the air gap of magnetic head 208 was sensing the area on that insert which corresponds to the portrait border area on a U.S. bill would cause the comparing function of step 872 to provide a NO. Thereupon, REJECT connectives 874 and 578, respectively, of FIGS. 21 and 8 would initiate the reject routine—with consequent returning of the insert to platform 32 and re-setting of the bill-handling device.

If the comparing function of step 872 provided a YES, a comparing function in step 876 would determine whether the count in scratch pad register 45 was greater than eight (8) but less than thirty-three (33). Such a determination would be useful because the number of magnetic-ink lines in the green seal area on an authentic U.S. ten dollar bill is in the range of eight (8) through thirty-two (8–32). If the comparing function of step 876 provided a NO, the insert would not be an authentic U.S. ten dollar bill; and thereupon, REJECT connectives 876 and 578, respectively, of FIGS. 21 and 8 would initiate the reject routine—with consequent returning of the insert to platform 32 and re-setting of the bill-handling device.

If the comparing function of step 876 did provide a YES, data would be supplied to scratch pad registers 48 and 49 which would call for the display 454 to subsequently exhibit "10.00". The TX2 connectives 882 and 768, respectively, of FIGS. 21 and 17 would cause the program to execute steps 770 and 772 of FIG. 17, steps 592 and 594 of FIG. 8, and steps 506, 508 and 510 of FIG. 5 in the same manner in which that program executed those steps when the TX2 connectives 766 and 768, respectively, of FIGS. 16 and 17 caused the program to execute those same steps. The display 454 will respond to step 770 to exhibit "10.00". As pointed out hereinbefore, the dotted-line step 903 is not applicable to this section; and hence the YES at the end of the comparing function of step 876 caused the program to execute step 880.

If the comparing function of step 866 of FIG. 14 had provided a NO, a comparing function in step 884 would determine whether the count in scratch pad register 42 was equal to the number thirty-four (34). It has been noted that some authentic U.S. two dollar bills, which have been repeatedly folded and unfolded along a line about midway between the upper and lower edges thereof, have so little magnetic ink in the second portrait border line thereof that the air gap of magnetic head 208 fails to sense that line. In such event, the arcuate magnetic-ink line which defines the left-hand edge of the portrait background will be the second magnetic-ink line in the portrait border area, and the first vertical portrait background line will be the third magnetic-ink line in the portrait border area. Because the spacing between that arcuate magnetic-ink line and that first vertical portrait background line is much smaller than the distance between the true second portrait border line and that arcuate magnetic-ink line, the corresponding count in scratch pad register 42 would be much less—ranging from fifteen through thirty-three (15–33). Somewhat similarly, it has been noted that some authentic U.S. ten dollar bills, which have been repeatedly folded and unfolded along a line about midway between the upper and lower edges thereof, have so little magnetic ink in the arcuate magnetic-ink line which defines the left-hand edge of the portrait background that the air gap of magnetic head 208 fails to sense that line. In that event, the count in scratch pad register 42 is less than the count which is stored in that scratch pad register during the scanning of an un-worn authentic U.S. ten dollar bill.

The count in scratch pad register 42 should, when the portrait border area of a well-worn authentic U.s. two dollar or ten dollar bill is being scanned, be thirty-three or less. Consequently, it would be desirable to reject any insert which, during the scanning of the portrait border area thereof, caused a count of thirty-four (34) to be stored in scratch pad register 42. Consequently, a comparing function is performed during step 884 which will provide a YES if the count in that scratch pad register is equal to the number 34. Thereupon, REJECT connectives 886 and 578, respectively, of FIGS. 14 and 8 would initiate the reject routine—with consequent returning of the insert to platform 32 and re-setting of the bill-handling device.

Figure 15:
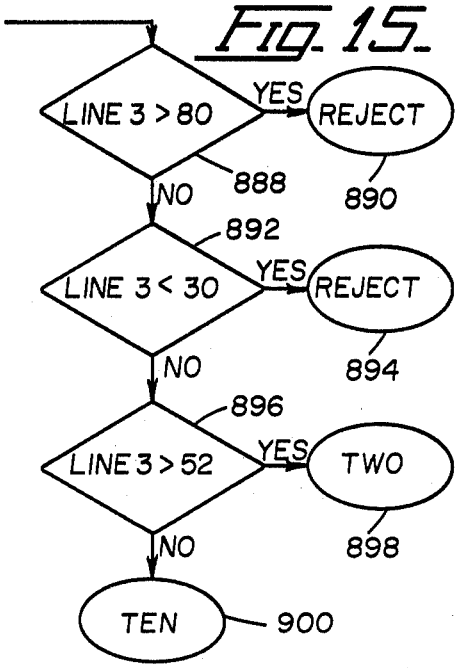
FIG. 15 is a portion of the flow chart which shows steps that help determine the authenticity and denominations of some U.S. two dollars and ten dollar bills.

If the comparing function of step 884 provided a NO, a comparing function in step 888 of FIG. 15 would determine whether the count in scratch pad register 43 was greater than eighty (80). Such a determination would be useful because the fifty-three through eighty (53–80) range of point-to-point distances between corresponding portions of the third and fourth portrait border lines on an authentic U.S. two dollar bill, as well as the thirty through fifty-two (30–52) range of point-to-point distances between corresponding portions of the third and fourth portrait border lines on an authentic U.S. ten dollar bill, would enable the comparing function of step 888 to provide a NO. Any insert which provided a count of more than eighty (80), while the air gap of magnetic head 208 was sensing the area thereon which corresponds to the areas on U.S. bills where the third and fourth portrait border lines are located, should be rejected. Thereupon, REJECT connectives 890 and 578, respectively, of FIGS. 15 and 8 would initiate the reject routine—with consequent returning of the insert to platform 32 and re-setting of the bill-handling device.

If the comparing function of step 888 had provided a NO, a comparing function in step 892 would determine whether the count in scratch pad register 43 was less than thirty (30). Because any count that was less than thirty (30) would not fall within either the fifty-three through eighty (53–80) range of point-to-point distances between corresponding portions of the third and fourth portrait border lines on an authentic U.S. two dollar bill or the thirty through fifty-two (30–52) range of such distances on an authentic U.S. ten dollar bill, any insert which provided such a count—while the air gap of magnetic head 208 was sensing the area thereon which corresponds to the areas on U.S. bills where the third and fourth portrait border lines are located—should be rejected. The YES, that would then be provided by the comparing function of step 892 would cause the REJECT connectives 894 and 578, respectively, of FIGS. 15 and 8 to initiate the reject routine—with consequent returning of the insert to platform 32 and re-setting of the bill-handling device.

If the comparing function of step 892 provided a NO, a comparing function in step 896 would determine whether the count in scratch pad register 43 was greater than fifty-two (52). Because the fifty-three through eighty (53–80) range of point-to-point distances between corresponding portions of the third and fourth portrait border lines on an authentic U.S. two dollar bill would cause the comparing function of step 896 to provide a YES, whereas the thirty through fifty-two (30–52) range of point-to-point distances between corresponding portions of the third and fourth portrait border lines on an authentic U.S. ten dollar bill would cause that comparing function to provide a NO, that step makes it possible to distinguish between, and to help identify, well-worn authentic U.S. two dollar and ten dollar bills. If the insert was a well-worn authentic U.S. two dollar bill, the YES from the comparing function of step 896 would cause the program, via TWO connectives 898 and 848, respectively, of FIGS. 15 and 20, to initiate the steps 850, 854 and 858 of FIG. 20, steps 770 and 772 of FIG. 17, steps 592 and 594 of FIG. 8, and steps 506, 508 and 510 of FIG. 5 in the same manner in which that program executed those steps when the TWO connectives 846 and 848, respectively, of FIGS. 14 and 20 caused the program to execute those same steps. The display 454 will respond to step 770 to exhibit "2.00". On the other hand, if that insert was a well-worn authentic U.S. ten dollar bill, the NO from the comparing function of step 896 would cause the program, via TEN connectives 900 and 870, respectively, of FIGS. 15 and 21 to initiate the steps 872, 876 and 880 of FIG. 10, steps 770 and 772 of FIG. 17, steps 592 and 594 of FIG. 8, and steps 506, 508 and 510 of FIG. 5 in the same manner in which that program executed those steps when the TEN connectives 868 and 870, respectively, of FIGS. 14 and 21 caused the program to execute those same steps. The display 454 will respond to step 770 to exhibit "10.00". As pointed out hereinbefore, the dotted-line step 903 is not applicable to this section; and hence the YES at the end of the comparing function of step 854 of FIG. 20 caused the program to execute step 858, and the YES at the end of the comparing function of step 876 of FIG. 21 caused the program to execute step 880.

Figure 25:
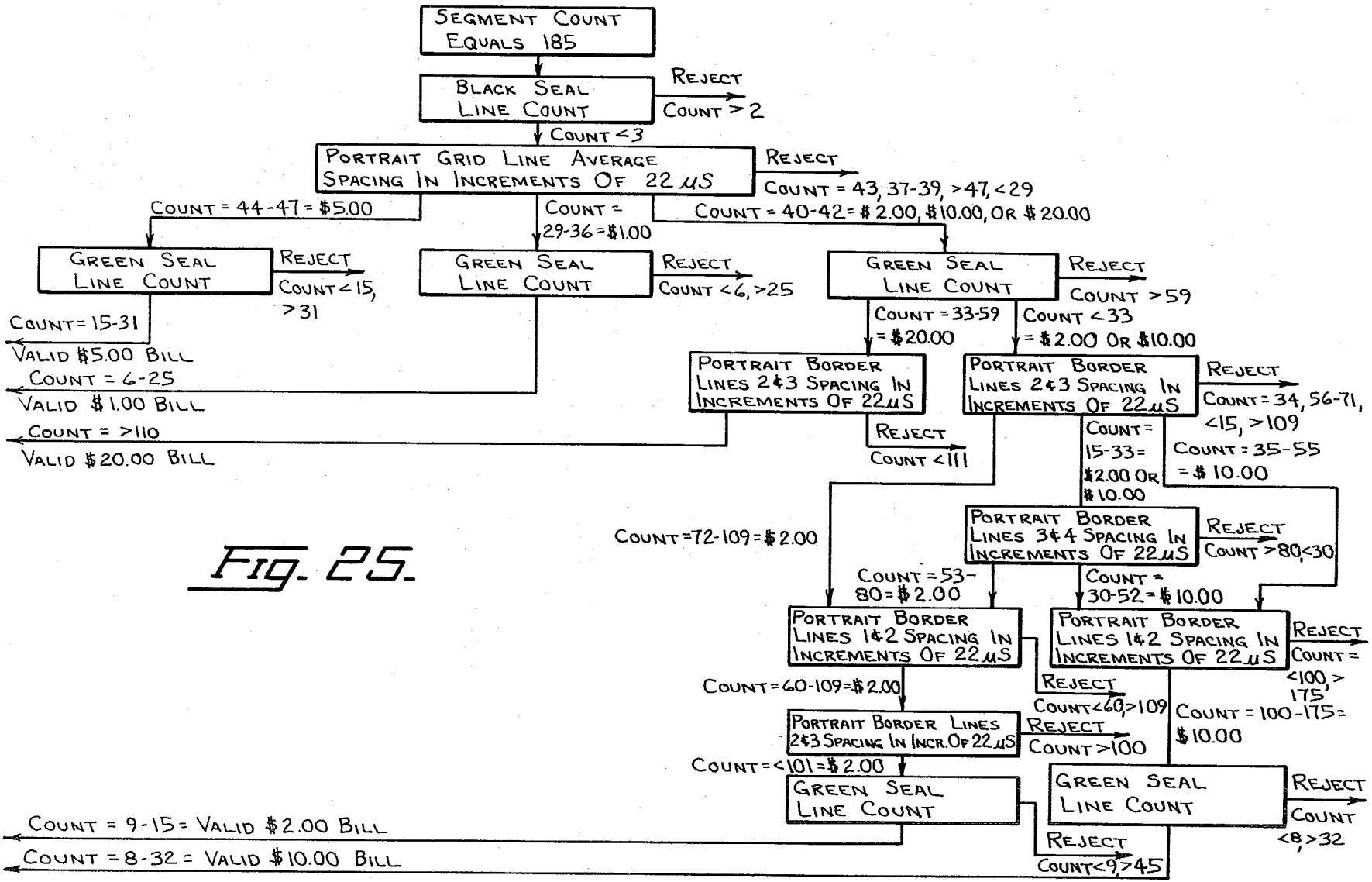
FiG. 25 is a block-type representation of the steps which are used in analyzing data that is relied upon to determine the authenticity and denomination of U.S. bills.

In the analysis of the data, that was collected and stored during the data collection routine of the program, many tests are made which distinguish between authentic U.S. bills and inserts—even though those inserts provide closely-similar data. Moreover, that analysis of data makes many tests which distinguish authentic U.S. bills of different denominations from each other—even though some of those bills provide closely-similar data. The various tests that are made on various inserts are generally indicated by FIG. 25.

The block entitled SEGMENT COUNT EQUALS 185 emphasizes the fact that two magnetic-ink lines or areas must be sensed on an insert within seven and eight-tenths milliseconds (7.8 ms). Also that block emphasizes the fact that those two magnetic-ink lines or areas must be sensed close enough to the leading edge of the insert to enable a total of one hundred and eighty-five (185) time-related segments to be scanned before the trailing edge of that insert releases the actuator 164 of switch 162.

The block entitled BLACK SEAL LINE COUNT emphasizes the fact that any insert will be rejected if, during the time the area thereon which corresponds to the black seal area on a U.S. bill is being sensed, a count that is greater than two (2) is collected and stored in scratch pad register 40. The black seal areas on authentic U.S. one dollar, two dollar, five dollar, ten dollar and twenty dollar bills are effectively devoid of magnetic ink; and hence any insert which generates less than three counts during the scanning of the black seal area thereon should not be rejected because of that count. However, photocopies of U.S. bills which are made by copying machines which use magnetic particles, and other inserts which have magnetic-ink lines or areas in the "black seal area" thereof, should, and will, be rejected.

The block entitled PORTRAIT GRID LINE AVERAGE SPACING IN INCREMENTS OF 22 μs emphasizes the fact that authentic U.S. one dollar bills can be distinguished from authentic U.S. two dollar, five dollar, ten dollar and twenty dollar bills by the average point-to-point distances between corresponding points of the vertical portrait background lines thereof. Also, that block emphasizes the fact that authentic U.S. five dollar bills can be distinguished from authentic U.S. one dollar, two dollar, ten dollar and twenty dollar bills by the average point-to-point distances between corresponding points of the vertical portrait background lines thereof. In addition, that block emphasizes the fact that authentic U.S. two dollar, ten dollar and twenty dollar bills cannot be distinguished from each other by scanning the average point-to-point distances between corresponding points of the vertical portrait background lines thereof.

The upper left-hand block entitled GREEN SEAL LINE COUNT emphasizes the fact that authentic U.S. one dollar bills can be distinguished from authentic U.S. two dollar, five dollar, ten dollar and twenty dollar bills and from counterfeit bills by the leading border test, the black seal test, the portrait background test, and the green seal test. The upper middle GREEN SEAL LINE COUNT block emphasizes the fact that authentic U.S. five dollar bills can be distinguished from authentic U.S. one dollar, two dollar, ten dollar and twenty dollar bills and from counterfeit bills by the leading border test, the black seal test, the portrait background test, and the green seal test. The upper right-hand GREEN SEAL LINE COUNT block emphasizes the fact that authentic U.S. two dollar, ten dollar and twenty dollar bills can not be distinguished from each other by the leading border test, the black seal test, the portrait background test, and the green seal test.

The upper left-hand block entitled PORTRAIT BORDER LINE 2 & 3 SPACING IN INCREMENTS OF 22 μs emphasizes the fact that authentic U.S. twenty dollar bills can be distinguished from authentic U.S. two dollar and ten dollar bills by the leading border test, the black seal test, the portrait background test, the green seal test, and a test of the second portrait border line and of the succeeding space. The upper right-hand block entitled PORTRAIT BORDER LINE 2 & 3 SPACING IN INCREMENTS OF 22 μs emphasizes the fact that un-worn authentic U.S. two dollar and ten dollar bills can be distinguished from each other by a test of the second portrait border line and of the succeeding space. However, that block emphasizes the fact that well worn authentic U.S. two dollar and ten dollar bills can not be distinguished from each other by a test of the second portrait border line and of the succeeding space.

The block entitled PORTRAIT BORDER LINE 3 & 4 SPACING IN INCREMENTS OF 22 μs emphasizes the fact that well-worn authentic U.S. two dollar and ten dollar bills can be distinguished from each other by a test of the third portrait border line and of the succeeding space.

The two blocks entitled PORTRAIT BORDER LINE 1 & 2 SPACING IN INCREMENTS OF 22 μs emphasize the fact that authentic U.S. two dollar and ten dollar bills can not be distinguished from each other by a test of the first portrait border line and of the succeeding space. However, those two blocks plus the lower block entitled PORTRAIT BORDER LINE 2 & 3 SPACING IN INCREMENTS OF 22 μs and the two lower GREEN SEAL LINE COUNT blocks emphasize the fact that even well-worn authentic U.S. two dollar and ten dollar bills can be distinguished from each other by the leading border test, the black seal test, the portrait background test, repeated green seal tests, the test of the first portrait border line and of the succeeding space, repeated tests of the second portrait border line and of the succeeding space, and a test of the third portrait border line and of the succeeding space. These various tests make the acceptance rate of authentic U.S. one dollar, two dollar, five dollar, ten dollar and twenty dollar bills unusually high, the ability to distinguish between those bills unusually high, and the rejection rate of counterfeit bills unusually high.

Counterfeits Will Be Rejected

The bill-handling device provided by the present invention will reject all known kinds of counterfeits of U.S. one dollar, two dollar, five dollar, ten dollar and twenty dollar bills. One kind of counterfeit bill which could be accepted by many prior bill-handling devices, but which will be rejected by the bill-handling device of the present invention, is a photocopy of an authentic U.S. one dollar, two dollar, five dollar, ten dollar or twenty dollar bill that is made by a copying machine which uses magnetic particles. Such a counterfeit bill would cause the magnetic head 208 to develop signals in the leading border, in the portrait border area and in the portrait background area that would closely simulate the signals which that magnetic head would produce when scanning the corresponding portion of an authentic U.S. bill. However, the large number of signals which the magnetic head would develop as it scanned the black seal area of that counterfeit bill, and the larger number of signals which that magnetic head would develop as it subsequently scanned the green seal area of that counterfeit bill, would enable the comparing function of step 752 or the comparing function of step 812 of FIG. 14 to initiate the rejection of that counterfeit bill.

If the person who made such a counterfeit bill were to cut the black seal area out of that bill, were to cover that black seal area with a cloth or plastic tape, or were to erase or scrape away the magnetic particles in that area, the comparing function of step 752 of FIG. 14 might not be able to effect the rejection of that counterfeit bill. However, even if that person were able to remove, or reduce the effect of, the magnetic particles in the normally-black seal, that person would find it very difficult, and perhaps impossible, to remove the magnetic particles which define the normally-green seal and yet leave enough of the lines in the adjacent indiciadefining numerals to avoid the rejection of the counterfeit bill. Specifically, that person would have to remove enough of the magnetic ink from the normally-green seal to keep the total number in scratch pad register 45 from exceeding the number fifty-nine (59) and yet would have to leave sufficient magnetic particles to enable the magnetic-particle lines in the area adjacent that seal to produce a count of at least five (5).

All of this means that it would be extremely difficult, and perhaps impossible, for a person to make a magnetic-particle photocopy of a U.S. bill and then alter that copy so it would be accepted by the bill-handling device of the present invention. This would be the case even if that person knew the method of testing which is utilized by that bill-handling device and also knew the areas where the authenticity-determining and denomination-determining data are sensed. However, because the bill-handling device moves each insert wholly within the transport 30 before initiating the authenticity-determining and denomination-determining routine of FIGS. 14 and 15, it would be difficult for a person to determine what areas of the insert are being sensed—much less determine which areas of the insert produce data that is collected and stored for subsequent use in determining whether the insert is an authentic or counterfeit bill.

Alternate Embodiments Of Invention

FIG. 22

Figure 22:
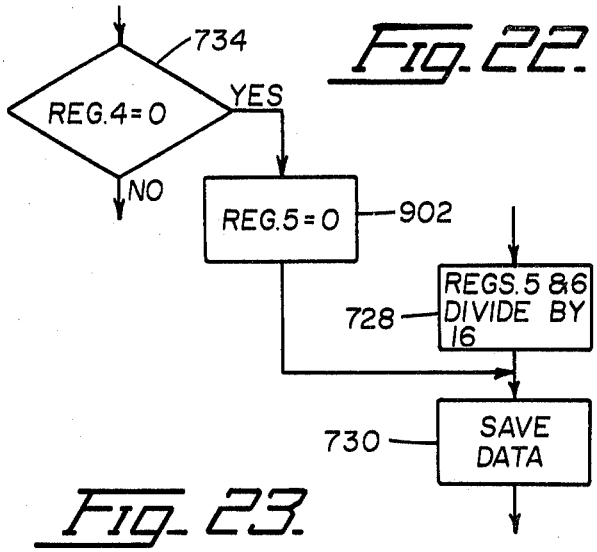
FIG. 22 shows a modification which could be made in the portion of the flow chart shown by FIG. 12.

The routine which is represented by FIG. 12 causes a YES, at the conclusion of the comparing function of step 734, to effect prompt rejection of the insert—as by causing REJECT connectives 738 and 578, respectively, of FIGS. 12 and 8 to initiate the reject routine. If desired, the initiation of the reject routine could be delayed until the routine represented by FIG. 14 was executed. Specifically, as shown by FIG. 22, a YES at the conclusion of the comparing function of step 734 of FIG. 12 could cause zero (0) to be loaded into scratch pad register 5—as in step 902. At the conclusion of that loading function, the data in that scratch pad register would be transferred to scratch pad register 44 during step 730, and the ISAR would be incremented to address further data to scratch pad register 45. Thereafter, the program would execute step 692 of FIG. 12, steps 658, 634, 636 and 638 of FIG. 10, and step 536 of FIG. 5, and would then re-initiate the data collection routine of FIG. 5. The execution of steps 730, 692, 658, 634, 636, 638 and 536, and the re-initiation of the data collection routine of FIG. 5, would be performed in the manner described hereinbefore. Also, the air gap of magnetic head 208 would scan the time-related segments on the insert, and the program would repeatedly execute the interrupt service routine of FIG. 7 until a YES at the conclusion of the comparing function of step 626 caused the routine of FIG. 13 to initiate the routine of FIG. 14. During step 786 of the latter routine, the count in scratch pad register 44 would be the zero (0) that was loaded into scratch pad register 5 during step 902 of FIG. 22 and that was transferred to scratch pad register 44 during step 730 of FIG. 12. That zero (0) would cause the comparing function of step 786 of FIG. 14 to provide a YES—with consequent initiation of the reject routine via REJECT connectives 788 and 578, respectively, of FIGS. 14 and 8. Consequently, in the routine of FIG. 22, as well as in the routine of FIG. 12, the development of a YES by the comparing function of step 734 would effect the rejection of the insert.

One advantage of the routine of FIG. 22, over the routine of FIG. 12, is that an insert is moved all of the way into the transport 30 before it is rejected. Such an arrangement will make it very difficult, and perhaps impossible, for a person who inserts a counterfeit bill—that will cause the comparing function of step 734 to provide a YES—to know which scanned area of the counterfeit bill caused the bill-handling device to reject the counterfeit bill. Consequently, it should be more difficult for such a person to modify, adapt, change or otherwise alter the counterfeit bill to try to make it pass some of the tests provided by the bill-handling device than it would be if (a) the rejection of that counterfeit bill occurred before that counterfeit bill was drawn all the way into transport 30 and (b) successive rejections of that counterfeit bill showed that it was being rejected at the same position within that transport.

FIG. 23

Figure 23:
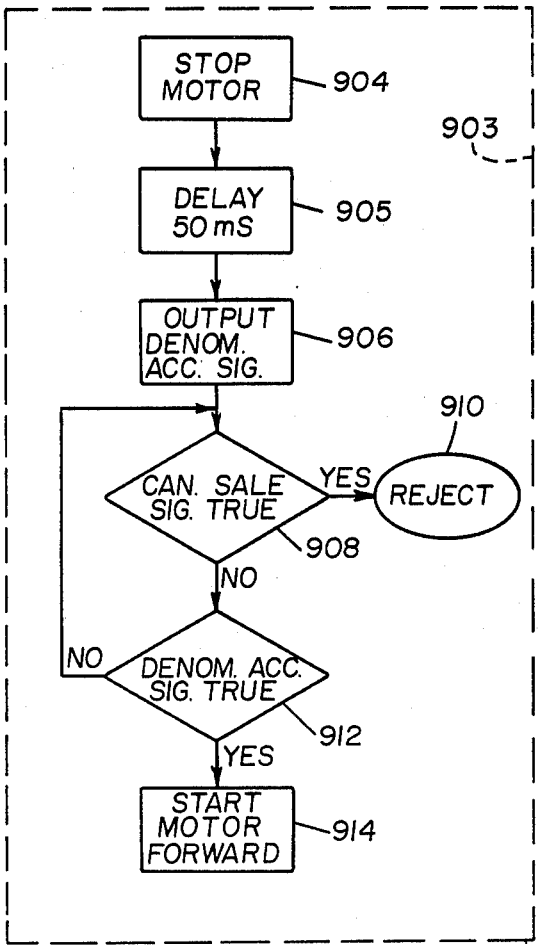
FIG. 23 shows the steps of a routine which could be added to the flow chart to enable the bill-handling device to supply signals to a vending machine.

The flow chart of FIGS. 5–21 represents the sensing of inserts and the consequent displaying of indicia that will indicate whether the inserts are counterfeits or are authentic U.S. bills and also will indicate the denomination of each inserted authentic U.S. one dollar, two dollar, five dollar, ten dollar and twenty dollar bill. The bill-handling device of the present invention is not, however, limited to the mere displaying of indicia; and it is a simple matter to add to the flow chart of FIGS. 5–21 a routine which will make that bill-handling device usable with a vending machine which can vend products and which can accept credits established by the insertion of one dollar, two dollar, five dollar, ten dollar or twenty dollar bills. If a vending machine was unable to respond to credits established by the insertion of a twenty dollar bill, the bill-handling device of the present invention could easily have the program thereof revised to make the number that would be used in the comparing function of step 816 of FIG. 14 so much higher than one hundred and ten (110) that all twenty dollar bills would be rejected. Similarly, if a vending machine was unable to respond to credits established by the insertion of a two dollar bill or a five dollar bill or a ten dollar bill, the bill-handling device of the present invention could easily have the program thereof revised to make it impossible for one or more of the tests, used to establish the authenticity of the appropriate one of those bills, to be met. As a result, the bill-handling device of the present invention could easily be adapted for use with vending machines that were able to respond to credits established by the insertion of one or more U.S. bills of one or more denominations in the group consisting of one dollar, two dollar, five dollar, ten dollar and twenty dollar bills.

Where the bill-handling device of the present invention is used with a vending machine of the "post select" type, that bill-handling device should be able to stop the motor 562 to hold a U.S. bill in "escrow" within the transport 30, to send a signal to the vending machine which would represent a credit equal to the denomination of the bill held in "escrow", to wait until the customer had pressed a selection switch and a comparator in the control equipment for the vending machine had determined that the credit at least equalled the price of the selected product, to keep the motor 562 de-energized until the vending machine supplied a signal which would indicate that a vending cycle had been initiated, and then re-start the motor 562 to complete the acceptance of the "escrowed" bill and the re-setting of the bill-handling device. FIG. 23 shows a routine which could be used in each of the dotted-line blocks 903 of FIGS. 16 and 18–21 to enable the bill-handling device of the present invention to be used with "post select" vending machines. The numeral 904 denotes a step wherein the motor 562 would be de-energized in response to a YES from the comparing function of step 762 of FIG. 16, in response to a NO from the comparing function of step 800 of FIG. 18, in response to a YES from the comparing function of step 816 of FIG. 14 via the TWENTY connectives 818 and 820, respectively, of FIGS. 14 and 19, in response to a YES from the comparing function of step 854 of FIG. 20, or in response to a YES from the comparing function of step 876 of FIG. 21. After motor 562 was de-energized, a fifty millisecond (50 ms) delay would be provided during step 905 in the same way in which a fifty millisecond (50 ms) delay is provided during step 486 of FIG. 5. During step 906, a "denomination accept" signal will be supplied to the vending machine which would indicate that an authentic U.S. bill of a specified denomination had been introduced into transport 30 and was being held in "escrow" within that transport. During step 908, a determination would be made of whether the vending machine had supplied a "cancel sale" signal—due to the pressing of the "cancel sale" switch of the vending machine by the patron, or due to a determination by a comparator in the control equipment for the vending machine that the difference between the value of the "escrowed" bill and the lowest-price product exceeded the amount of money that was available to make change. If the determination of step 908 provided a YES, the program would, via REJECT connectives 910 and 578, respectively, of FIGS. 23 and 8 initiate the reject routine—with consequent return of the bill to platform 32 and re-setting of the bill-handling device. However, if the determination of step 908 provided a NO, a determination would be made during step 912 of whether the vending machine had received and had responded to the "denomination accept" signal provided during step 906. If the determination of step 912 provided a NO—thereby indicating that the patron had not made a selection, the program would loop at steps 908 and 910 until a comparing function during step 908 indicated receipt of a "cancel sale" signal, or a comparing function during step 912 determined that the vending machine had received and had responded to the "denomination accept" signal that was supplied during step 906. In the former instance, the REJECT connectives 910 and 578, respectively, of FIGS. 23 and 8 would initiate the reject routine; whereas in the latter instance, the motor 562 would be re-started in the "forward" direction during step 914—with consequent initiation of step 764 of FIG. 16, of step 802 of FIG. 18, of step 822 of FIG. 19, of step 858 of FIG. 20, or of step 880 of FIG. 21. It thus can be seen that by using the routine of FIG. 23 in each of the dotted-line steps 903 of FIGS. 16 and 18–21, the bill-handling device of the present invention could be used with a vending machine of the "post select" type to stop the motor 562 to hold a U.S. bill in "escrow" within the transport 30, to send a "denomination accept" signal to the vending machine, to return the "escrowed" bill to the patron in the event a "cancel sale" signal is developed, or to effect the acceptance of the "escrowed" bill and the initiation of the vending of the desired product if no "cancel sale" signal is developed. In the event the "escrowed" bill is returned to the patron, the "0.00" will appear on seven-segment units 458, 460 and 462 of display 454; but, in the event that bill is accepted, the denomination of that bill will appear on the appropriate seven-segment units of that display.

The bill-handling device of the present invention also could be used with vending machines of the "pre-select" type. All that would be needed would be to use a step, like step 906 of FIG. 23 in the dotted-line steps 903 of FIGS. 16 and 18–21. That step would respond to a YES from the comparing function of step 762 of FIG. 16, a NO from the comparing function of step 800 of FIG. 18, a YES from the comparing function of step 816 of FIG. 14 via the TWENTY connectives 818 and 820, respectively, of FIGS. 14 and 19, a YES from the comparing function of step 854 of FIG. 20, or a YES from the comparing function of step 876 of FIG. 21 to effect the initiation of step 764 of FIG. 16, of step 802 of FIG. 18, of step 822 of FIG. 19, of step 858 of FIG. 20, or of step 880 of FIG. 21. It thus can be seen that by using a step, like step 906 of FIG. 23, in each of the dotted-line steps 903 of FIGS. 16 and 18–21, the bill-handling device of the present invention could be used with pre-select vending machines. The value of the inserted bill would appear on the appropriate seven-segment units of display 454.

Where the routine of FIG. 23 is used in the dotted-line steps 903 of FIGS. 16 and 18–21, the initialization of ports—that is provided during step 506 of FIG. 5 and that is described hereinbefore in the TURN ON section—must be augmented. Specifically, the initialization of ports during step 506 must provide the following values.

| PORT | PIN | FUNCTION | LOGIC VALUE |
|---|---|---|---|
| 0 | 3 | $1 "denomination accept signal" from micro-processor | 0 |
| 0 | 4 | $2 "denomination accept signal" from microprocessor | 0 |
| 0 | 5 | $5 "denomination accept signal" from microprocessor | 0 |
| 0 | 6 | $10 "denomination accept signal" from microprocessor | 0 |
| 0 | 7 | $20 "denomination accept signal" from microprocessor | 0 |
| 1 | 0 | "cancel sale" signal | 0 |
| 1 | 1 | "denomination accept" signal from vending machine | 0 |

FIG. 24

Figure 24:
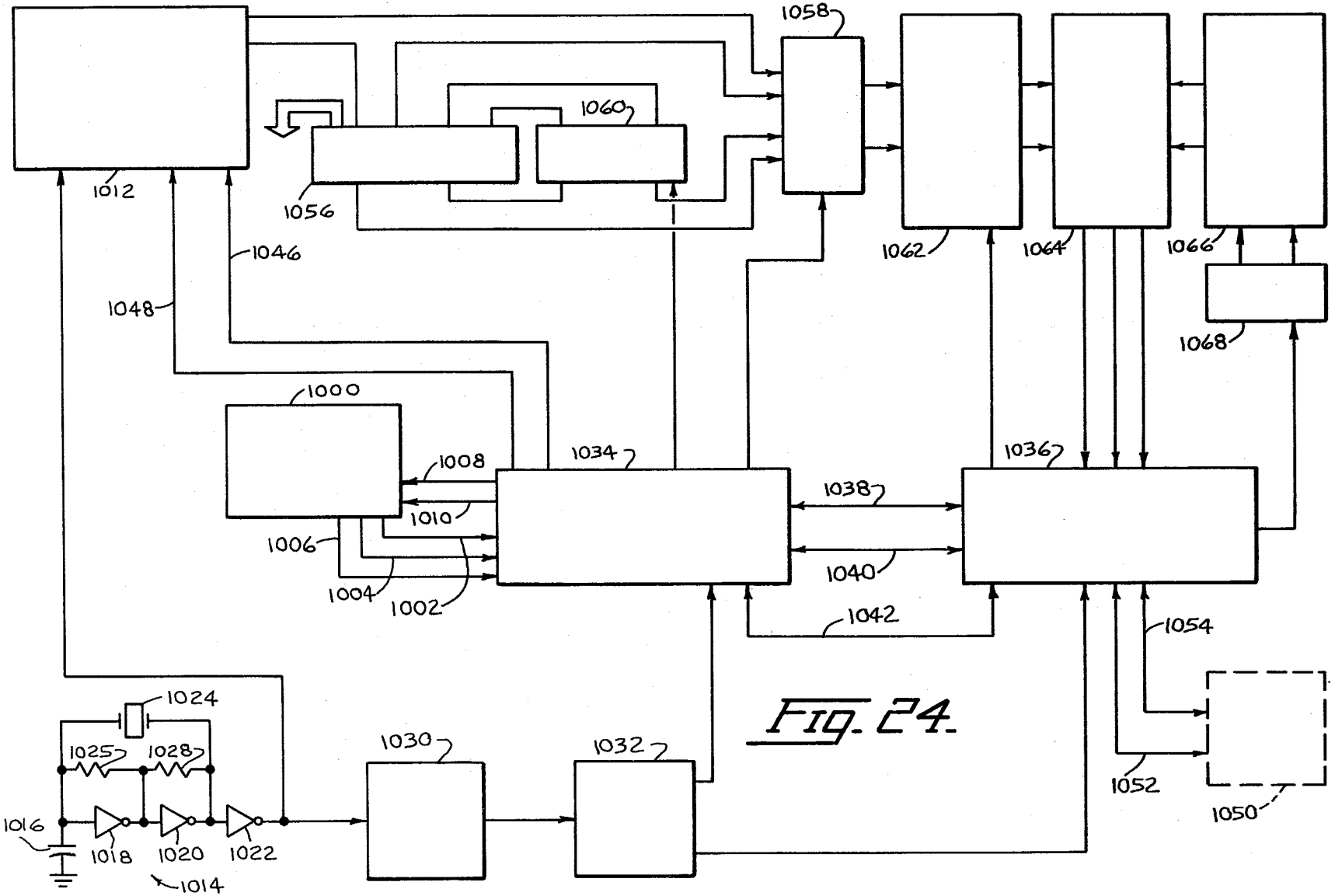
FIG. 24 is a block diagram of a hard-wired bill-handling device which is the equivalent of the bill-handling device shown by the block diagram of FIG. 4.

The bill-handling device of FIGS. 1–23 is preferred because of its low cost, compact size, ease of manufacture, and minimum maintenance. However, if desired, a discrete logic version of that bill-handling device could be used; and one such discrete logic version is shown by FIG. 24. The block 1000 generally represents a transport that preferably will be identical to the transport 30; and the conductors 1002, 1004 and 1006 are identical in purpose and function to the conductors of FIG. 4 which extend, respectively, between switch 146 and pin 4 of Port 1, between switch 156 and pin 6 of the port, and between switch 162 and pin 5 of that port. Conductor 1008 is identical in purpose and function to the conductor which connects the base of resistor 344 to pin 7 of Port 5; and conductor 1010 is identical in purpose and function to the conductor which connects the base of resistor 450 to pin 6 of that port. The magnetic head 208, the amplifier combination and low pass filter 420, the level detector 422, the Schmitt trigger 424, and the monostable multivibrator 426 of FIG. 4 would be used to supply the "head signals" to the left-hand input of a counter 1012 of FIG. 24. Although various counters could be used as the counter 1012, two 7497 4-bit Binary Counters plus two 7402 Quad 2-input NOR gates would be useful. An oscillator, which provides a twenty-two microsecond (22 μs) output, is generally denoted by the numeral 1014; and it consists of a twenty-seven picofarad (27 pf) capacitor 1016, two 7404 inverters 1018 and 1020, a crystal 1024, and two four hundred and seventy (470) ohm resistors 1025 and 1028. The oscillator output is inverted by a 7404 inverter 1022 and is applied to the lower left-hand input of counter 1012. That inverted output also is applied to a divide-by-hundred 1-74490 Dual Decade Counter 1030 to provide a two and two-tenths millisecond (2.2 ms) clock. A clock divider 1032, which includes three 7493 binary counters receives that two and two-tenths millisecond (2.2 ms) clock; and the outputs of that clock divider are applied to inputs of MM1-PAL 10H8 Dual Octal 10 Input And-/Or Gate Arrays 1034 and 1036. Interconnections 1038, 1040 and 1042, between the Gate Arrays 1034 and 1036, are provided in standard and usual manner. A re-set conductor 1046 and a Select Clock Input conductor 1048 extend from Gate Array 1034 to counter 1012.

The numeral 1050 denotes an interface which is connected to Gate Array 1036 and which is connectable to a vending machine that would be able to respond to credits corresponding to the insertion of one dollar, two dollar, five dollar, ten dollar or twenty dollar bills. Conductors 1052 and 1054 interconnect that Interface and Gate Array 1036.

Counter 1012 counts the inverted twenty-two microsecond (22 μs) output of oscillator 1014; and it responds to logic transitions in the head signals to re-set itself. As a result, that counter effectively times the intervals between logic level changes in the head signals.

The output of counter 1012 is applied to the A input of a 12-bit Adder 1056 which consists of three 7483 4-bit Adders. That output also is applied to the A input of Multiplexer 1058 which consists of two 74157 Multiplexers. An output of the 12-bit Adder 1056 is applied to the B input of Multiplexer 1058. A further output of the 12-bit Adder 1056 is applied to a 12-bit Latch 1060 which consists of two 74LS374 latches. The output of that 12-bit Latch is connected to the B input of the 12-bit Adder 1056 and of the Multiplexer 1058. The four most significant bits of the A input of 12-bit Adder 1056 are grounded. The eight most significant bits of the 12-bit Adder 1056 are applied to the B input of the Multiplexer 1058. The output of that Multiplexer is applied to the data input of an 8×8 Register File 1062 which consists of four 74LS670 4×4 Register Files. The output of Register File 1062 is applied to the A input of a comparator 1064 which consists of three 7485 4-bit Magnitude Comparators. The B input of that comparator receives signals from a ROM 1066 which consists of one or more MMI 6330 ROMs. An Address Counter 1068, which consists of two 7497 Binary Counters, is connected to the ROM 1066 to drive the addresses of that ROM. That Address Counter receives a signal from the Gate Array 1036.

The address and read-write functions of the Register File 1062 are controlled by Gate Array 1036. The output of the Comparator 1064 is connected to Gate Array 1036 which provides "equal to" or "less than" outputs. Control signals from Gate Array 1034 control (a) the 12-bit Latch 1060, (b) the Multiplexer 1058, and (c) the Reset and Select count functions of counter 1012. In addition, Gate Array 1034 provides a re-set function for Clock Divider 1032.

Figure 4:
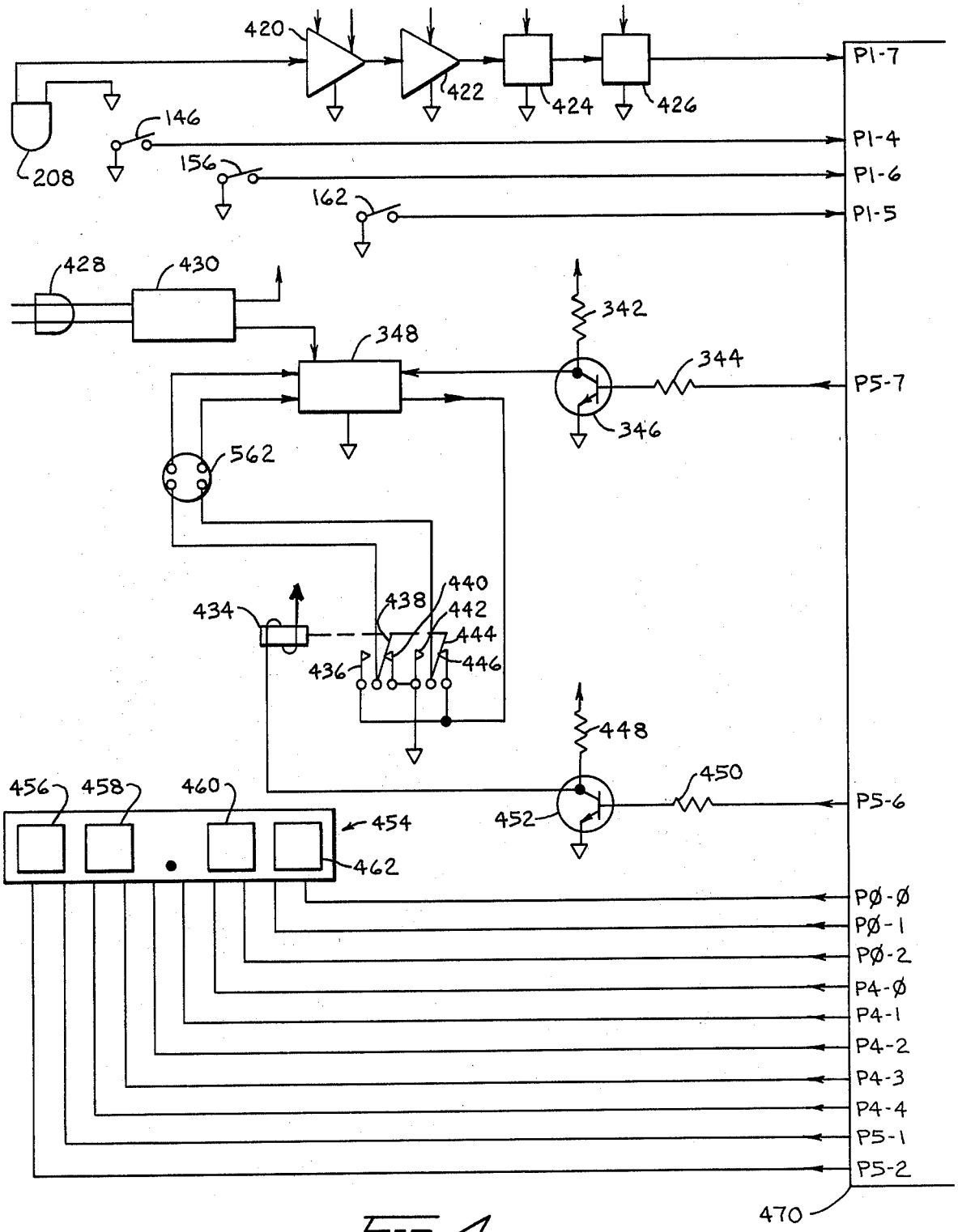
FIG. 4 is a block diagram of the electrical circuit for one embodiment of bill-handling device that is provided by the present invention.

The discrete logic version of the bill-handling device of FIGS. 1–23 will receive signals that will be identical to the signals which are received by pin 7 of Port 1 of microprocessor 470 of FIG. 4. That discrete logic version will supply denomination-indicating signals to a display, not shown, which is identical to the display 454 of FIG. 4. Also, that discrete logic version will supply authenticity-indicating as well as denomination-indicating signals, to the vending machine, via Interface 1050, which will be identical to the "denomination accept" signals provided during step 906 of FIG. 23.

Other Alternate Embodiments

Although the level detector 422 of FIG. 4 is useful in determining which signals, that it receives from the combination-amplifier and low pass filter 420, should be supplied to Schmitt trigger 424, the replacement of that level detector by a peak detector will increase the effectiveness of the bill-handling device. Instead of sensing portions of leading-edge signals, which may be essentially vertical or which may have applicable slopes—as determined by the age and the usage of the inserted bill, as a level detector must do, a peak detector would sense the peaks of the head signals from the combination amplifier and low pass filter 420. The point to point distance between the peaks of succeeding signals is far less subject to variation due to the slopes of the leading edges of those signals than is the point to point distance between the leading edges of those signals. Further, the point to point distance between the peaks of succeeding signals is far less subject to variation due to the amplitudes of those signals than is the point to point distance between the leading edges of those signals. In addition, a peak detector is far less likely to "miss" a low amplitude signal than is a level detector—whose threshold level could well be above the maximum level of some signals obtained from authentic, but old and well worn, U.S. bills.

The ink that is used to engrave the portrait, the portrait background, and other areas on the black-ink faces of U.S. bills is well suited for engraving purposes, but it does not constitute a desirable medium for the affixing of magnetic particles to a sheet of paper. The magnetic particles in that ink are not the types of particles which are used in making magnetic tapes or discs, and they are harder to sense than are the particles which are used on those tapes and discs. That ink provides random and undesirably-variable concentrations of magnetic particles at different points along lines of constant width, it permits the wearing away of significant proportions of those magnetic particles during circulation of the bills, and it provides irregular, rather than sharp and precise, edges for the lines. Also, the engraving of U.S. bills is, and for many years has been, directed to making those bills visually recognizable, and some of the engraving practices make precise magnetic recognition of portions of those bills difficult. As a result, the sensing of the point to point distance between the leading edges of signals obtained by sensing the magnetic-ink lines on U.S. bills is not truly satisfactory. By replacing the level detector 422 of FIG. 4 with a peak detector, it is possible to make the counts, on which the bill-handling device of the present invention relies, more accurate, more predictable, and more attainable. Consequently, in the preferred embodiment of the present invention, the numeral 422 in FIG. 4 will denote a peak detector. That peak detector preferably will be a part of a MOTOROLA MC3470 integrated circuit that will be used to replace all of the combination amplifier and low pass filter 420, level detector 422, Schmitt trigger 424 and monostable multivibrator 426.

The bill-handling device that is provided by the present invention provides unusually-precise determinations of authenticity and denomination of U.S. one dollar, two dollar, five dollar, ten dollar and twenty dollar bills. Also, that device provides an unusually high degree of rejection of counterfeits of all kinds. However, when a low cost gear train, low cost pulleys, low cost shafts, and low cost drive belts are used to move inserted bills through the transport 30, the tolerances and lack of concentricality in that gear train, in those pulleys, and in those shafts cause the movement of inserted bills past the air gap of magnetic head 208 to occur at non-uniform rates. Specifically where such a gear train, pulleys, shafts and belts are used, it is possible to have appreciable variations in the speeds of the inserted bill occur. Those variations are cyclic in nature, because they are generated by rotative components; and hence they provide recurrent increases and decreases in the speeds of the bills as those bills are moved past the magnetic head 208. Those variations in bill speed necessarily cause the data, which is collected during those variations, to depart from the norm which is established on the basis of a precisely uniform bill speed.

An alternative to the use of a higher-priced gear train, of higher-priced shafts, of higher-priced pulleys, and of higher-priced belts in the collecting and storing of data that is obtained by scanning a relatively-large number of lines, and then subsequently averaging that data. Such a procedure is followed in the routine of FIG. 12; and that procedure has minimized the effect which variations in bill speed have had on the tests of the point-to-point spacings of lines in the portrait backgrounds of bills.

It would be possible to minimize the effects which variations in bill speed have on other tests that are made on inserted bills; and one test where that minimization would be particularly desirable is the test of the point-to-point spacing of the portrait border lines. That minimization could be effected by utilizing the data, which is subsequently obtained during the sensing of the sixteen (16) lines in the portrait background, to determine where the speed variations occur, and then using that determination to modify the data which was obtained during the sensing of the portrait border lines. More specifically, because the variations in bill speed tend to be sinusoidal and to occur at predictable frequencies, it is possible, by sensing the point-to-point spacing of a few of the sixteen (16) portrait background lines, to determine the point on the sinusoid when the air gap of magnetic head 208 sensed the portrait border lines. The precentage of change, which is noted at that point on the sinusoid can be determined, and then can be used to adjust the measurement of the point-to-point spacing of the portrait border lines, and thereby effectively eliminate any variation in spacing sensing which was due to variations in bill speed. The overall result will be an increase in the statistical accuracy of the comparisons which are made, and which are relied upon, to differentiate between authentic two dollar bills and ten dollar bills.

Whereas the drawing and accompanying description have shown and described one embodiment of the present invention, it should be apparent to those skilled in the art that various changes may be made in the form of the invention without affecting the scope thereof.

What we claim is:

1. A bill-handling device that comprises a sensor which can respond to relative movement between itself and a line or area on an object to provide a first signal and subsequently provide a second and oppositely-directed signal, motion-providing means to provide relative movement between said sensor and said object, said sensor responding to relative movement between itself and a line or area on said object, which moves said line or area on said object into register with it, to provide said first signal and thereafter responding to relative movement between itself and said line or area on said object, which moves said line or area on said object out of register with it, to provide said second and oppositely-directed signal, and means to indicate the detection of said line or area on said object if said first signal and said second and oppositely-directed signal are produced in a predetermined sequence and are produced within a predetermined short period of time.

2. A bill-handling device as claimed in claim 1 wherein said sensor responds to relative movement between itself and a further line or area on said object to provide a further signal and then a further oppositely-directed signal, said indicating means indicating the detection of said further line or area on said object if said further signal and said further oppositely-directed signal are produced within said predetermined short period of time or within an immediately-succeeding further predetermined short period of time.

3. A bill-handling device that comprises a sensor, motion-producing means to provide relative movement between said sensor and an object, said sensor being adapted, during said relative movement between said sensor and said object to develop bill-distinguishing signals, a memory in which bill-distinguishing data is stored that corresponds to bill-distinguishing signals developed by said sensor during a predetermined amount of said relative movement, a timer that subdivides said predetermined amount of said relative movement into a predetermined number of time-related segments, collection and storage means that responds to bill-distinguishing signals from said sensor to collect bill-distinguishing data and to effect the storing of said bill-distinguishing data in a memory, testing means to provide an initial test of bill-distinguishing data corresponding to markings in a predetermined area on said object and to prevent the initiation of said timer until after said initial test indicates the presence of said markings on said object, whereby said timer will not develop said time-related segments unless and until said markings on said object are present.

4. A bill-handling device as claimed in claim 3 wherein said collection and storage means is rendered inactive during predetermined ones of said time-related segments but is rendered active during other time-related segments, whereby storage capacity is not needed for the data which is obtained during all of said time-related segments.

5. A bill-handling device that comprises a magnetic head, motion-producing means to provide relative movement between said magnetic head and an object, said magnetic head responding to relative movement between itself and magnetic lines or areas on said object to provide bill-distinguishing signals, said motion-producing means providing relative movement between said magnetic head and said object along a predetermined scan path on said object, said scan path intersecting some lines or areas on said object which would be magnetic if said object was an authentic bill and passing across areas which would be devoid of magnetic lines or areas if said object was an authentic bill and also passing across an area which would have both magnetic and non-magnetic lines or areas therein if said object was an authentic bill, means to indicate the authenticity of said object if predetermined bill-distinguishing signals are obtained during the sensing of said some lines or areas, and if essentially no bill-distinguishing signals are obtained during the sensing of said areas which would be devoid of magnetic lines or areas if said object was an authentic bill and if the number of bill-distinguishing signals obtained during the sensing of said area which would have both magnetic and non-magnetic lines or areas thereon if said object was an authentic bill do not exceed a predetermined number, said authenticity-indicating means including a memory in which said predetermined number is stored and also including means to count the number of bill-distinguishing signals obtained, during the sensing of said area which would have both magnetic and non-magnetic lines or areas thereon if said object was an authentic bill, and to compare the counted number with said predetermined number.

6. A bill-handling device as claimed in claim 5 wherein said authenticity-indicating means will not indicate that an object is authentic if the bill-distinguishing signals which are obtained during the sensing of said some lines or areas differs from said predetermined bill-distinguishing signals.

7. A bill-handling device as claimed in claim 5 wherein said authenticity-indicating means will not indicate that an object is authentic if signals are obtained during the sensing of said areas which would be devoid of magnetic lines or areas if said object was an authentic bill.

8. A bill-handling device as claimed in claim 5 wherein said authenticity-indicating means will not indicate that an object is authentic if too many signals were obtained during the sensing of said area which would have both magnetic and non-magnetic lines or areas if said object was an authentic bill.

9. A bill-handling device that comprises a magnetic head, motion-producing means to provide relative movement between said magnetic head and an object, said magnetic head responding to relative movement between itself and magnetic lines or areas on said object to provide signals, said motion-producing means providing relative movement between said magnetic head and said object along a predetermined scan path on said object, said scan path intersecting an area which would have both magnetic and non-magnetic lines or areas thereon if said object was an authentic bill, and means to indicate the authenticity of said object if the number of signals obtained during the sensing of said area, which would have both magnetic and non-magnetic lines or areas thereon if said object was an authentic bill, do not exceed a predetermined number, said authenticity-indicating means including a memory in which said predetermined number is stored and also including means to count the number of signals obtained, during the sensing of said area which would have both magnetic and non-magnetic lines or areas thereon if said object was an authentic bill, and to compare the counted number with said predetermined number.

10. A bill-handling device as claimed in claim 9 wherein said area is the area on an authentic bill that bears the green seal and the black denomination-indicating numerals.

11. A bill-detecting device which comprises a sensor, motion-producing means to provide relative movement between an object and said sensor, said motion-producing means causing said relative movement between said sensor and said object to be along a predetermined scan path on said object, said sensor checking a number of points on said object along said scan path and developing countable numbers of bill-distinguishing signals during the checking of each of said points, a memory wherein numbers corresponding to the countable numbers of said bill-distinguishing signals at each of said points are stored, authenticity-determining means which responds to said numbers in said memory to determine whether said countable numbers indicate that said object is an authentic bill, said motion-producing means being adapted to provide reverse relative movement between said sensor and said object, and said authenticity-determining means causing said motion-producing means to provide said reverse relative movement in the event a comparison between said stored numbers and said countable numbers indicates that said object is not an authentic bill, said authenticity-determining means not causing said motion-producing means to provide said reverse relative movement prior to a predetermined position on said scan path.

12. A bill-detecting device as claimed in claim 11 wherein said predetermined position corresponds to the location between the green seal and the trailing portion of the border on an authentic bill.

13. A bill-detecting device as claimed in claim 11 wherein said motion-producing means moves said object within a housing in which said sensor is mounted, and wherein said sensor is located far enough inwardly of said housing so all portions of said object must move wholly within said housing prior to the time said position on said scan path moves into register with said sensor, whereby the position of said bill at the time said authenticity-determining means causes said motion-producing means to provide reverse relative movement between said object and said sensor is not visible to customers of said bill-detecting device.

14. A bill-detecting device which comprises a sensor, motion-producing means which provides relative movement between said sensor and an object, said motion-producing means causing said relative movement between said sensor and said object to be along a predetermined scan path, said scan path crossing the leading portion of the border and the black seal area and the leading portion of the portrait border and the leading portion of the portrait background and the portrait and the trailing portion of the portrait background and the trailing portion of the portrait border and the green seal if said object is a properly-oriented authentic bill, said sensor sensing all of said areas and producing predetermined numbers of bill-distinguishing signals in predetermined ones of said areas if said object is a properly-oriented authentic bill of a predetermined denomination, a memory in which predetermined numbers that correspond to said predetermined numbers of bill-distinguishing signals that are developed by said sensor during said relative movement between said sensor and a properly-oriented authentic bill of said predetermined denomination are stored, and control means to compare those portions of said bill-distinguishing signals which were obtained during the sensing of said green seal area with a number that is stored in said memory and that corresponds to said green seal area.

15. A bill-detecting device as claimed in claim 14 wherein said control means also compares those portions of said bill-distinguishing signals which were obtained during the sensing of said leading portion of said portrait background with a number that is stored in said memory and that corresponds to said leading portion of said portrait background.

16. A bill-detecting device as claimed in claim 14 wherein said control means also compares those portions of said bill-distinguishing signals which were obtained during the sensing of said leading portion of said portrait border with a number that is stored in said memory and that corresponds to said leading portion of said portrait border.

17. A bill-detecting device as claimed in claim 14 wherein said control means also compares those portions of said bill-distinguishing signals which were obtained during the sensing of said leading portion of said portrait border with a number that is stored in said memory and that corresponds to said leading portion of said portrait border, and wherein said control means also compares those portions of said bill-distinguishing signals which were obtained during the sensing of said leading portion of said portrait background with a number that is stored in said memory and that corresponds to said leading portion of said portrait background.

18. A bill-detector as claimed in claim 14 wherein no bill-distinguishing signals that were obtained during the sensing of said leading portion of said portrait border and of said leading portion of said portrait background and of said green seal area can be used unless predetermined bill-distinguishing signals were obtained during the sensing of said leading portion of said border of said object if said object is an authentic bill.

19. A bill detector as claimed in claim 14 wherein an authenticity-indicating signal will not be developed if proper bill-distinguishing signals are not obtained during the sensing of said leading portion of said border of said object if said object is an authentic bill.

20. A bill-detector as claimed in claim 14 wherein an authenticity-indicating signal will not be developed if proper bill-distinguishing signals are not obtained during the sensing of said leading portion of said portrait border.

21. A bill-detector as claimed in claim 14 wherein an authenticity-indicating signal will not be developed if proper bill-distinguishing signals are not obtained during the sensing of said leading portion of said portrait background.

22. A bill detector which comprises a sensor, motion-producing means to provide relative movement between said sensor and an object, said relative movement between said sensor and said object being along a predetermined scan path, said scan path crossing an area on said object which would have a plurality of closely spaced lines if said object was an authentic bill, said sensor responding to relative movement between itself and said area to provide a plurality of signals if said object has a plurality of lines in said area, said signals indicating the linear spacing between corresponding points on adjacent sensed lines of said plurality of lines in said area, storage means wherein data representing the linear spacing between corresponding points on lines in the corresponding area on an authentic bill of a predetermined denomination is stored, and control means to determine whether said signals indicate that the linear spacing between corresponding points on said sensed lines on said object match the linear spacing between said corresponding points on said lines on said corresponding area on said authentic bill of said predetermined denomination.

23. A bill detector as claimed in claim 22 wherein said bill detector will exclude, from the determination by said control means, any lines that are spaced too close to or that are spaced too far away from an adjacent sensed line.

24. A bill-detecting device which comprises a sensor, motion-producing means that provides relative movement between said sensor and an object along a predetermined scan path on said object at a predetermined constant speed, said scan path being located so it would cross an area having a plurality of closely-spaced lines if said object was an authentic bill, said sensor developing a predetermined polarity of signals whenever said sensor is in register with one of said lines, means to provide countable time periods, a counter which counts said time periods to determine the length of time said sensor is in register with each of said lines during said relative movement between said sensor and said object and thereby determines the width of each line, said time periods and said counter also determining the length of time said sensor is in register with the space immediately following each sensed line and thereby determining the width of each space, means to check the count in said counter and thereby sense the combined width of each sensed line and the space immediately following said line, and further means to use said combined width of each sensed line and the space immediately following said line to help determine the denomination of said object if said object is an authentic bill.

25. A bill-detecting device as claime in claim 24 wherein a line will not be counted if the width of that line and the width of the space immediately following said line is too small or too large.

26. A bill-detecting device as claimed in claim 24 wherein a running count is made of the sums of the widths of lines and of the spaces immediately following those lines, and wherein said running count is divided by the number of lines whose widths were in said running count to provide an average sum of the width of a line plus the width of the space immediately following said line.

27. A bill-detecting device as claimed in claim 24 wherein a running count is made of the sums of the widths of lines and of the spaces immediately following those lines, wherein said running count is divided by the number lines whose widths were in said running count to provide an average sum of the widths of a line plus the width of the space immediately following said line, and wherein said average sum is used to distinguish between authentic bills of different denominations.

28. A bill-detecting device as claimed in claim 24 wherein a running count is made of the sums of the widths of lines and of the spaces immediately following those lines, wherein said running count is divided by the number of lines whose widths were in said running count to provide an average sum of the width of a line plus the width of the space immediately following said line, and wherein the average sum is used to distinguish bills of one denomination from bills of another denomination which do not have said average sum.

29. A paper currency validator which comprises members that provide relative movement between a bill and a sensor along an elongated path on one face of said bill at a constant speed, starting means responsive to the insertion of a bill to initiate said relative movement between said bill and said sensor, timing means to establish time-related segments along said path, said sensor being adapted to produce bill-distinguishing signals as it senses predetermined ones of said time-related segments, a memory in which said bill-distinguishing signals produced by said sensor are stored, and control means to determine whether said bill-distinguishing signals obtained during the sensing of said ones of said time-related segments are within predetermined limits, said control means being unable to make the determination of whether said bill-distinguishing signals obtained during the sensing of said ones of said time-related segments are within said predetermined limits until two lines have been sensed within a predetermined short time.

30. A paper currency validator as claimed in claim 29 wherein said two lines are in the leading portion of the border of said bill.

31. A bill-handling device that comprises a sensor which can respond to relative movement between itself and a line or area on an object to provide a first signal and subsequently provide a second and oppositely-directed signal, motion-producing means to provide relative movement between said sensor and said object, said sensor responding to relative movement between itself and a line or area on said object, which moves said line or area on said object into register with it, to provide said first signal and thereafter responding to relative movement between itself and said line or area on said object, which moves said line or area on said object out of register with it, to provide said second and oppositely-directed signal, means to indicate the detection of said line or area on said object if said first signal and said second and oppositely-directed signal are produced in a predetermined sequence and are produced within a predetermined short period of time, storage means that stores data representing the detection of said line or area on said object, said sensor responding to relative movement between itself and a further line or area on said object to provide a further signal and then a further oppositely-directed signal, said indicating means indicating the detection of said further line or area on said object if said further signal and said further oppositely-directed signal are produced in a predetermined sequence and are produced within said predetermined short period of time or within an immediately-succeeding further predetermined short period of time, and means that erases from said storage means the memory of the first said line or area if the detection of said first said line or area and if the detection of said further line or area are not accomplished within a short predetermined overall period of time.

32. A bill-handling device that comprises a sensor which can respond to relative movement between itself and a line or area on an object to provide a first signal and subsequently provide a second and oppositely-directed signal, motion-providing means to provide relative movement between said sensor and said object, said sensor responding to relative movement between itself and a line or area on said object, which moves said line or area on said object into register with it, to provide said first signal and thereafter responding to relative movement between itself and said line or area on said object, which moves said line or area on said object out of register with it, to provide said second and oppositely-directed signal, means to indicate the detection of said line or area on said object if said first signal and said second and oppositely-directed signal are produced in a predetermined sequence and are produced within a predetermined short period of time, storage means that stores data representing the detection of said line or area on said object, said sensor responding to relative movement between itself and a further line or area on said object to provide a further signal and then a further oppositely-directed signal, said indicating means indicating the detection of said further line or area on said object if said further signal and said further oppositely-directed signal are produced in a predetermined sequence and are produced within said predetermined short period of time or within an immediately-succeeding further predetermined short period of time, means that erases from said storage means the memory of the first said line or area if the detection of said first line or area and the detection of said further line or area are not accomplished within a short predetermined overall period of time, an authenticity-determining means that will rely upon said further signal and said further oppositely-directed signal to determine the authenticity of said object, and further means that will prevent said authenticity-determining means from utilizing said further signal and said further oppositely-directed signal in the event said erasing means erases the memory of the sensing of said first said line or area.

33. A bill-handling device that comprises a magnetic head, motion-producing means to provide relative movement between said magnetic head an an object, said magnetic head responding to relative movement between itself and magnetic lines or areas on said object to provide bill-distinguishing signals, said motion-producing means providing relative movement between said magnetic head and said object along a predetermined scan path on said object, said scan path intersecting an area which would have a limited number of magnetic lines and a number of non-magnetic lines or areas thereon if said object was an authentic bill, and means to reject said object if no signals or too many signals are obtained from said magnetic head during the sensing of said area which would have both magnetic and non-magnetic lines or areas thereon if said object was an authentic bill, whereby said bill-handling device can reject counterfeit bills that are made by photocopying machines which use non-magnetic particles to form the lines and areas on said counterfeit bills and also can reject counterfeit bills that are made by photocopying machines which use magnetic particles to form the lines and areas on said counterfeit bills.

34. A bill-handling device that comprises a magnetic head, motion-producing means to provide relative movement between said magnetic head and an object, said magnetic head responding to relative movement between itself and magnetic lines or areas on said object to provide bill-distinguishing signals, said motion-producing means providing relative movement between said magnetic head and said object along a predetermined scan path on said object, said scan path intersecting an area which would have both magnetic and non-magnetic lines or areas thereon if said object was an authentic bill, and means to reject said object if the number of signals obtained from said magnetic head during the sensing of said area, which would have both magnetic and non-magnetic lines or areas thereon if said object was an authentic bill, is below a predetermined number or is above a further predetermined number, said rejecting means including a memory in which said predetermined number and said further predetermined number are stored and also including means to count the number of bill-distinguishing signals obtained, during the sensing of said area which would have both magnetic and non-magnetic lines or areas thereon if said object was an authentic bill, and to compare the resulting number with said predetermined number and with said further predetermined number.

35. A bill-handling device that comprises a magnetic head, motion-producing means to provide relative movement between said magnetic head and an object, said magnetic head responding to relative movement between itself and an area on said object where both magnetic lines and non-magnetic lines would be located if said object was an authentic bill to produce signals corresponding to said magnetic lines but not to produce signals corresponding to said non-magnetic lines of said area, means to collect and store signals which are produced by said magnetic head as the air gap of said magnetic head engages and moves past magnetic lines of said area, and further means to determine whether the signals, that are collected during the sensing, by said magnetic head, of said area on said object where both magnetic lines and non-magnetic lines would be located if said object was an authentic bill, are within a predetermined range.

36. A bill detector which comprises a sensor, motion-producing means to provide relative movement between said sensor and an object, said relative movement between said sensor and said object being along a predetermined scan path, said scan path crossing an area on said object which would have a plurality of closely spaced lines if said object was an authentic bill, said sensor responding to relative movement between itself and said area to provide a plurality of signals if said object has a plurality of lines in said area, said signals indicating the linear spacing between corresponding points on adjacent sensed lines of said plurality of lines in said area, storage means wherein data representing the linear spacing between corresponding points on lines in the corresponding area on an authentic bill of a predetermined denomination is stored, control means to determine whether said signals indicate that the linear spacing between corresponding points on said sensed lines on said object match the linear spacing between said corresponding points on said lines on said corresponding area on said authentic bill of said predetermined denomination, and averaging means that causes said bill detector to average the linear spacings indicated by said signals.

37. A bill detector which comprises a sensor, motion-producing means to provide relative movement between said sensor and an object, said relative movement between said sensor and said object being along a predetermined scan path, said scan path crossing an area on said object which would have a plurality of closely spaced lines if said object was an authentic bill, said sensor responding to relative movement between itself and said area to provide a plurality of signals if said object has a plurality of lines in said area, said signals indicating the linear spacing between corresponding points on adjacent sensed lines of said plurality of lines in said area, storage means wherein data representing the linear spacing between corresponding points on lines in the corresponding area on an authentic bill of a predetermined denomination is stored, control means to determine whether said signals indicate that the linear spacing between corresponding points on said sensed lines on said object match the linear spacing between said corresponding points on said lines in said corresponding area on said authentic bill of said predetermined denomination, means which causes said bill detector to exclude, from the determination by said control means, any sensed lines that are spaced too close to or that are spaced too far away from an adjacent sensed line, wherein a count is kept of the number of times, during the sensing of an object, when a sensed line is excluded, and means to effect the rejection of said object if said count reaches a predetermined value.

38. The method of determining the authenticity of a bill which comprises providing relative movement between said bill and a sensor along a scan path which passes through the border of the engraving on said bill and also through the border of the portrait on said bill, storing signals which are developed by said sensor during the sensing of said border of the engraving, storing signals developed by said sensor during the sensing of said portrait border, rejecting said bill if the data obtained during the sensing of said border of the engraving does not meet a predetermined standard, and rejecting said bill if the data obtained during the sensing of said portrait border does not meet a second standard.

39. The method of determining the authenticity of a bill which comprises providing relative movement between said bill and a sensor along a scan path which passes through the portrait border and the portrait background to enable said sensor to develop bill-distinguishing signals, storing signals developed as said sensor senses said portrait border, storing further signals developed as said sensor senses said portrait background, rejecting said bill if the further signals developed during the sensing of said portrait border do not meet a predetermined standard, and rejecting said bill if the further signals developed during the sensing of said portrait background do not meet a second predetermined standard.

40. The method of determining the authenticity and denomination of a bill which comprises providing relative movement between a sensor and said bill along a scan path which crosses the portrait border, the portrait background and the green seal area on a bill, storing bill-distinguishing signals developed by said sensor during the sensing of said portrait border, storing bill-distinguishing signals developed by said sensor during the sensing of said portrait background, storing bill-distinguishing signals developed by said sensor during the sensing of said green seal area, comparing the bill-distinguishing signals developed during said sensing of said portrait background with stored data to distinguish one dollar and five dollar bills from the group of bills including two dollar, ten dollar and twenty dollar bills, comparing the bill-distinguishing signals developed during said sensing of said green seal area with stored data to distinguish twenty dollar bills from two dollar and ten dollar bills, and comparing the bill-distinguishing signals developed during said sensing of said portrait border with stored data to discriminate between two dollar and ten dollar bills.

41. The method of determining the authenticity of an object which comprises sensing an area on that object which corresponds to at least a part of the portrait background on an authentic bill, sensing for the widths of a predetermined minimum number of lines and spaces in said area, rejecting data which is obtained during said sensing which indicates that the sum of a line width and space width is not within a predetermined range of the sums of line widths and space widths, summing the total widths of said predetermined minimum number of lines and of the widths of the succeeding spaces, obtaining the average combined width of said lines and spaces, and rejecting said object if said combined width of said lines and spaces does not fall within a predetermined range.

42. The method of determining the authenticity and denomination of a one dollar bill which comprises providing relative movement between said bill and a sensor along a scan path which passes through a portrait background and the green seal area on said bill to develop bill-distinguishing signals corresponding to said portrait background and to develop further bill-distinguishing signals corresponding to said green seal area, comparing the bill-distinguishing signals developed during the sensing of said portrait background with stored data to determine that said bill is a one dollar bill and is authentic and comparing the bill-distinguishing signals developed during the sensing of said green seal area with stored data to additionally determine that said bill is authentic.

43. The method of determining the authenticity and denomination of a two dollar bill which comprises providing relative movement between said bill and a sensor along a scan path which passes through the portrait border, the portrait background and the green seal area of said bill, using the data obtained during the sensing of said portrait background to distinguish said two dollar bill from one dollar bills and five dollar bills, using the data obtained during the sensing of said green seal area to distinguish said two dollar bill from a twenty dollar bill, using the spacing between the second and third lines in the portrait border to help distinguish said two dollar bill from a ten dollar bill, using the spacing between the third line and the fourth line in the portrait border to help distinguish said two dollar bill from a ten dollar bill, and using the spacing between the first and second lines in the portrait border to help distinguish said two dollar bill from a ten dollar bill.

44. The method of determining the authenticity and denomination of a ten dollar bill which comprises providing relative movement between said bill and a sensor along a scan path which passes through the portrait border, the portrait background and the green seal area of said bill, using the data obtained during the sensing of said portrait background to distinguish said ten dollar bill from one dollar bills and five dollar bills, using the data obtained during the sensing of said green seal area to distinguish said ten dollar bill from a twenty dollar bill, using the spacing between the second and third lines in the portrait border to help distinguish said ten dollar bill from a two dollar bill, using the spacing between the third line and the fourth line in the portrait border to help distinguish said ten dollar bill from a two dollar bill, and using the spacing between the first and second lines in the portrait border to help distinguish said ten dollar bill from a two dollar bill.

45. The method of determining the authenticity and denomination of a twenty dollar bill which comprises providing relative movement between said bill and a sensor along a scan path which passes through the portrait border, the portrait background and the green seal area of said bill, using the data obtained during the sensing of said portrait background to distinguish said twenty dollar bill from one dollar bills and five dollar bills, using the data obtained during the sensing of said green seal area to distinguish said twenty dollar bill from two dollar and ten dollar bills, and using the spacing between the second and third lines in the portrait border to determine the authenticity of said twenty dollar bill.

46. The method of determining the authenticity and denomination of a five dollar bill which comprises providing relative movement between said bill and a sensor along a scan path which passes through the portrait background and the green seal area on said bill to develop bill-distinguishing signals corresponding to said portrait background and to develop further bill-distinguishing signals corresponding to said green seal area, comparing the bill-distinguishing signals developed during the sensing of said portrait background with stored data to determine that said bill is authentic and is a five dollar bill and comparing the bill-distinguishing signals developed during the sensing of said green seal area with stored data to additionally determine that said bill is authentic.

* * * * *